US011746525B2

(12) United States Patent
Thomson

(10) Patent No.: US 11,746,525 B2
(45) Date of Patent: Sep. 5, 2023

(54) MODULAR PARTITION SYSTEM

(71) Applicant: ULTRAFRAME (UK) LIMITED, Clitheroe (GB)

(72) Inventor: Andrew Thomson, Clitheroe (GB)

(73) Assignee: ULTRAFRAME (UK) LIMITED, Lancashire (GB)

( * ) Notice: Subject to any disclaimer, the term of this patent is extended or adjusted under 35 U.S.C. 154(b) by 195 days.

(21) Appl. No.: 16/499,586

(22) PCT Filed: Mar. 29, 2018

(86) PCT No.: PCT/GB2018/050896
§ 371 (c)(1),
(2) Date: Sep. 30, 2019

(87) PCT Pub. No.: WO2018/178726
PCT Pub. Date: Oct. 4, 2018

(65) Prior Publication Data

US 2020/0056373 A1 Feb. 20, 2020

(30) Foreign Application Priority Data

Mar. 31, 2017 (GB) ..... 1705227

(51) Int. Cl.
*E04C 2/24* (2006.01)
*E04B 1/14* (2006.01)
(Continued)

(52) U.S. Cl.
CPC ..... *E04C 2/243* (2013.01); *E04B 1/14* (2013.01); *E04B 1/6116* (2013.01); *E04B 7/225* (2013.01); *E04C 3/18* (2013.01); *E04C 3/292* (2013.01)

(58) Field of Classification Search
CPC . E04C 2/243; E04C 3/18; E04C 3/292; E04B 1/14; E04B 1/6116; E04B 7/225;
(Continued)

(56) References Cited

U.S. PATENT DOCUMENTS 1,990,656 A * 2/1935 Kotrbaty ..... E04B 1/6158 52/354
2,394,443 A 2/1946 Guignon, Jr.
(Continued)

FOREIGN PATENT DOCUMENTS

CA 2226584 A1 9/1999
CN 1078762 A 11/1993
(Continued)

OTHER PUBLICATIONS

Machine Translation of French Patent FR 1504427A obtained from the European Patent Office (last accessed on Dec. 4, 2021 at https://www.epo.org/) (Year: 1967).*
(Continued)

*Primary Examiner* — Brian D Mattei
*Assistant Examiner* — Charissa Ahmad
(74) *Attorney, Agent, or Firm* — Barnes & Thornburg LLP

(57) ABSTRACT

A modular partition system comprises a plurality of panels and at least one connecting strip. Each of the plurality of panels comprises two support members extending generally perpendicularly to a plane of the modular partition system and a central panel extending between said two support panels. The plurality of panels are arranged such that the central panels of each of the plurality of panels are generally mutually parallel and one support member of each of the plurality of panels is adjacent to a support member of an adjacent panel. The at least one connecting strip cooperates with a support member from each of two of the plurality of
(Continued)

adjacent panels so as to connect said two of the plurality of adjacent panels.

17 Claims, 35 Drawing Sheets

(51) Int. Cl.
*E04B 1/61* (2006.01)
*E04B 7/22* (2006.01)
*E04C 3/18* (2006.01)
*E04C 3/292* (2006.01)

(58) Field of Classification Search
CPC ..... E04B 1/34321; E04B 2001/6195; E04B 1/6108; E04B 1/6112
See application file for complete search history.

(56) References Cited

U.S. PATENT DOCUMENTS 2,963,825 A * 12/1960 Douglas, Jr. ..... E04B 5/046 52/94
3,378,977 A * 4/1968 Vervloet ..... E04B 2/78 52/481.2
3,392,497 A * 7/1968 Cushman ..... E04B 1/6183 52/272
3,432,196 A * 3/1969 Marchiorello ..... F25D 23/063 52/584.1
3,512,819 A 5/1970 Gillingwater et al.
3,594,028 A * 7/1971 Scott ..... E04F 13/0803 52/465
3,640,039 A 2/1972 McKee et al.
3,789,567 A * 2/1974 Rae ..... E04B 2/7881 52/584.1
3,793,789 A * 2/1974 Greenamyer ..... E04B 1/10 52/463
3,861,101 A * 1/1975 Whisson ..... A47B 96/1466 52/238.1
3,896,598 A * 7/1975 Yoshida ..... E04B 1/6112 52/766
4,019,302 A 4/1977 Meyer
4,067,159 A * 1/1978 Juriss ..... E04B 1/34853 52/234
4,075,811 A 2/1978 Keith
4,114,333 A * 9/1978 Jones ..... E04B 2/7411 52/745.1
4,261,143 A * 4/1981 Rizzo ..... E04D 13/064 52/11
4,435,935 A * 3/1984 Larrea ..... E04B 1/617 52/461
4,455,803 A 6/1984 Kornberger
4,526,024 A 7/1985 Toti
4,852,317 A * 8/1989 Schiavello ..... E04B 2/7424 52/239
4,872,297 A * 10/1989 Hetzel ..... E04B 7/04 52/91.1
5,348,790 A * 9/1994 Ben-Zvi ..... E04C 2/34 428/116
5,644,878 A 7/1997 Wehrmann
5,647,181 A * 7/1997 Hunts ..... A63H 33/10 312/111
5,651,220 A * 7/1997 dit Felix ..... E04B 1/6116 52/285.3
6,250,042 B1 6/2001 Rudd
6,536,175 B2 * 3/2003 Conterno ..... E04C 2/543 52/762
7,926,236 B2 * 4/2011 Konstantin ..... E04C 2/543 52/459
8,056,289 B1 * 11/2011 Konstantin ..... E04D 3/355 52/204.591
8,316,609 B2 * 11/2012 Ben-Zvi ..... E04D 3/28 52/459
8,347,569 B1 1/2013 McIntyre et al.
9,267,521 B2 * 2/2016 Baillie ..... B65D 88/40
9,428,903 B2 * 8/2016 West ..... E04D 13/147
9,518,385 B2 * 12/2016 Weber ..... E04F 15/02
2004/0221526 A1 * 11/2004 Rinehart ..... B32B 17/10816 156/99
2009/0056255 A1 3/2009 Barton
2009/0272056 A1 11/2009 Koupal

FOREIGN PATENT DOCUMENTS

CN 1163967 A 11/1997
CN 1191004 A 8/1998
CN 2403837 Y 11/2000
CN 1543526 A 11/2004
CN 1651676 A 8/2005
CN 1842630 A 10/2006
CN 103814181 A 5/2014
DE 1240261 B 5/1967
DE 3132152 A1 * 6/1982 ..... E04D 3/3602
EP 3106582 A1 12/2016
EP 3786382 A1 * 3/2021 ..... E04B 2/821
FR 1028791 A 5/1953
FR 1504427 A * 12/1967 ..... E04B 1/6116
FR 1532244 A * 7/1968 ..... E04D 13/151
FR 1559156 A * 3/1969 ..... E04B 1/6116
FR 2036868 A6 * 12/1970 ..... E04B 1/6116
FR 2042252 A5 * 2/1971 ..... E04B 1/34331
FR 2071375 A5 * 9/1971 ..... E04B 2/7457
FR 2131811 A2 * 11/1972 ..... E04B 2/7854
FR 2436226 A1 * 4/1980 ..... E04B 1/6162
FR 2586732 A * 3/1987 ..... E04B 2/78
GB 2067619 A 7/1981
GB 2346626 A 8/2000
GB 2496130 A * 5/2013 ..... E04B 9/00
JP H06316992 A 11/1994
JP H09280548 H 10/1997
JP H10183860 A 7/1998
JP H11124939 A 5/1999
JP 2000064515 A 2/2000
JP 2001-081890 A 3/2001
JP 2001152557 A 6/2001
WO WO-9533104 A1 * 12/1995 ..... E04B 1/34321
WO WO-2009137417 A1 * 11/2009 ..... E04B 1/6162

OTHER PUBLICATIONS

UK Intellectual Property Office Search Report for UK Patent App. No. GB1705227.5, dated Aug. 23, 2017; 6 pages.
International Search Report for PCT International Application Serial No. PCT/GB2018/050896, dated Oct. 1, 2019, 10 pages.
EPO Office Action for European Application No. 18 715 951.2, dated Aug. 27, 2020; 6 pages.
Examination Report for Application No. GB1 915847.6, dated Aug. 16, 2021, 1 page.
Official Action issued in connection with Chinese Patent Appln. No. 2012110317307.4 dated Mar. 8, 2022; 17 pages.
Official Action issued in connection with Japanese Patent Appln. No. 2019-553864; dated Mar. 15, 2022; 13 pages.
Japanese Office Action for Application No. 2019-553864, dated Dec. 6, 2022; 7 pages.

* cited by examiner

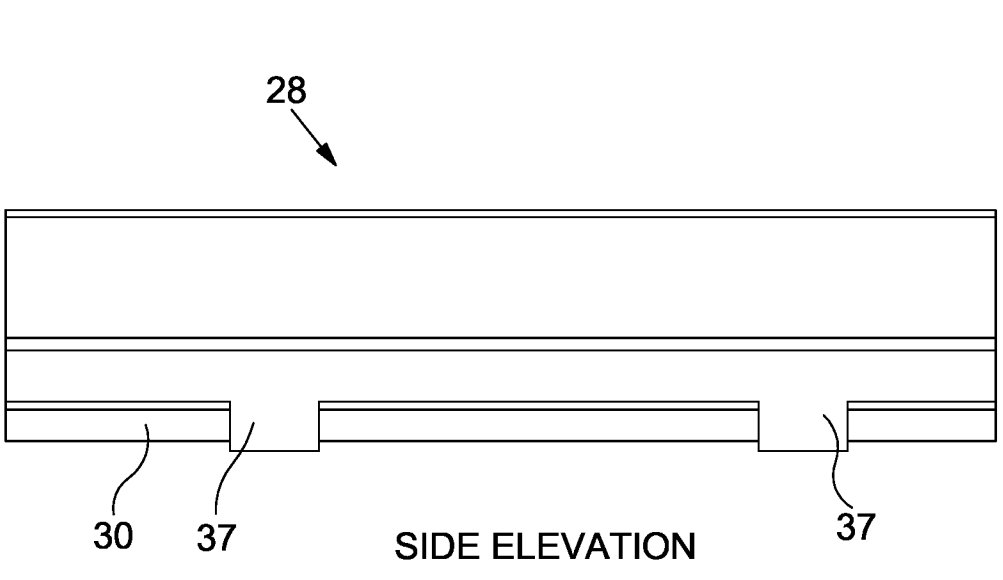
Fig. 8
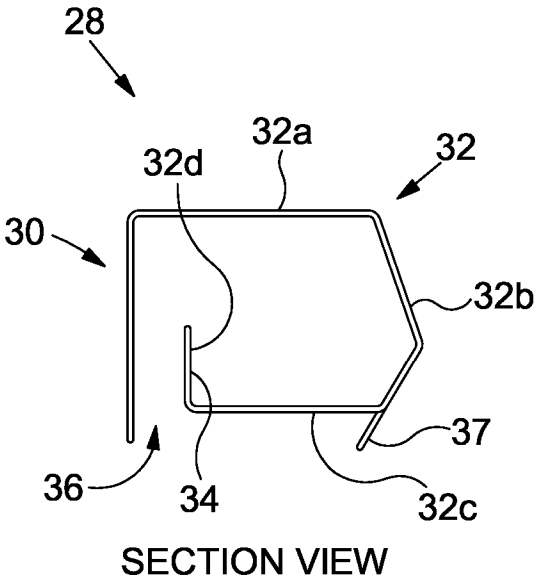

MODULAR PARTITION SYSTEM

The present invention relates to a modular partition system for forming a partition and parts therefor. In particular, but not exclusively, the partition may be a thermally insulating or sound insulating partition. The partition may, for example, form part of a building and may be a roof, a wall or a floor.

Structurally insulating panels (SIPs) provide an alternative to more traditional forms of construction. SIPs comprise an insulation board or panel which is sandwiched between two structural panels. SIPs may be used in the construction of roofs, walls and even floors.

One benefit of construction that uses SIPs is that it aids in the facilitation of offsite construction wherein buildings are fabricated in a factory before being shipped to site. Another benefit of construction that uses SIPs is that it may aid in the construction of a well-insulated and sealed building since generally SIPs are generally manufactured as large sheet materials which may result in fewer joints and less opportunity for air leaks.

Although this type of construction (using SIPs) has various benefits it is not universally adopted because it can be more expensive than other more traditional forms of construction. Therefore, construction that uses SIPs is mainly used where either speed of build or envelope performance are the overriding factors.

It is desirable to provide a system for constructing a partition that at least partially addresses one or more of the problems of the prior art, whether identified herein or elsewhere.

According to a first aspect of the present invention there is provided a modular partition system comprising: a plurality of panels, each of the plurality of panels comprising two support members extending generally perpendicularly to a plane of the modular partition system and a central panel extending between said two support panels, the plurality of panels being arranged such that the central panels of each of the plurality of panels are generally mutually parallel and one support member of each of the plurality of panels is adjacent to a support member of an adjacent panel; and at least one connecting strip; wherein the at least one connecting strip cooperates with a support member from each of two of the plurality of adjacent panels so as to connect said two of the plurality of adjacent panels.

It will be appreciated that as used herein the terms panel, sheet and board are intended to mean a relatively thin, generally flat three-dimensional object or body. It will be further appreciated that by relatively thin it is meant that one dimension of the object or body is smaller than the other two dimensions of the object or body. The smallest dimension of the object or body may be referred to as its thickness. The two dimensions generally perpendicular to the smallest dimension of the object or body may define a plane (or family of parallel planes). Such panels, sheets and boards may, for example, be generally rectangular.

The first aspect of the invention provides a particularly versatile and cost effective system for constructing a partition which provides a number of advantages over the prior art, as now discussed.

In particular, the first aspect of the invention provides a system for constructing a partition which is self-supporting. In particular, the system forms a self-supporting structure which can bear a load such as, for example, a roof, a wall or a floor of a building. Generally, the system comprises a plurality of panels and a pair of connecting strips arranged to cooperate with a support member from each of two adjacent panels. The bulk of each panel is non-load bearing in use and may provide thermal or sound insulation. The support members of two adjacent panels, along with two connecting strips co-operate to form a self-supporting, load bearing I beam.

The modular partition system of the first aspect provides an alternative to prior art construction panels such as, for example, structurally insulating panels (SIPs). Within an SIP the insulation is sandwiched between two structural panels (i.e. two panels placed on the inside and outside surfaces of the construction panel). SIP panels are not only used for roofs but also generally for construction building walls and floors.

Furthermore, SIPs are generally manufactured as large sheet materials that may form an entire, or at least a significant portion of, a partition. This is an intentional feature of prior art SIP systems which is intended to reduce the number of joints in the hope that this will provide less opportunity for air leaks.

Advantageously, the system according to the first aspect of the invention uses panels wherein the support members are disposed on the sides of the central panels extending generally perpendicularly to a plane of the modular partition system. As a result, the modular system according to the first aspect may use significantly less structural support material than is required for an equivalent SIP panel. As a result, the system according to the first aspect is significantly lighter and is significantly cheaper to produce. In addition, since the support members of the panels extend generally perpendicularly to a plane of the modular partition system, there is no need for any load to be transmitted through the central panel (in contrast to SIPs). Therefore, any connection (for example adhesive bonding) between the support members and the central panel does not need to be of high integrity. This further reduces the manufacturing costs of the system of the first aspect relative to the prior art.

Furthermore, contrary to the teachings of the prior art, the modular partition system of the first aspect lends itself better to an arrangement with a larger number of panels and, consequently, a larger number of joins. This has been allowed, at least in part, due to the provision of the at least one connecting strip which cooperates with a support member from each of two of the plurality of adjacent panels so as to aid a structural connection between two adjacent panels. Since the system of the first aspect allows such smaller panels, it can result in a further cost benefit since the quantity of waste material, for example at apertures in the partition (e.g. doors and windows) and at the joins between partitions (e.g. the corner of a room) can be significantly reduced or even eliminated completely.

Furthermore, because the system of the first aspect allows such panels, it can be significantly easier to install. For example, it may be easier for the panels of the system of the first aspect to be manually installed, removing the need for lifting apparatus (e.g. a crane or the like), which can be costly and can lead to costly delays on construction sites (e.g. if the lifting apparatus is temporarily unavailable).

The central panel of each of the plurality of panels may comprise any suitable material.

In some embodiments, the central panel of each of the plurality of panels may comprise a thermally insulating material. For example, the material may be a rigid insulation material such as, for example, expanded polystyrene (EPS), extruded polystyrene (XPS), rigid polyurethane (PUR), polyisocyanurate (PIR). The material may be either closed cell or open cell. Such embodiments, wherein the central panel of each of the plurality of panels comprises a thermally insulating material, may be particularly suitable when the partition forms part of a roof or an external wall of a building.

Alternatively, particularly for embodiments when the partition forms part of an internal wall or floor of a building, the central panel of each of the plurality of panels may comprise a cheap material that merely provides a connection between the two support members of the panel. For example, the material may comprise cardboard.

In some embodiments, the central panel of each of the plurality of panels may comprise a sound insulating material. Such embodiments may be particularly suitable when the partition forms part of an internal wall or floor of a building.

Each of the support members of the plurality of panels may comprise: a support panel extending generally perpendicularly to a plane of the central panel.

The support panels may be formed from any suitable material. Suitable materials may include hardboard and high density fibreboard (HDF).

The support panels may be bonded to the central panels using a suitable adhesive. This may keep the elements of the panel together thus making transportation of the panel (for example to a construction site) easier.

Each of the support members of the plurality of panels may comprise a protruding portion which extends beyond at least one of the surfaces of the central panel.

That is, the panels are arranged such that on each of four edges of the panel, a protruding portion of one of the support members stands proud of the central panel. This offers a further benefit over prior art arrangements (for example SIPs), as now explained. Since each of the support members extends beyond at least one of the surfaces of the central panel the partition does not have a smooth, flat surface. Rather, the protruding portions of the support members from each pair of adjacent panels form a ridge on each surface of the partition (which is generally defined by the generally mutually parallel surfaces of the central panels).

With prior art arrangements, for example SIPs, battens need to be added to the internal surface of the construction panel for fire and electrical cabling reasons. Typically, an internal board (for example plasterboard) is fixed to said battens. When used as a roof, on the external surface of a SIP, battens are attached for supporting roof tiles. However, these battens are required to be held off the external surface of the SIP with a counter batten to aid water drainage. With the system according to the first aspect, the internal battens and the additional external counter battens are not required (due to the ridges on each surface of the partition formed by the protruding portions of the support panels from each pair of adjacent panels).

Each of the support members of the plurality of panels may comprise a flange portion extending generally parallel to the plane of the central panel.

Such an arrangement provides a greater surface area at each end of the support members, which is beneficial for a variety of reasons. First, with this arrangement the profile of the support member is generally half of an I shape. That is, the two support members from two adjacent panels which are in contact together are generally of the form of an I beam. The increased surface area of the support members provided by the flanges better distributes any load carried by the modular partition system. Second, the increased surface area may make it easier for an internal or external cladding to be fixed to the partition.

The modular partition system may further comprise a resilient seal between each pair of adjacent panels.

For example, a side surface of either or both of the two support members may be provided with a sealing material (for example a foam tape or the like).

In at least one direction the at least one connecting strip may extend beyond the support members from the two adjacent panels which it is arranged to cooperate with.

This allows the connecting strip to extend beyond the plurality of panels and over, for example, a beam to help with the connection of the modular partition system to the beam and provide a counter batten on a top surface of the beam.

The at least one connecting strip may be provided with one or more engagement features for engagement with a batten and/or a wall tie.

This further simplifies constructions which use the modular partition system. When used as a roof, a plurality of battens may be provided on an external surface of the modular partition system to support roof tiles. When used as a wall (for example the inner leaf of a cavity wall), a plurality of wall ties may be provided on an external surface of the modular partition system to connect it to an outer leaf of the cavity wall (for example a brick wall).

According to a second aspect of the invention there is provided a panel for a partition, the panel comprising: a central panel; and two support panels disposed on opposed sides of the central panel, each of the two support panels extending generally perpendicularly to a plane of the central panel.

The panel may be suitable for use in the modular partition system of the first aspect of the invention.

The second aspect of the invention provides a construction panel wherein structural support is provided by the two support panels placed on opposite sides of the central panel, which may, for example, be formed from a thermally insulating material. This is in contrast to prior art insulated construction panels such as, for example, structurally insulating panels (SIPs) wherein where the insulation is sandwiched between two structural panels (i.e. two panels placed on the inside and outside surfaces of the construction panel).

Advantageously, a panel according to the second aspect of the invention may use significantly less structural support board than is required for an equivalent SIP panel. Furthermore, the support boards may be thinner than the structural support board that is used in SIP panels. As a result, the panel according to the second aspect is significantly lighter and is significantly cheaper to produce.

In some embodiments, the central panel may comprise a thermally insulating material. For example, the material may be a rigid insulation material such as, for example, expanded polystyrene (EPS), extruded polystyrene (XPS), rigid polyurethane (PUR), polyisocyanurate (PIR). The material may be either closed cell or open cell. Such embodiments, wherein the central panel comprises a thermally insulating material, may be particularly suitable when the panel forms pa part of a roof or an external wall of a building.

Alternatively, particularly for embodiments when the panel forms part of an internal wall or floor of a building, the central panel may comprise a cheap material that merely provides a connection between the two support members of the panel. For example, the material may comprise cardboard.

In some embodiments, the central panel may comprise a sound insulating material. Such embodiments may be particularly suitable when the panel forms part of an internal wall or floor of a building.

The support panels may be formed from any suitable material. Suitable materials may include hardboard and high density fibreboard (HDF).

The support panels may be bonded to the central panel using a suitable adhesive. This may keep the elements of the panel together thus making transportation of the panel (for example to a construction site) easier.

A protruding portion of the each of the two support panels may extend beyond at least one of the faces of the central panel.

That is, the panel is arranged such that on each of four edges of the panel, a protruding portion of one of the support panels stands proud of the central panel. This offers a further benefit over prior art arrangements (for example SIPs), as now explained. A partition may be formed from a plurality of panels according the second aspect, the plurality of panels being arranged in a row such that a support panel of each panel is adjacent to, and in contact with, a support panel of an adjacent panel. Since each of the support panels extends beyond at least one of the sides of the central panel, such a partition formed from a plurality of panels according to the second aspect does not have a smooth, flat surface. Rather, the protruding portions of the support panels from each pair of adjacent panels form a ridge on each surface of the partition (which is generally defined by the surfaces of the central panels).

With prior art arrangements, for example SIPs, battens need to be added to the internal surface of the construction panel for fire and electrical cabling reasons. Typically, an internal board (for example plasterboard) is fixed to said battens. When used as a roofing panel, on the external surface of a SIP, battens are attached for supporting roof tiles. However, these battens are required to be held off the external surface of the SIP with a counter batten to aid water drainage. With the panel according to the second aspect, the internal battens and the additional external counter battens are no required (due to the ridges on each surface of the partition formed by the protruding portions of the support panels from each pair of adjacent panels).

The panel may further comprise a flange extending from at least one protruding portion of the two support panels, said flange extending generally parallel to the plane of the central panel.

Each support panel and the flanges extending therefrom together provide a support member. It will be appreciated that such a support member may be formed from separate support panel and flange members, which are structurally connected. Alternatively, the separate support panel and flange members may be integrally formed.

Such an arrangement provides a greater surface area at each end of the support panels, which is beneficial for a variety of reasons. First, with this arrangement the profile of the support member is generally half of an I shape. That is, in use, when the two support members from two adjacent panels are in contact, together they are generally of the form of an I beam. The increased surface area of the support members provided by the flanges better distributes any load carried by a partition formed from the panels. Second, the increased surface area may make it easier for an internal or external cladding to be fixed to a partition formed from the panels.

The or each flange may be provided by a flange member which is formed from a metal material and which is structurally connected to the support panel.

For example, each flange member may comprise a rolled light gauge steel strip which is mechanically attached to the support panel (which may be formed from a better thermally insulating material such as hardboard). Optionally, each flange member may comprise a timber about which the light gauge steel strip is rolled.

A side surface of either or both of the support panels may be provided with a resilient sealing material.

For example, a foam tape or the like may be applied to one or both sides of the panel. In use, this can enhance the sealing of adjacent panels.

According to a third aspect of the invention there is provided a connecting strip for use in the modular partition system of the first aspect of the invention, the connecting strip comprising: an elongate body defining a groove for receipt of a portion of a support member from each of two of a plurality of adjacent panels; wherein the elongate body is provided with one or more engagement features for engagement with a batten and/or a wall tie.

The engagement features may be provided at any convenient separation along the connecting strip.

Each engagement feature may comprise at least one pair of protrusions, each of the protrusions defining a guide channel for at least part of a batten, the guide channels of the pair of protrusions facing each other.

Each protrusion may be generally L shaped and may comprise a first portion which extends generally perpendicularly from a surface of the connecting strip and a second portion, distal from said surface of the connecting strip which extends generally parallel to said surface of the connecting strip so as to define the guide channel.

Each each engagement feature may comprise two pairs of protrusions.

In use, a batten may be installed by sliding it in a direction generally parallel to the batten (and generally perpendicular to the connecting strip) so that a side portion of the batten is received in each of the guide channels formed by the at least one pair of protrusions.

Each engagement feature may comprise at least one generally L shaped protrusion defining a guide channel for receipt of a batten.

In use, the connecting strip is installed such that the guide channels defined by the protrusions face generally upwards (for example towards a ridge beam).

A timber batten or the like may be installed by sliding it into the guide channels of a plurality of said connecting strips in a direction generally perpendicular to the batten (and generally parallel to the connecting strips).

On either side of the groove the elongate body may define a plurality of pairs of features for engaging the ends of a wire wall tie.

According to a fourth aspect of the invention there is provided a building comprising the modular partition system of the first aspect of the invention.

The modular partition system may form any of the following: a roof partition, a wall or a floor within the building.

According to a fifth aspect of the invention there is provided a kit of parts for a modular partition system comprising: a plurality of panels, each of the plurality of panels comprising two support members extending generally perpendicularly to a plane of the modular partition system and a central panel extending between said two support panels, the plurality of panels being arranged such that the central panels of each of the plurality of panels are generally mutually parallel and one support member of each of the plurality of panels is adjacent to a support member of an adjacent panel; and at least one connecting strip arranged to cooperate with a support member from each of two of the plurality of adjacent panels so as to connect said two of the plurality of adjacent panels.

Each of the plurality of panels may comprise a panel according to the second aspect of the invention.

The at least one connecting strip may comprises a connecting strip according to the third aspect of the invention.

The kit of parts may further comprise at least one resilient seal for sealing a gap between each pair of adjacent panels.

For example, a side surface of either or both of the two support members may be provided with a sealing material (for example a foam tape or the like).

According to a sixth aspect of the invention there is provided a support beam comprising: a web panel having first and second opposed surfaces; a first flange attached to the web panel proximate a first edge of the web panel; and a second flange attached to the web panel proximate to the second edge of the web panel, wherein the first and second flanges are formed from a metal material; and wherein the first and second flanges are each attached to the first and second opposed surfaces.

The support beam is generally of the form of an I beam. The support beam may be suitable for use as a joist in part of a surface such as a floor, wall or ceiling.

The support beam according to the first aspect of the present invention is advantageous over known support beams, as now discussed.

Traditional floor joists are formed from solid timber beams. It has become increasingly common to use an I beam construction for floor joists. One known type of I beam that is used as a floor joist in the construction of buildings comprises a web formed from oriented strand board (OSB) and two solid flanges formed from timber. The OSB web is partially received in a groove in each of the solid timber flanges and attached thereto using adhesive to provide a connection which can resist shear forces.

In contrast to such known I beams or I joists, the support beam according to the first aspect of the present invention uses first and second flanges which are formed from a metal material. This offers a significant advantage over the known arrangement since, unlike timber, metal materials may be formed to arbitrary lengths, for example using a range of continuous processes. Therefore, the support beam according to the first aspect of the present invention can be easily manufactured to a range of different lengths. This allows the support beam to be manufactured to the required length for each purpose with substantially no waste.

Furthermore, there are a number of additional advantages of using metal flanges as opposed to timber flanges, including cost, weight and formability.

In addition, the support beam is formed from three parts (the web panel, the first flange and the second flange), which are attached together (the first and second flanges being attached to the first and second opposed surfaces of the web panel). This provides significant advantages over, for example, a typical rolled steel joist (RSJ) which is typically formed entirely from solid steel. This construction, whereby the support beam is formed from three parts which are attached together, advantageously, allows the use of more economical and lighter materials to be used for the web panel. Furthermore, it allows the first and second flanges to be formed as generally tubular or hollow structures, providing further cost and weight savings.

The support beam according to the first aspect comprises first and second flanges which are metal and which are attached to the first and second opposed surfaces of the web panel. It will be appreciated that the attachment of the first and second flanges to the web panel is an attachment which provides resistance to shear forces (the shear plane of the support beam being the plane of the web panel).

It will be further appreciated that as used herein the terms panel, sheet and board are intended to mean a relatively thin, generally flat three-dimensional object or body. It will be further appreciated that by relatively thin it is meant that one dimension of the object or body is smaller than the other two dimensions of the object or body. The smallest dimension of the object or body may be referred to as its thickness. The two dimensions generally perpendicular to the smallest dimension of the object or body may define a plane (or family of parallel planes). Such panels, sheets and boards may, for example, be generally rectangular.

It will be appreciated that the first and second flanges extend beyond the first and second surfaces of the web panel in a direction generally perpendicular to a plane of the panel.

The web panel may comprise engineered wood.

For example, the web panel may comprise a composite material board or panel. For example, the web panel may comprise OSB, hardboard, mdf, chipboard, plywood or the like.

The web panel may comprise a single panel.

Such embodiments may be preferred over, for example, embodiments comprising two or more panels since such arrangements with two or more panels would require some physical connection that can tie them together so as to resist shear forces (in the plane of the web panel).

In cross section the first and/or second flanges may be of the form of a hollow or tubular structure.

In cross section the first and/or second flanges may comprise a continuous loop of material from the first surface to the second surface.

In cross section the continuous loop of material from the first surface to the second surface may be generally uniform in cross section.

The continuous loop of material may comprise a first portion that is in contact with the first surface and a second portion that is in contact with the second surface.

The first and/or second flanges may be formed from sheet metal.

For example, the sheet metal may be formed by a light gauge steel strip. The sheet metal may, for example, be folded or rolled to form the first and second flanges.

Alternatively, the first and second flanges may be formed using another process, for example a continuous process such as extrusion.

As previously discussed, the attachment of the first and second flanges to the first and second surfaces of the web panel is an attachment which provides resistance to shear forces (the shear plane of the support beam being the plane of the web panel).

The attachment of the first and second flanges to the first and second surfaces of the web panel may prevent movement of the first and second flanges relative to the web panel. The attachment of the first and second flanges to the first and second surfaces of the web panel may be sufficient to resist shear forces of the order of 2.5 kN or more.

It will be appreciated that the attachment of the first and second flanges to the first and second surfaces of the web panel may be achieved in a variety of different ways.

The attachment of the first and/or second flanges to the first and second surfaces of the web panel may be via surfaces of the first and/or second flanges which are complementary to and in engagement with the first or second surfaces.

It will be appreciated that such an engagement may be achieved via plastic deformation of the mutually engaging surfaces (which may be flat prior to said plastic deformation). Such plastic deformation may be achieved, for example, by using a punch to crimp the two surfaces together. For example, a punch may be used to cause the first and second flanges to bite into the web panel.

Alternatively, the attachment of the first and second flanges to the first and second surfaces of the web panel may be achieved using screws, nails, rivets or other mechanical fixing.

The first and/or second flanges may comprise: a wall portion which is generally perpendicular to a plane of the web panel.

The wall portion may be provided with a feature for engagement with the first or second edge of the web panel.

Such an engagement feature may, for example, be formed on an interior surface of the first and second flanges.

The support beam may further comprise a resiliently deformable member provided on the wall portion of at least one of the first and second flanges.

Such a resiliently deformable member may provide some reduction in the amount of sound that is transmitted through a structure formed using the support beam. For example, the support beam may form a joist for a floor. For example, the resiliently deformable member may be provided on one of the first and second flanges that in use will form a top of the joist (and which may support floorboards or the like). The resiliently deformable member can absorb some sound and therefore at least partially prevent sound from being transmitted through the floor.

The resiliently deformable may comprise a foam material.

The support beam may further comprise at least one elongate metal member, the elongate member being movably connected to the first or second flange and the resiliently deformable member being disposed between the elongate metal member and the first or second flange.

For example the elongate metal member may be formed from a light gauge steel strip that is shaped such that it can engage over the first or second flange using a snap fit type coupling such that the resiliently deformable is held captive between the elongate metal member and the first or second flange. Advantageously, this provides an integrated arrangement that aids the ease of installation of such soundproofing solutions.

A known and currently used method to prevent sound transmission through an intermediate floor is to screw resilient bars, in the form of a light gauge steel Z-section, to the bottom surface of timber floor joists. A ceiling substrate (for example plasterboard) is then attached to the resilient bars, which reduce the transmission of sound from the floor to a space there below.

The support beam may further comprise one or more engagement features for connection to a resilient bar, the one or more engagement features being provided on the wall portion of at least one of the first and second flanges.

For example, the engagement features for connection to a resilient bar may be of the form of one of more generally L-shaped protrusions from the wall portion, said protrusions forming a groove for receipt of a portion of a resilient bar. Including these engagement features, for example on one of the first and second flanges that in use will form a bottom of the support beam will improve compliance and speed up installation. The ease of provision of such features on the first and second flanges is a further advantage of the support beam according to the first aspect of the invention, which uses metal flanges.

The support beam may further comprise one or more hanging features for connection to a supporting structure that is generally perpendicular to the support beam, the one or more hanging features being provided on at least one of the first and second flanges.

Steel joist hangers are used to support the ends of a beam at a supporting structure that is generally perpendicular to the beam (for example a wall or a perpendicular supporting beam). Light gauge steel is used and requires many fixings between the joist hanger and the beam to ensure the structural performance. It is common in construction for installers to not put enough in fixings in (saving time). The one or more hanging features are integrally formed with the support beam and therefore facilitate quick and safe installation.

According to a seventh aspect of the invention there is provided a support beam comprising: a plurality of the support beams according to the sixth aspect of the invention, the plurality of support beams being arranged so as to be mutually adjacent and parallel; a first elongate connection member arranged to connect to the first flanges of the all of the plurality of support beams; and a second elongate connection member arranged to connect to the second flanges of the all of the plurality of support beams.

For example the first and second elongate connection members may be formed from a light gauge steel strip that is shaped such that it can engage over the first or second flanges of all of the plurality of support beams using a snap fit type coupling. Additional fixings may be provided between the first and second elongate connection members and the first or second flanges of all of the plurality of support beams.

In the design of an intermediate floor or similar a beam may be required to carry several other beams or joists. The support beam according to the second aspect of the invention provides an arrangement having increased strength and second moment of area suitable for such applications.

According to an eighth aspect of the invention there is provided a method of forming the support beam according to the sixth aspect of the invention, the method comprising: providing a web panel; providing a first flange formed from a metal material; providing a second flange formed from a metal material; attaching the first flange to the web panel proximate a first edge of the web panel; and attaching the second flange to the web panel proximate to a second edge of the web panel; and wherein the first and second flanges are each attached to first and second opposed surfaces of the web panel.

Attaching the first flange to the web panel proximate a first edge of the web panel may comprise: positioning the first flange adjacent to the first edge of the web panel such that a first portion of the first flange is adjacent the first surface of the web panel and a second portion of the first flange is adjacent the second surface of the web panel; and using a punch to crimp the first portion of the first flange to the first surface of the web panel in at least one position; and using a punch to crimp the second portion of the first flange to the second surface of the web panel in at least one position.

Attaching the second flange to the web panel proximate a second edge of the web panel may comprise: positioning the second flange adjacent to the second edge of the web panel such that a first portion of the second flange is adjacent the first surface of the web panel and a second portion of the second flange is adjacent the second surface of the web panel; and using a punch to crimp the first portion of the second flange to the first surface of the web panel in at least one position; and using a punch to crimp the second portion of the second flange to the second surface of the web panel in at least one position.

Various aspects and features of the invention set out above or below may be combined with various other aspects and features of the invention as will be readily apparent to the skilled person.

Embodiments of the invention will now be described, by way of example only, with reference to the accompanying schematic drawings in which corresponding reference symbols indicate corresponding parts, and in which:

FIG. 8 shows various views of a reinforcing rail which forms part of the second panel shown in FIG. 7;

Figure 9A:
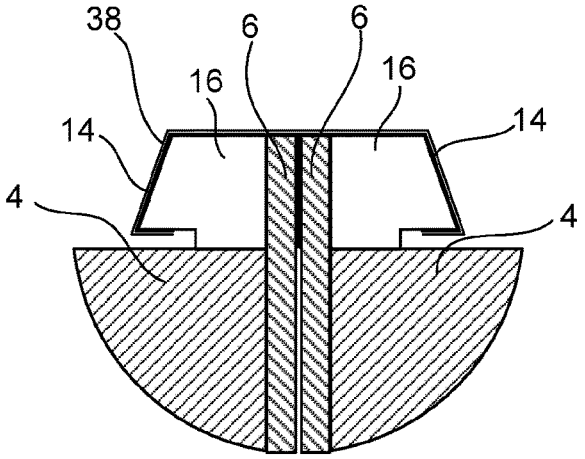
Figure 9B:
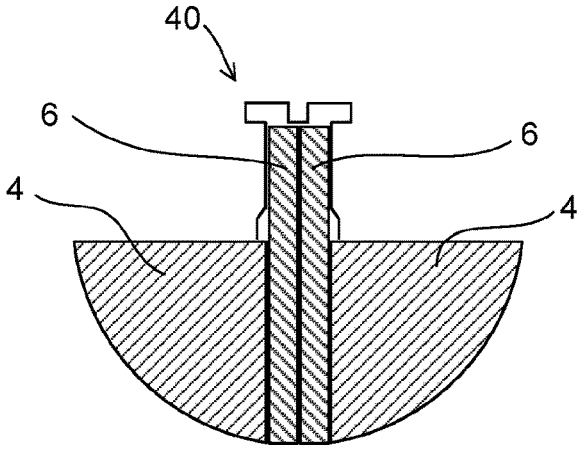
Figure 9C:
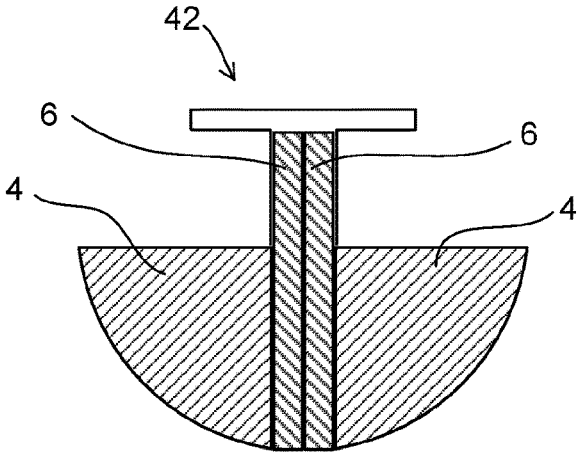
Figure 10:
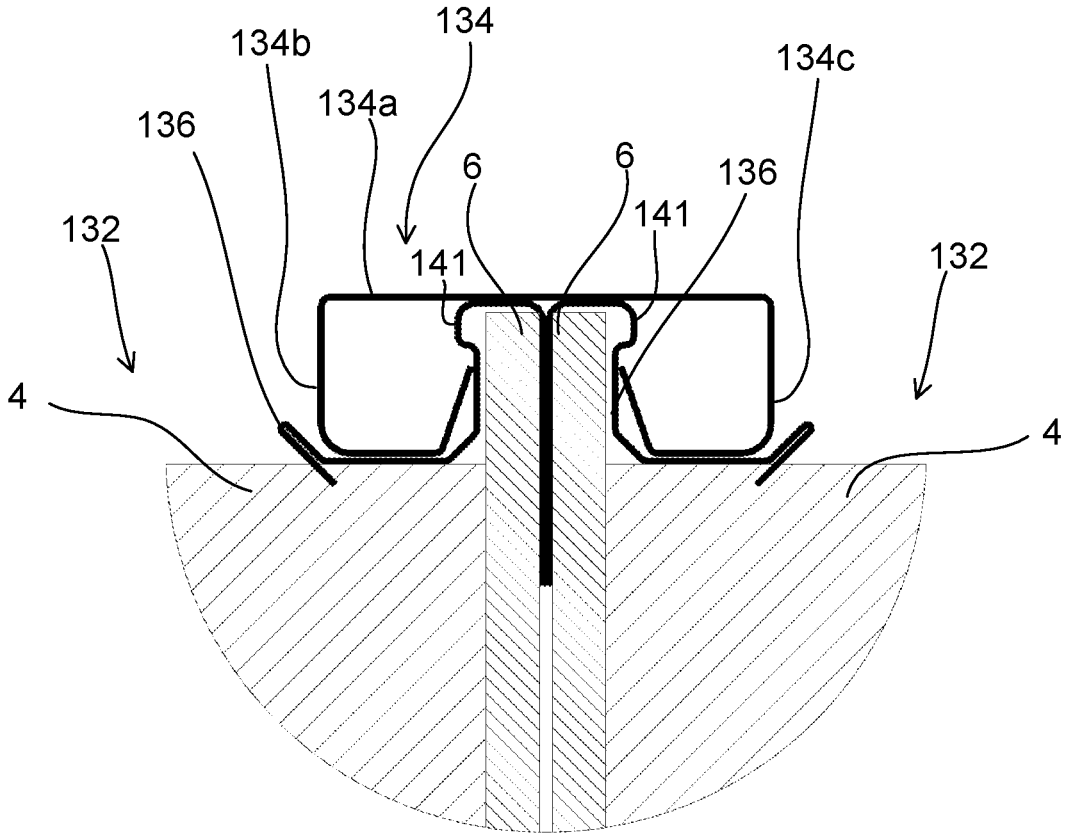
Figure 11B:
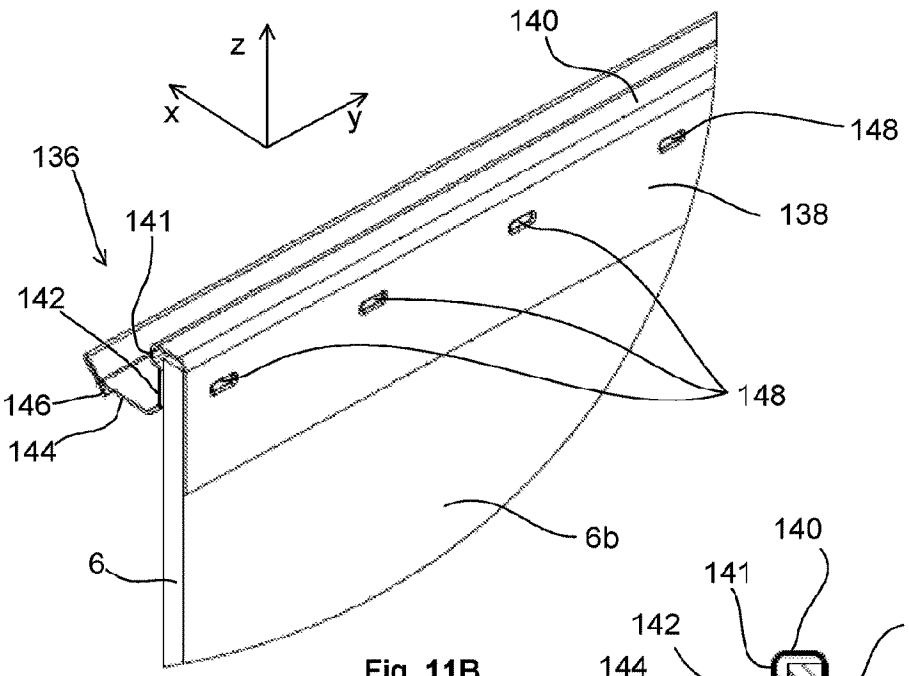
Figure 11C:
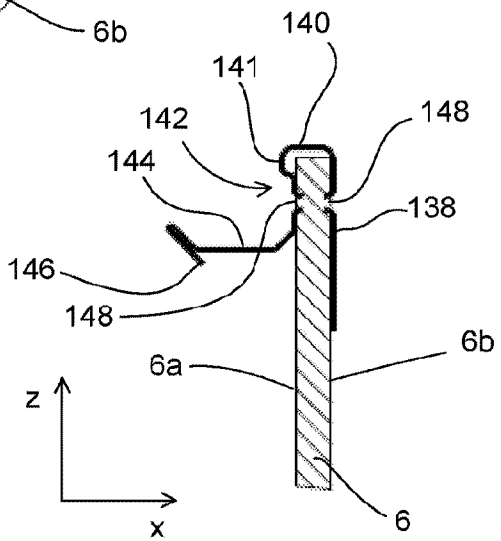
Figure 11A:
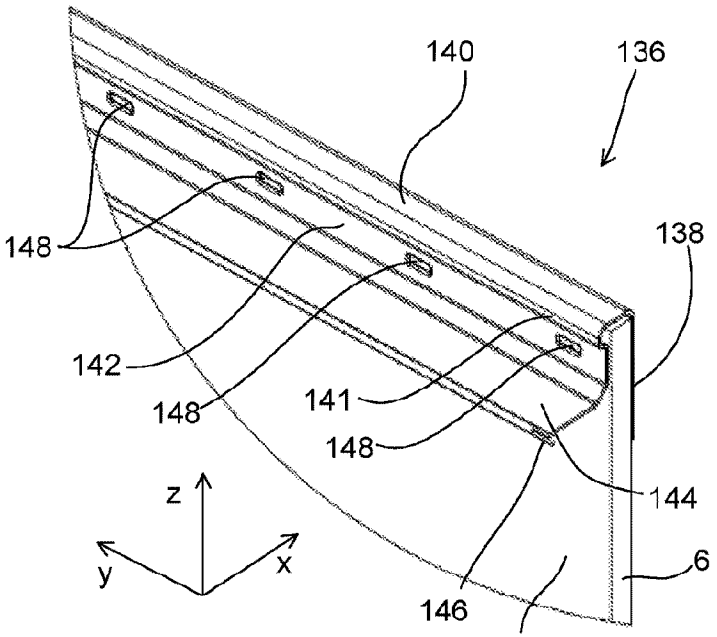
Figure 11D:
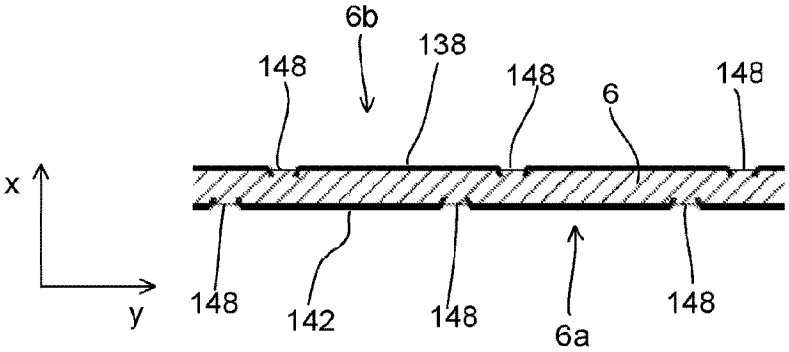
Figure 12A:
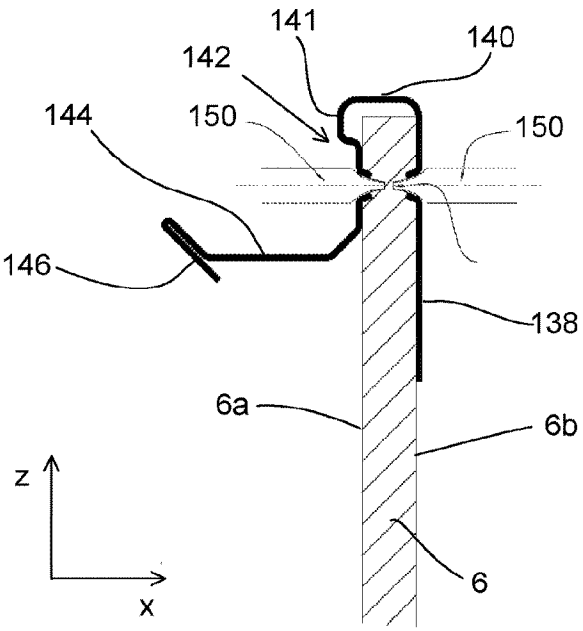
Figure 12B:
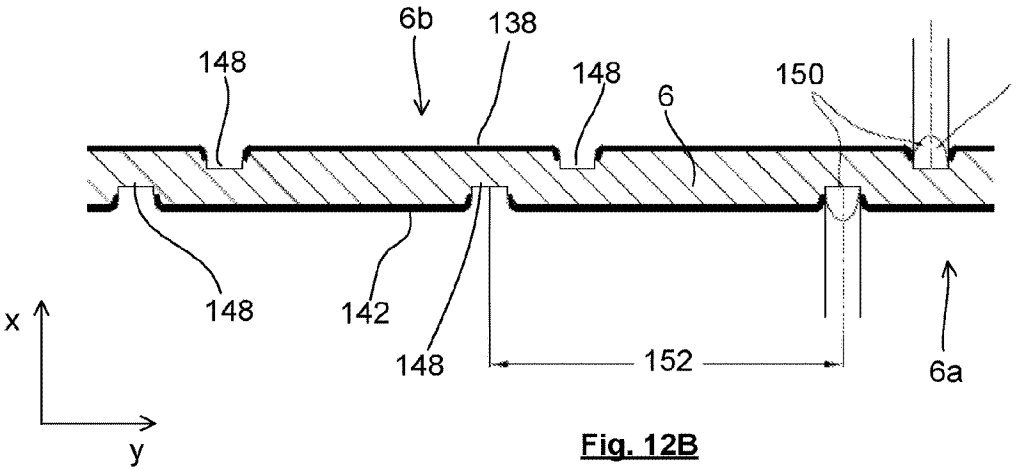
Figure 13A:
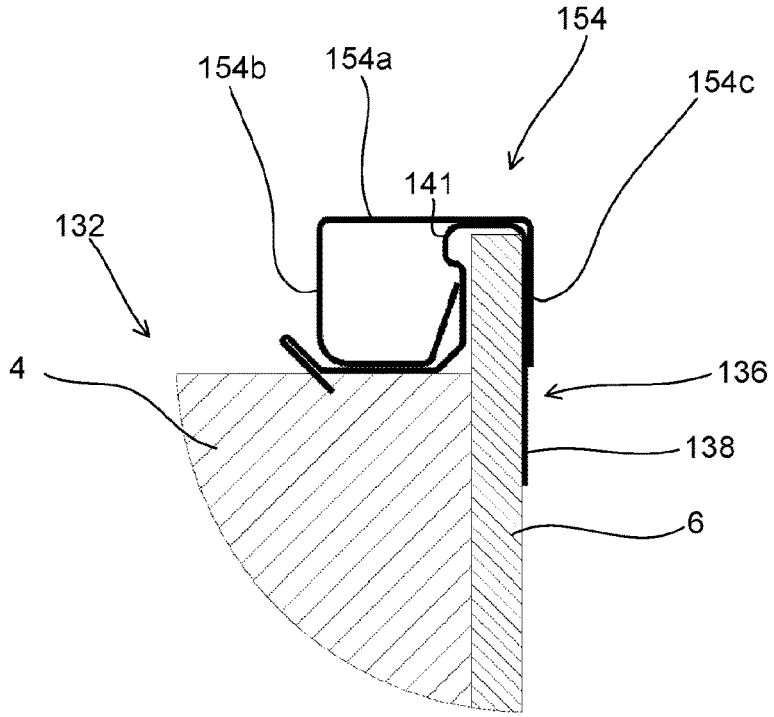
Figure 13B:
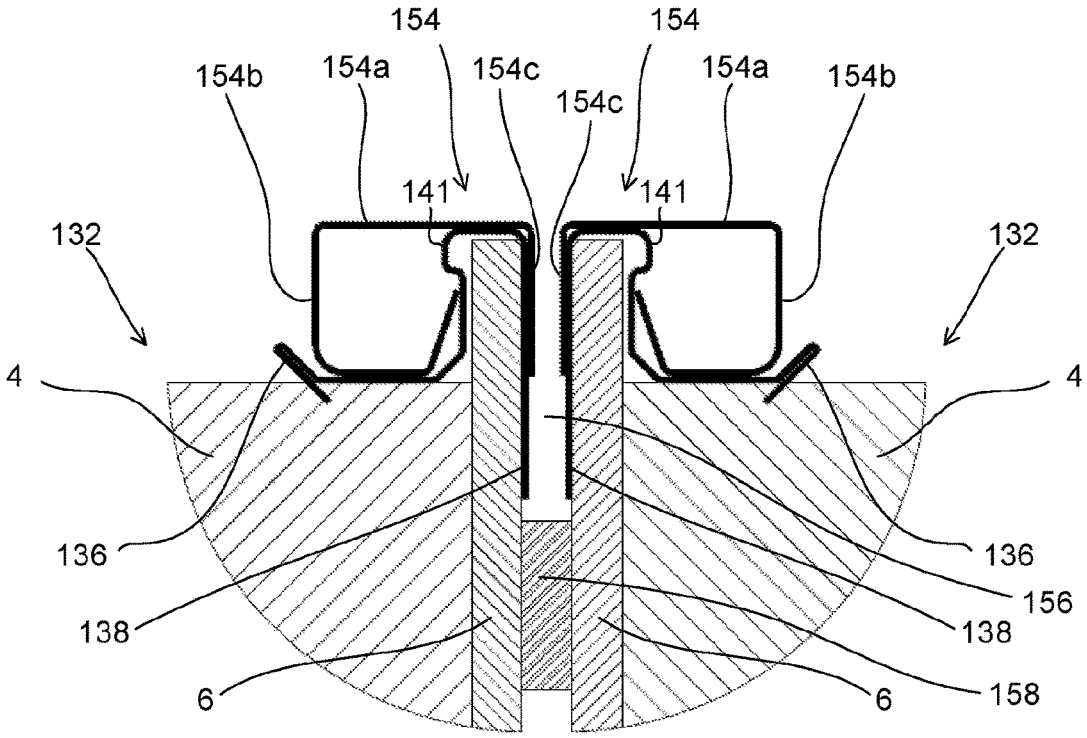
Figure 14:
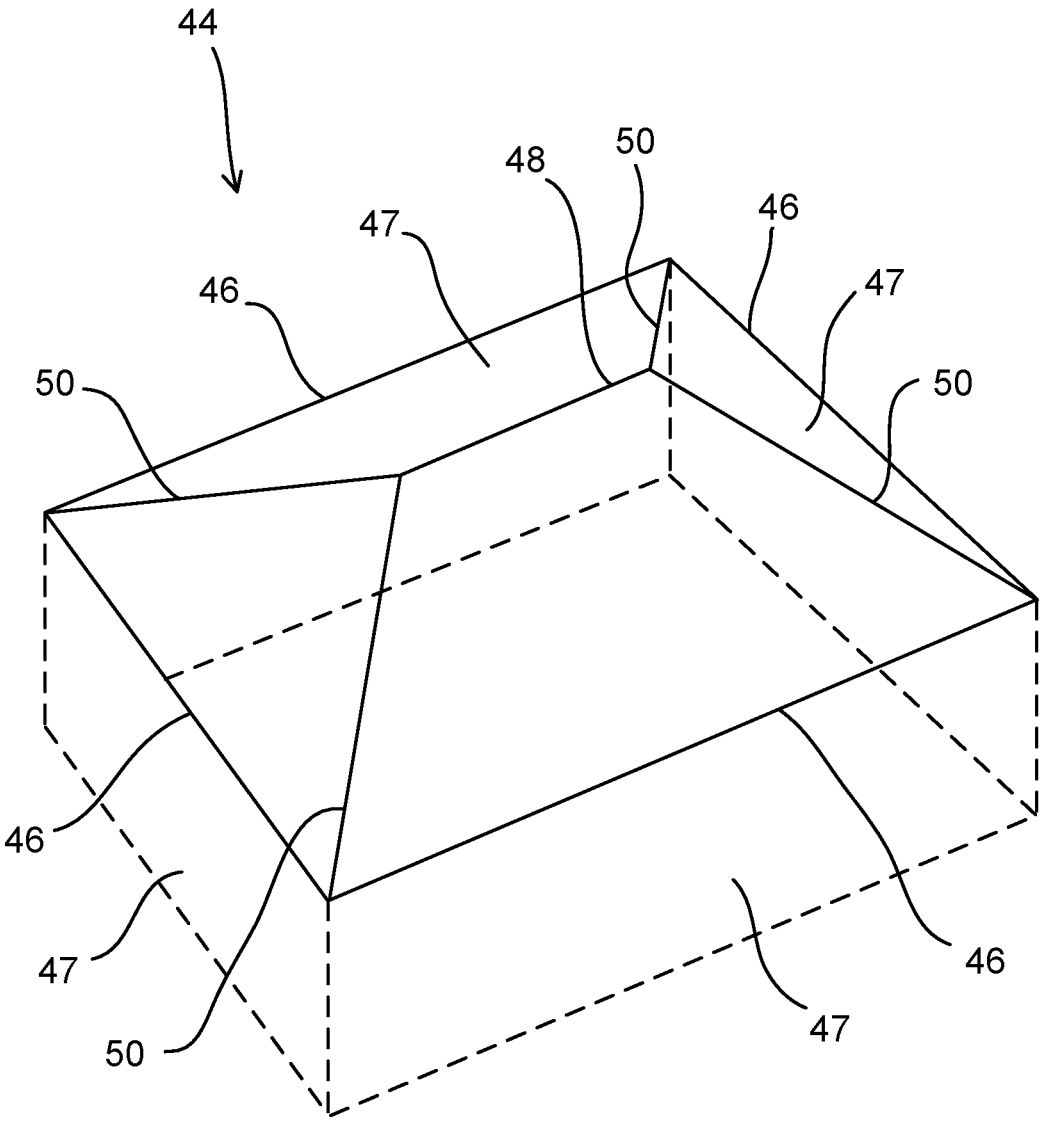
Figure 15:
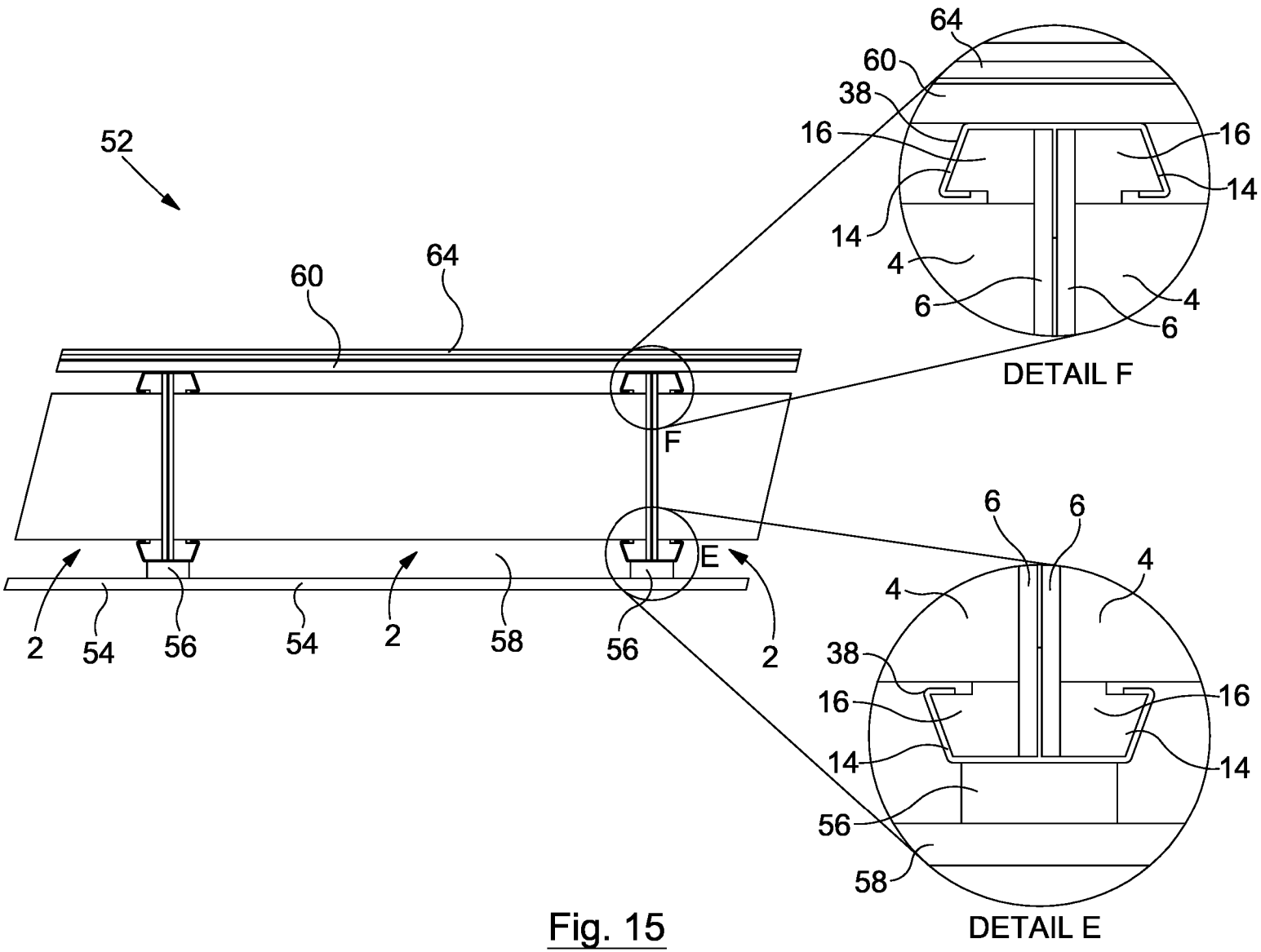
Figure 16:
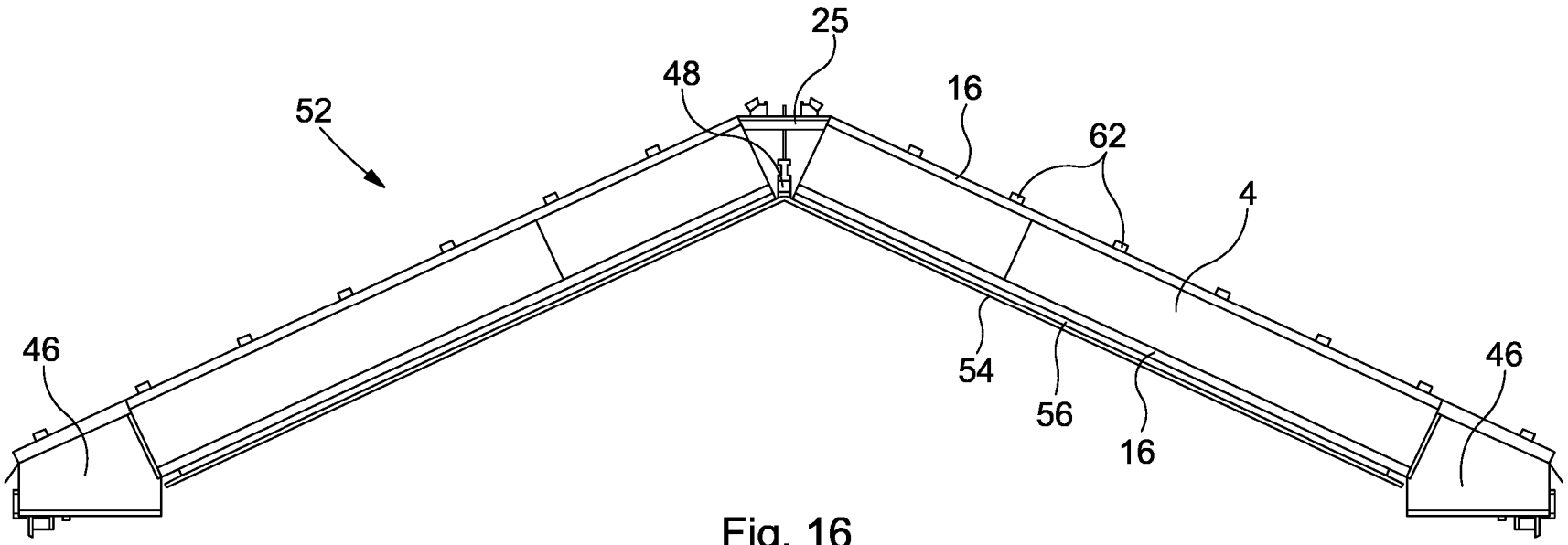
Figure 17:
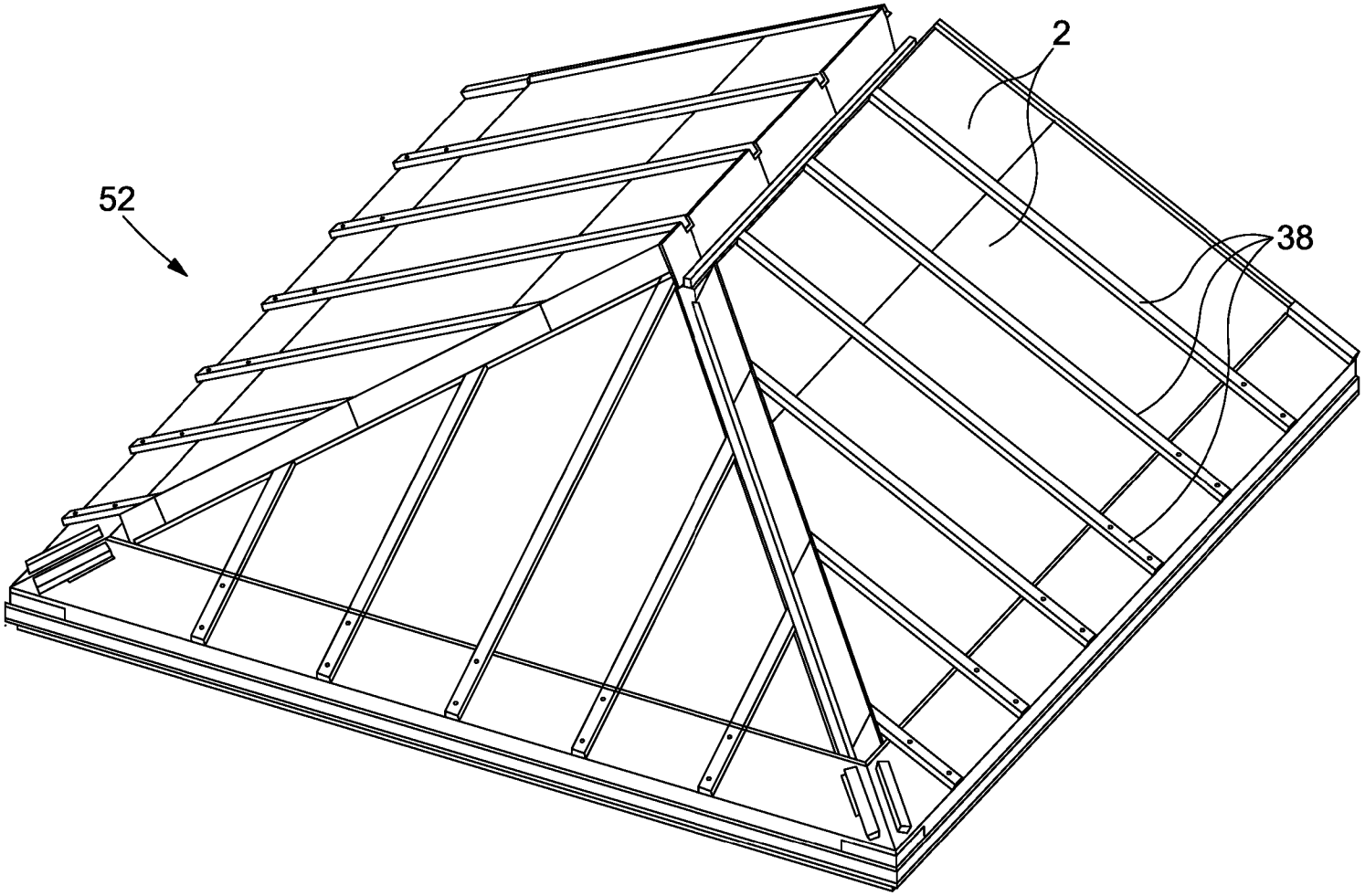
Figure 18A:
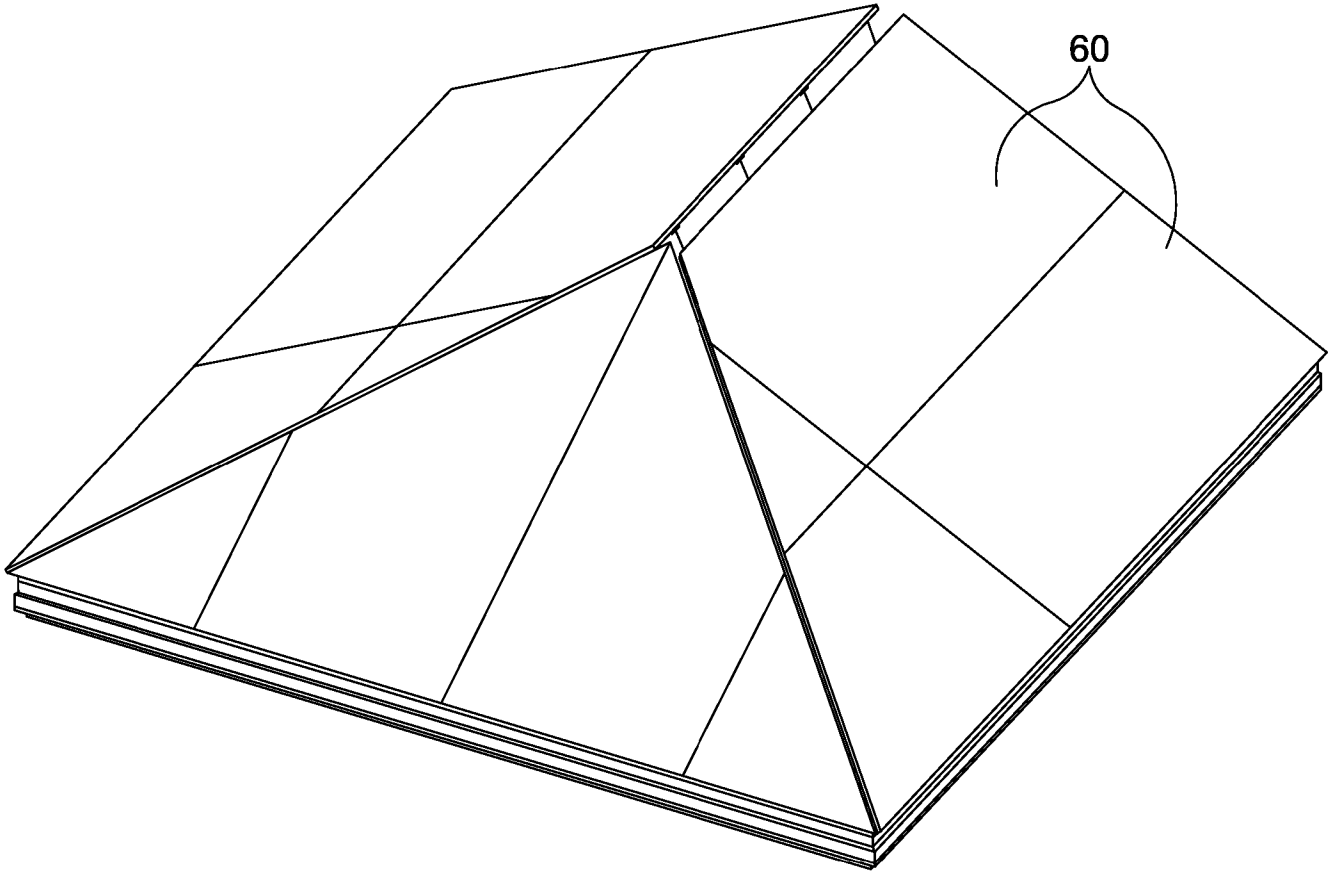
Figure 18B:
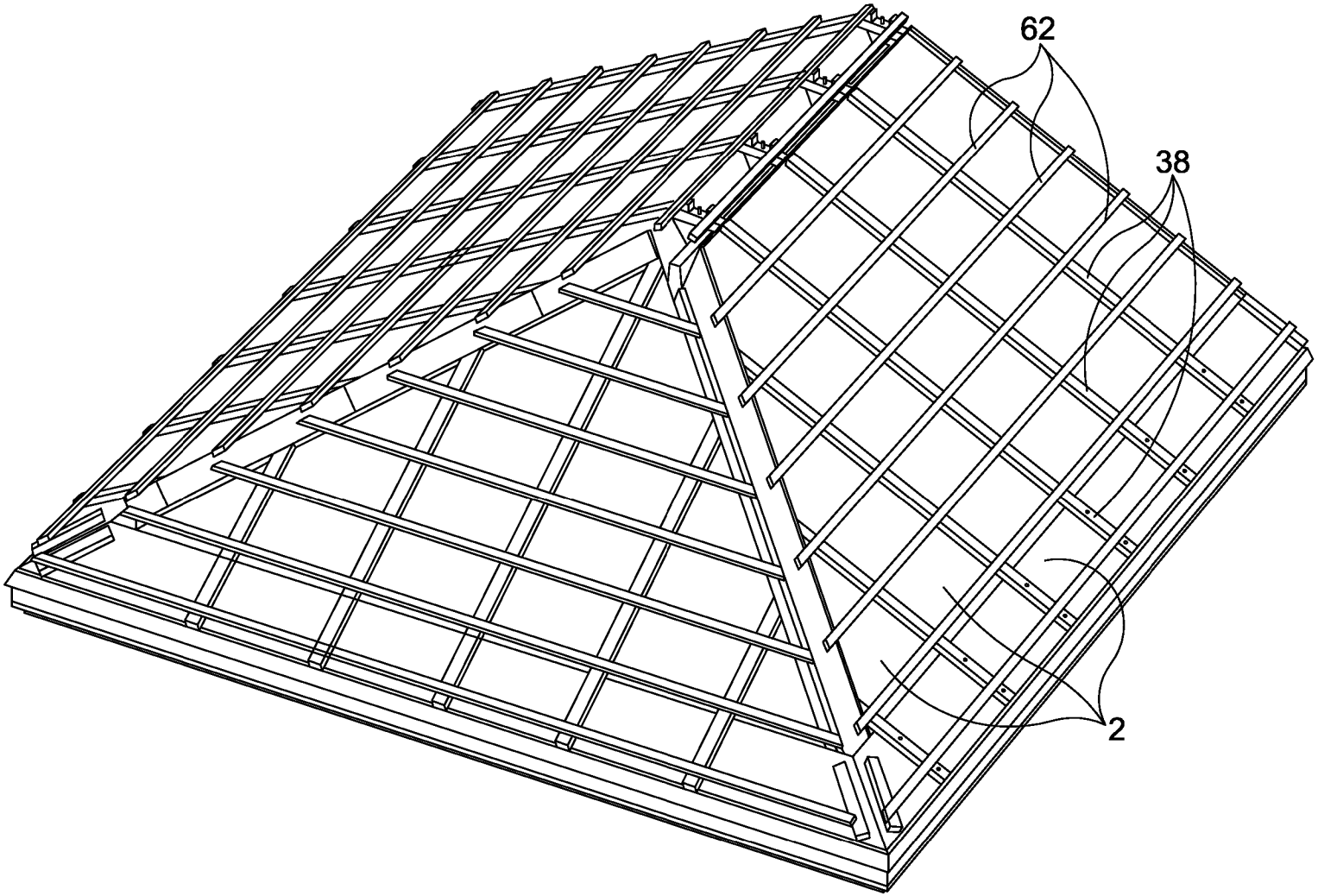
Figure 19:
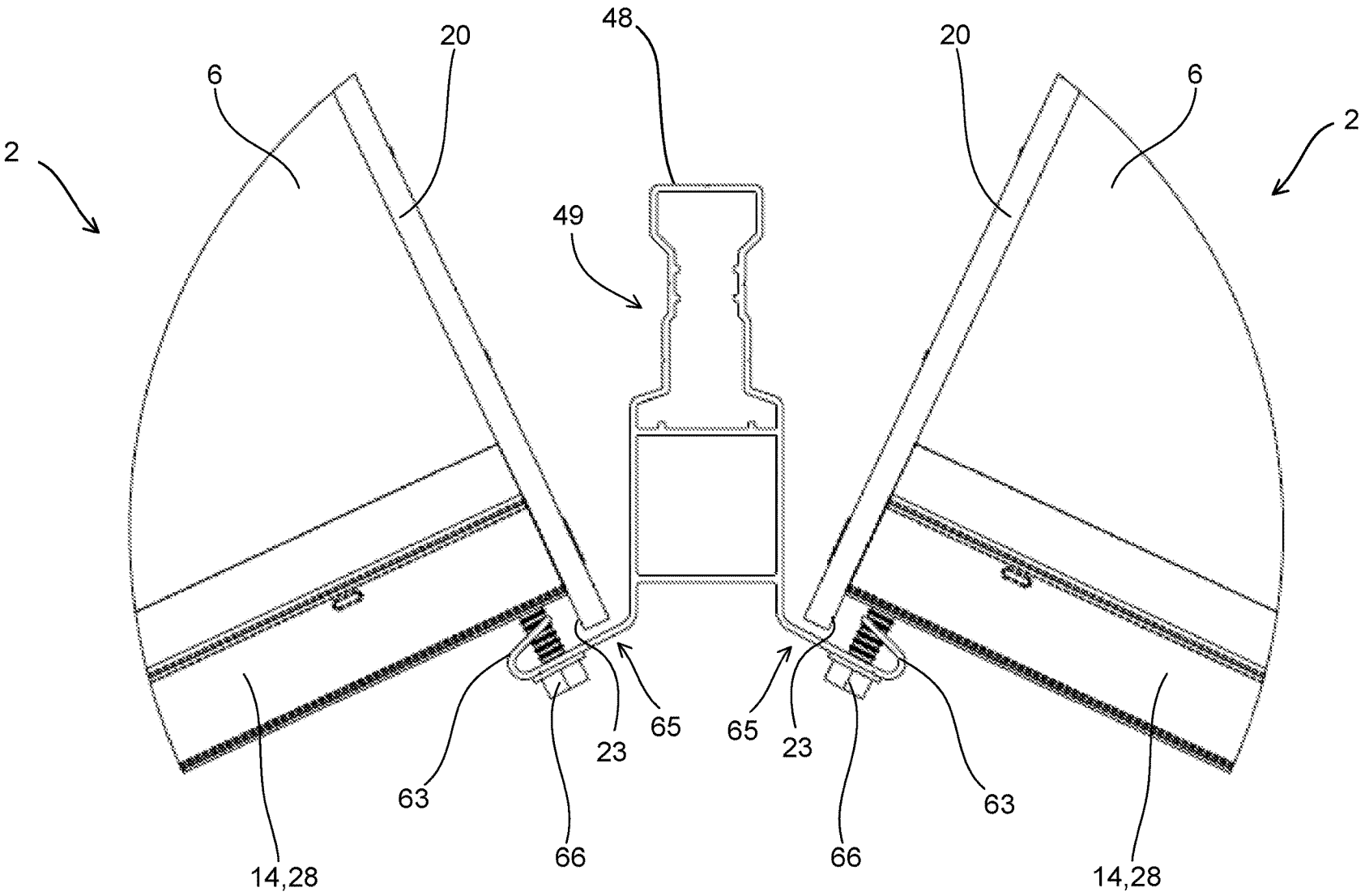
Figure 20:
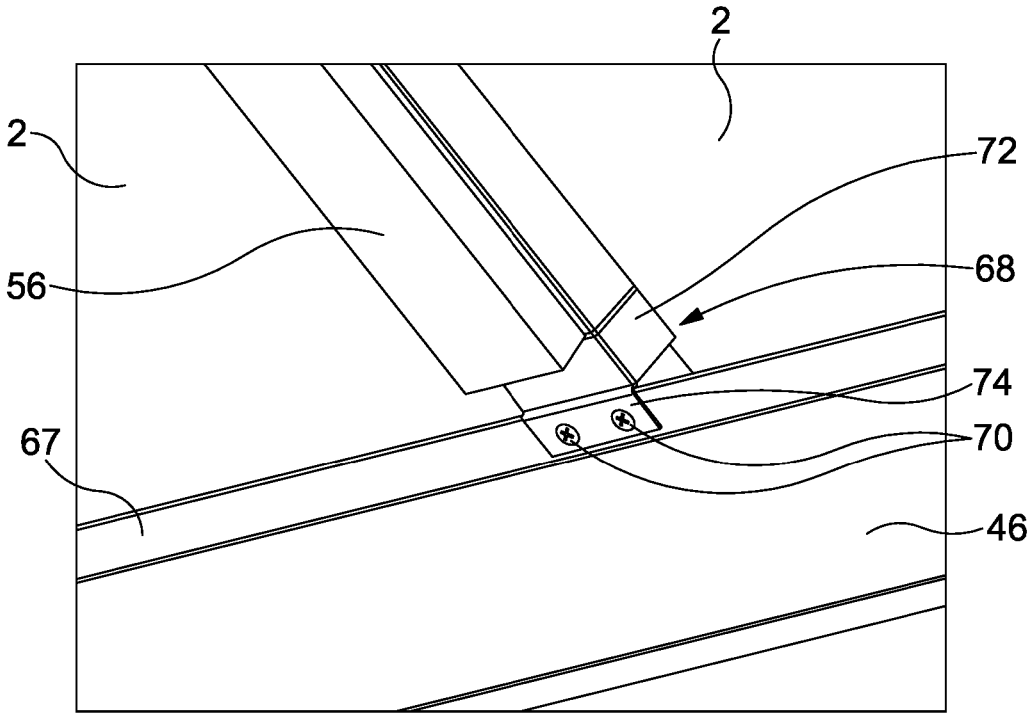
Figure 21:
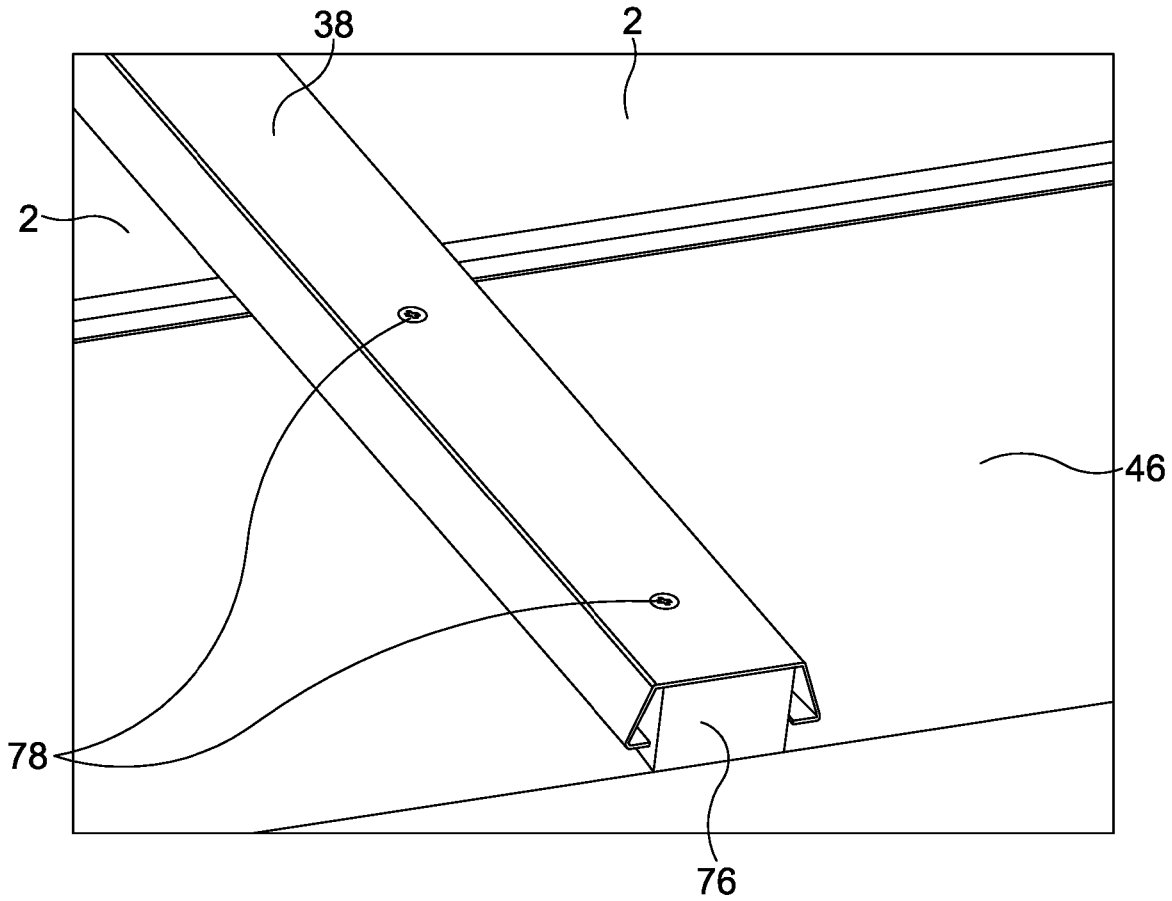
Figure 22:
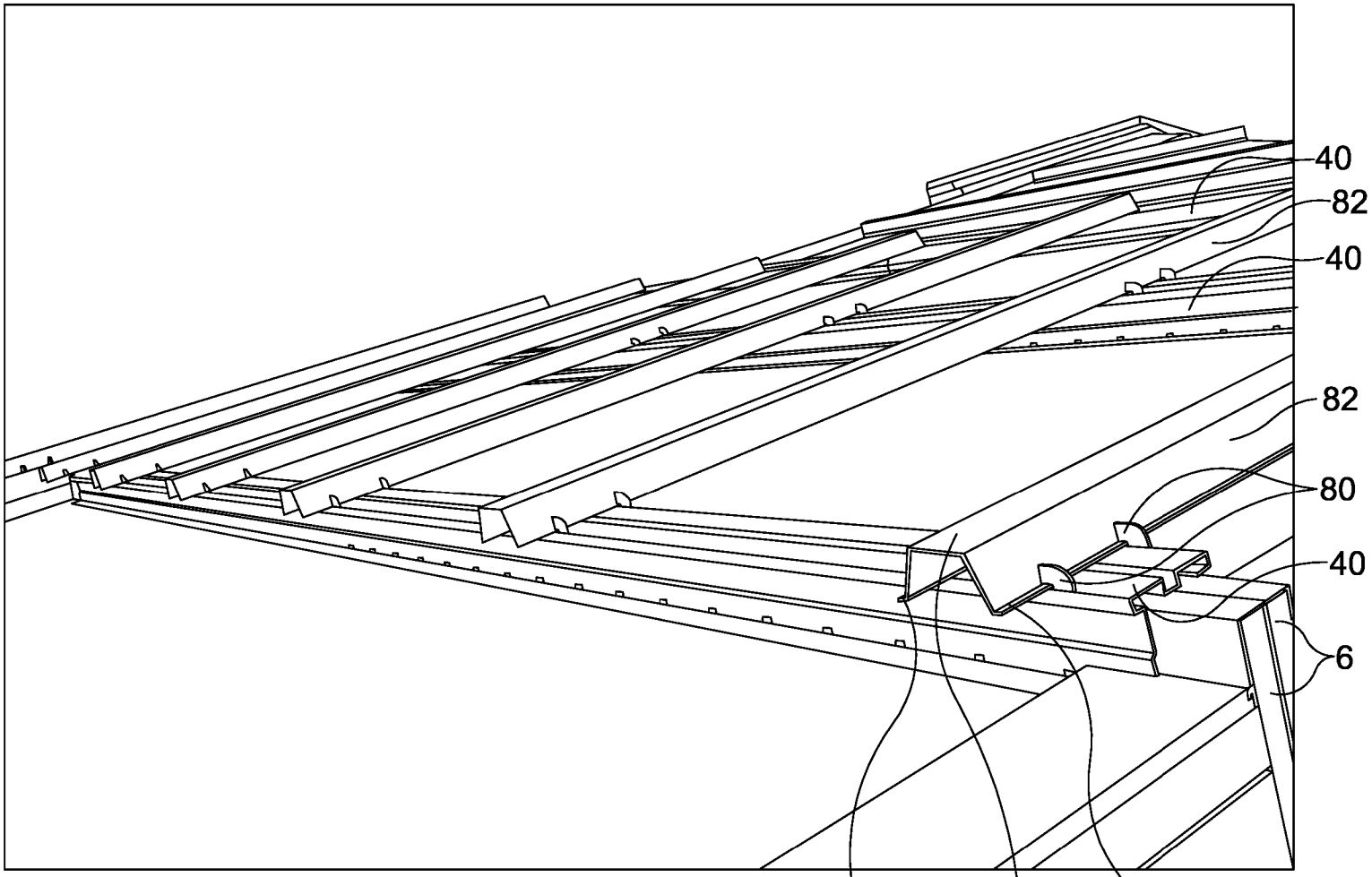
Figure 23:
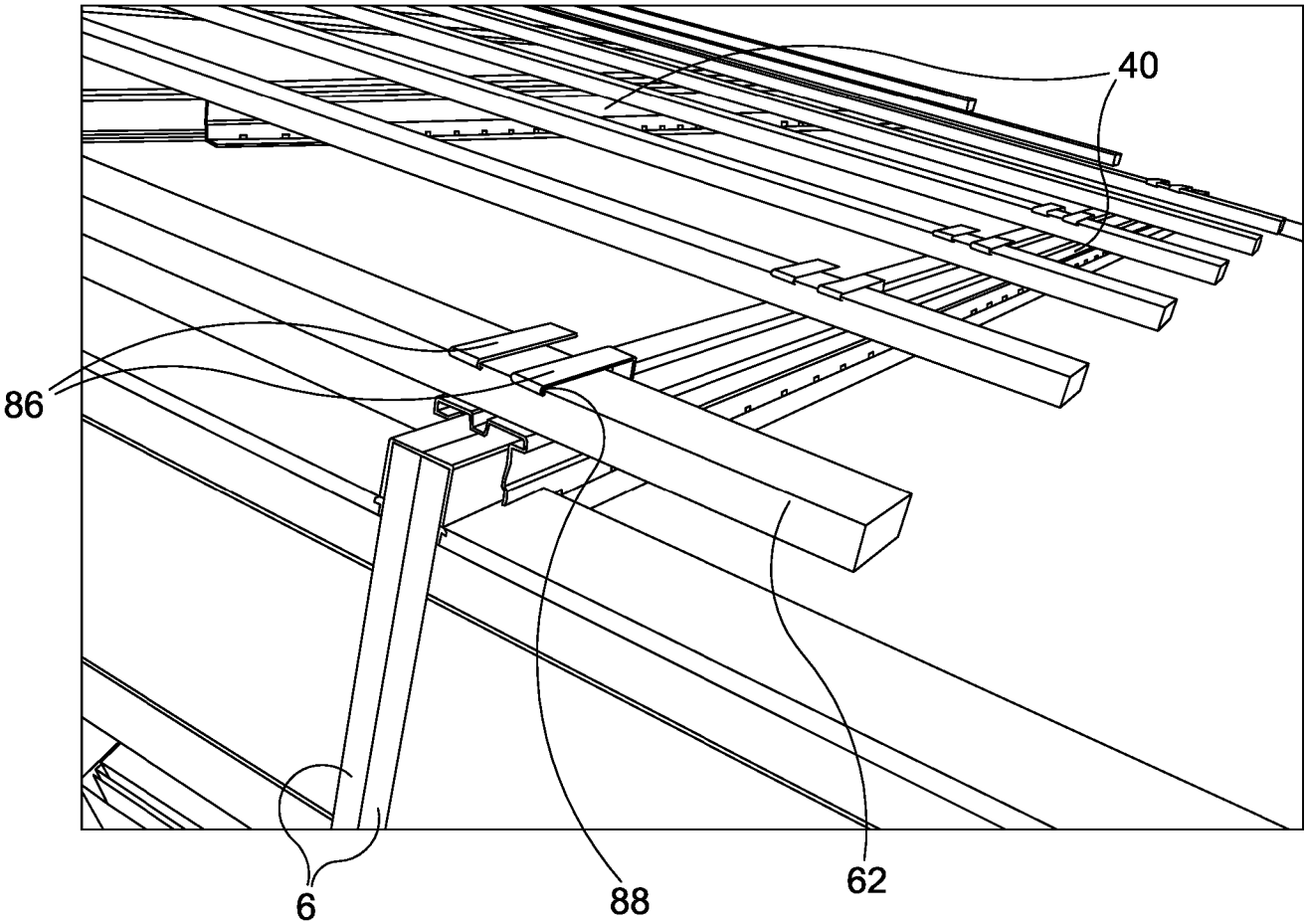
Figure 24:
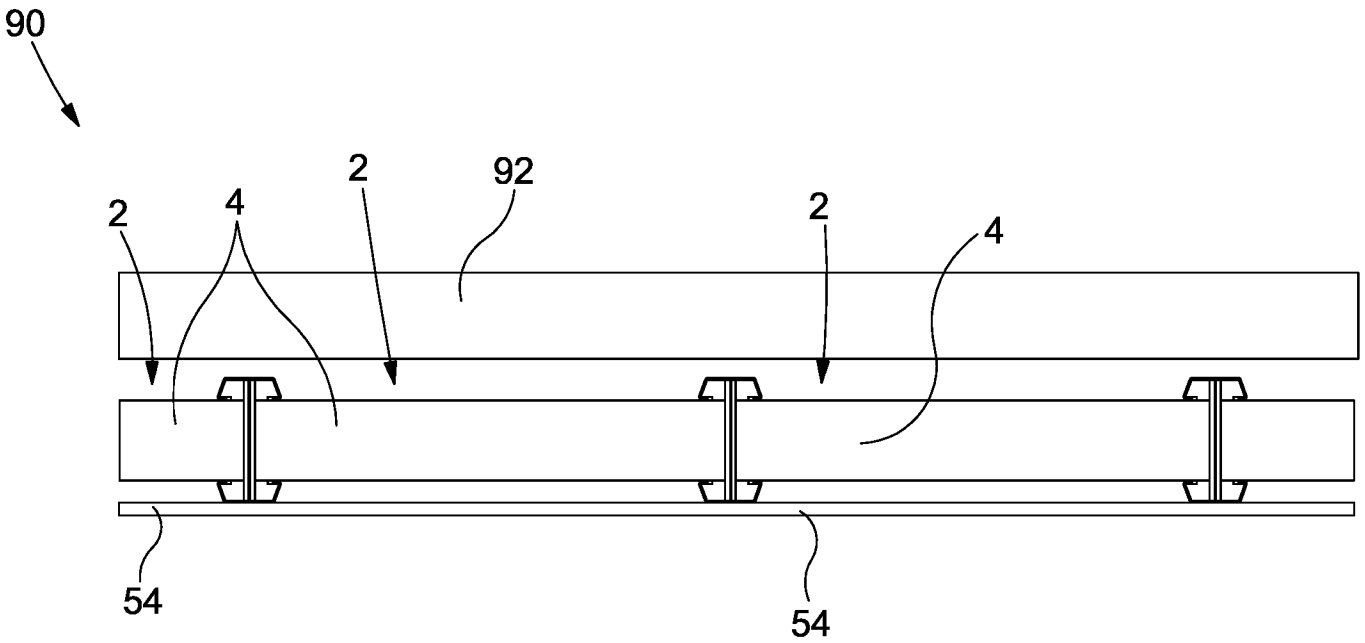
Figure 25:
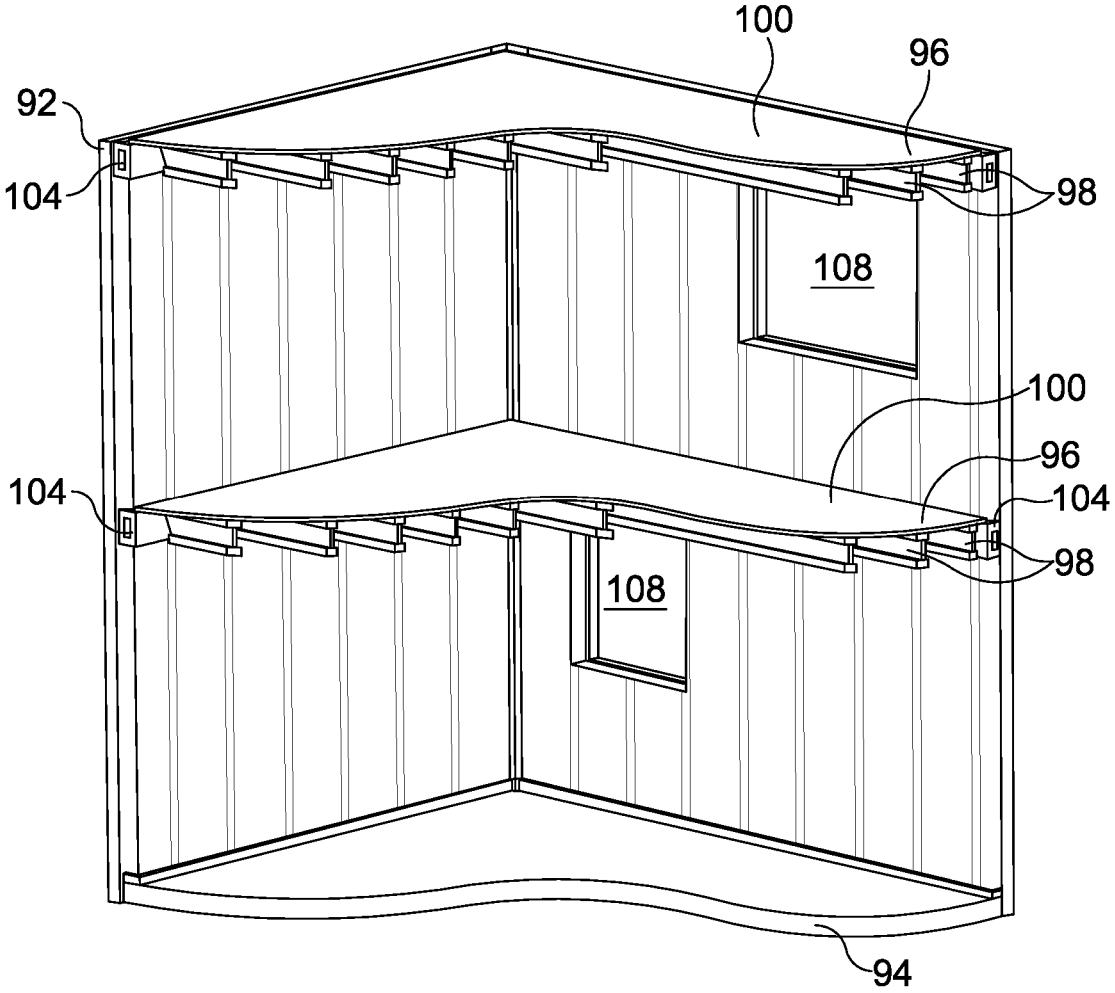
Figure 26:
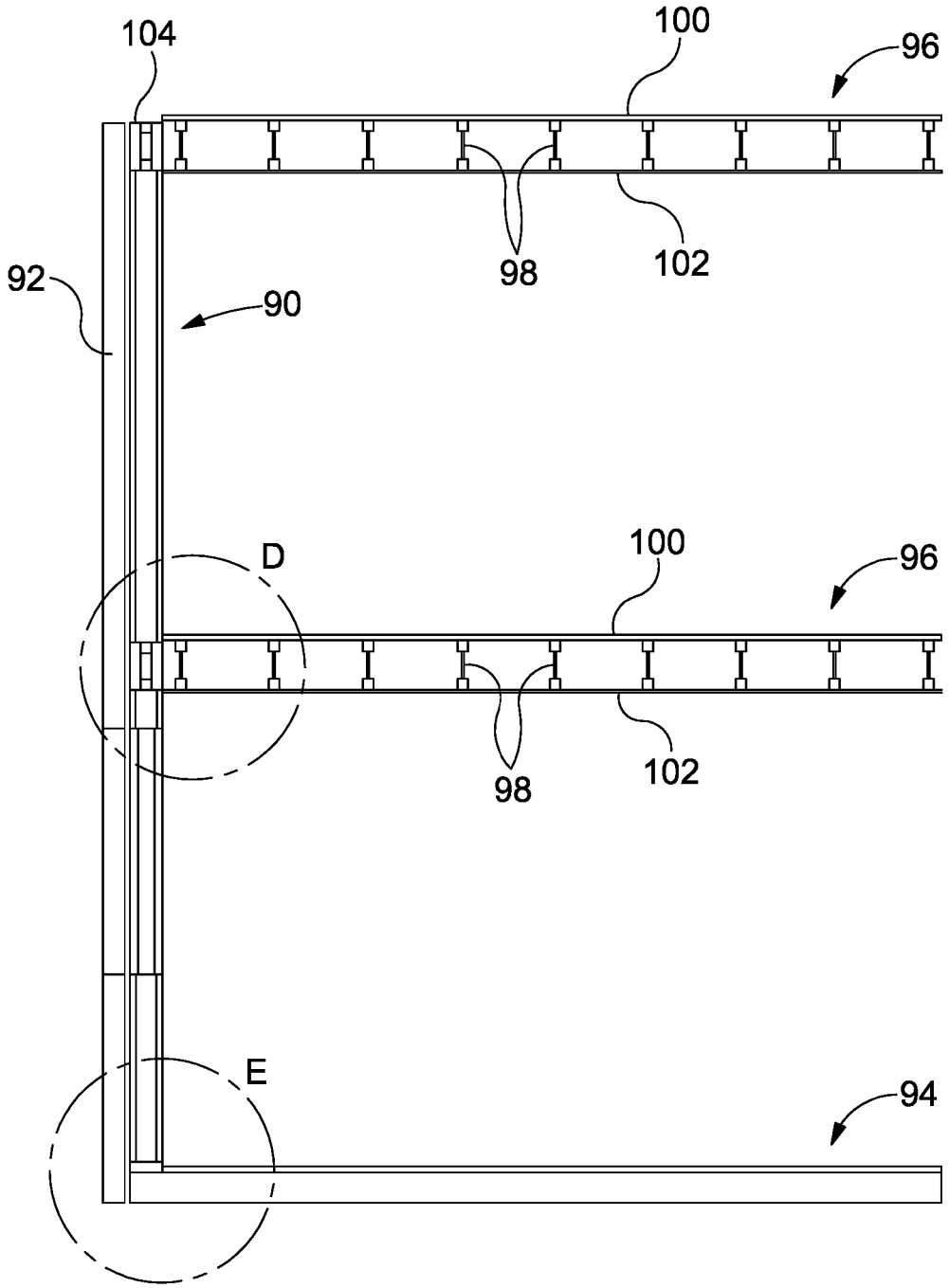
Figure 27:
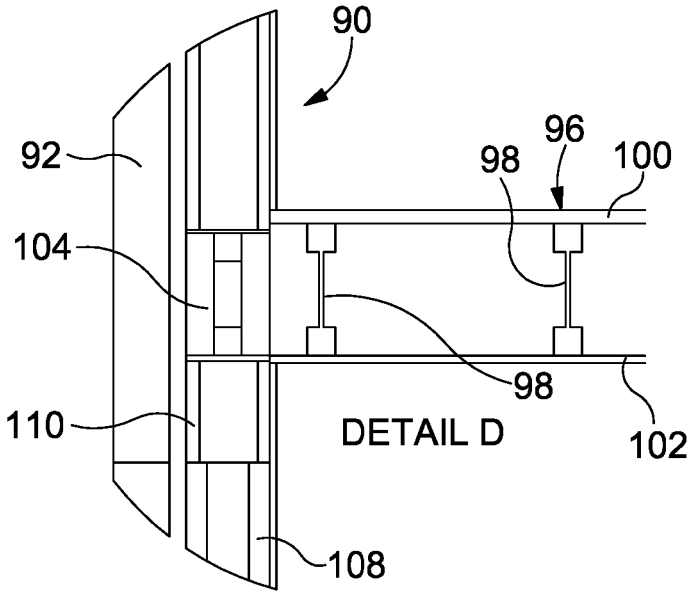
Figure 28:
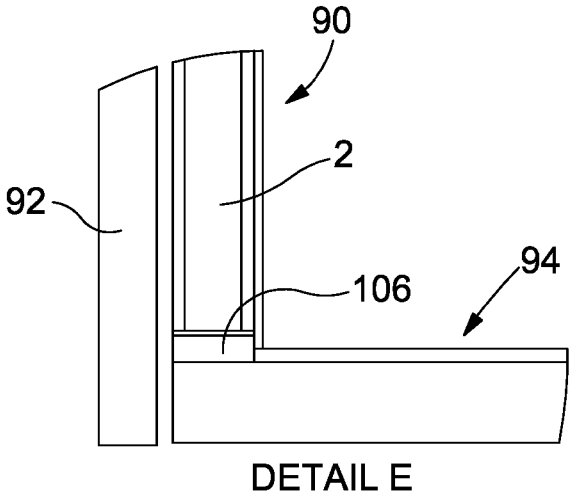
Figure 29:
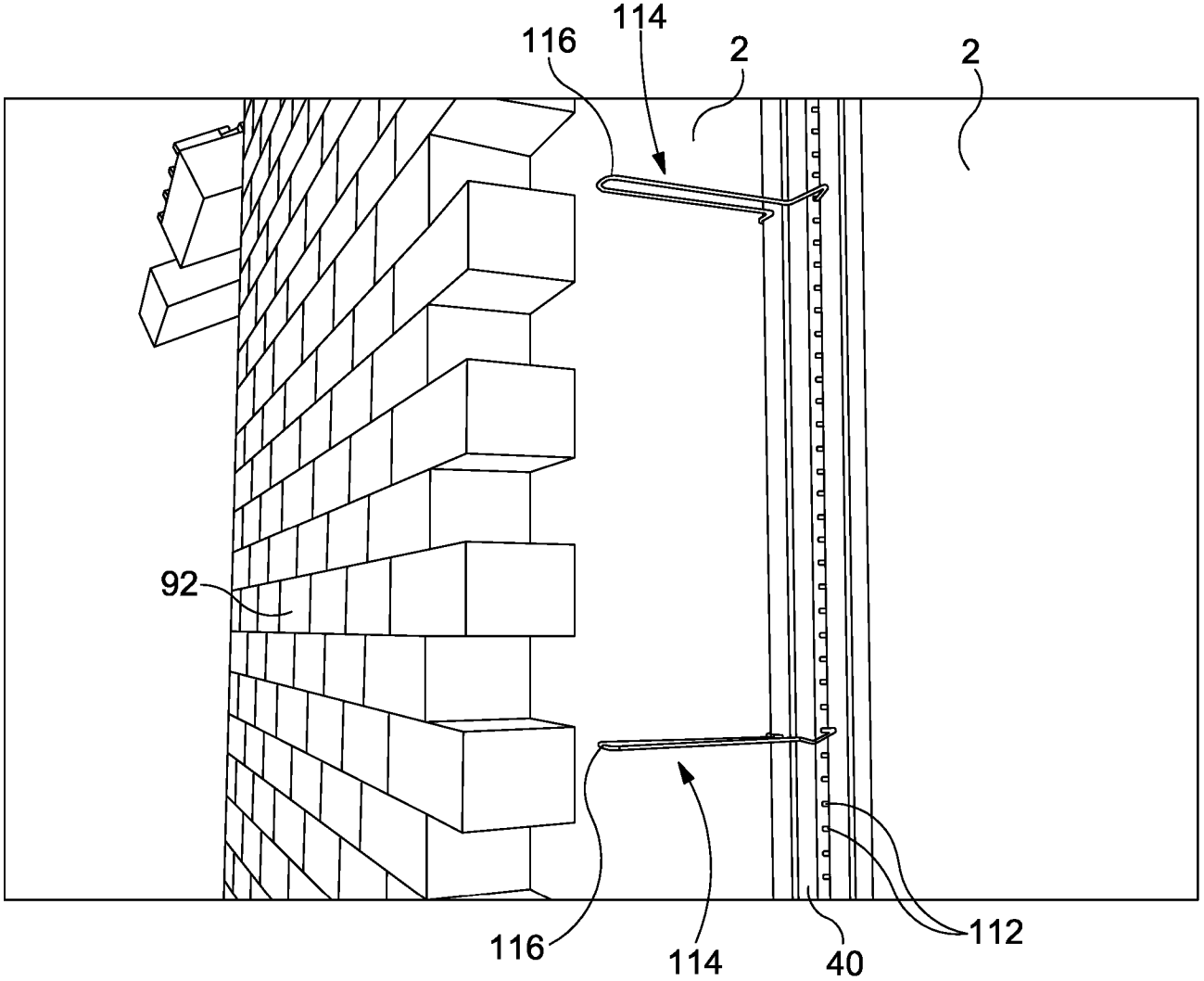
Figure 30:
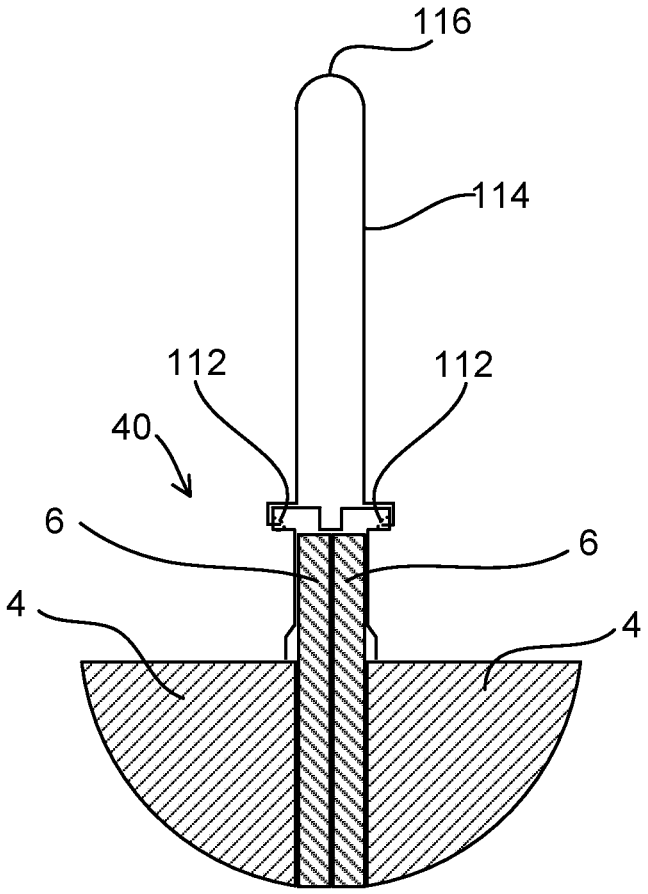
Figure 31:
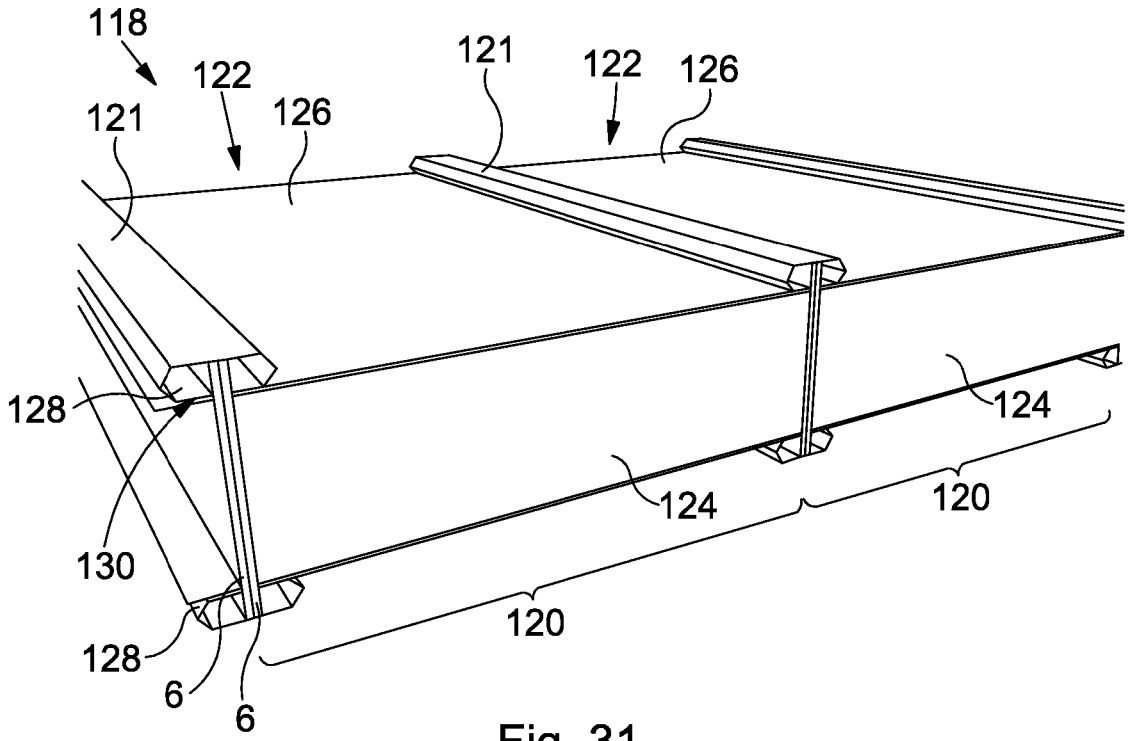
Figure 32:
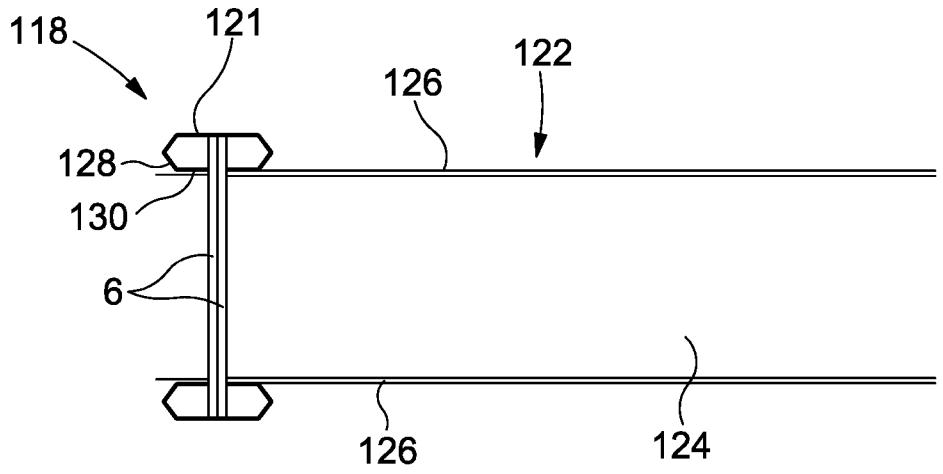
Figure 33:
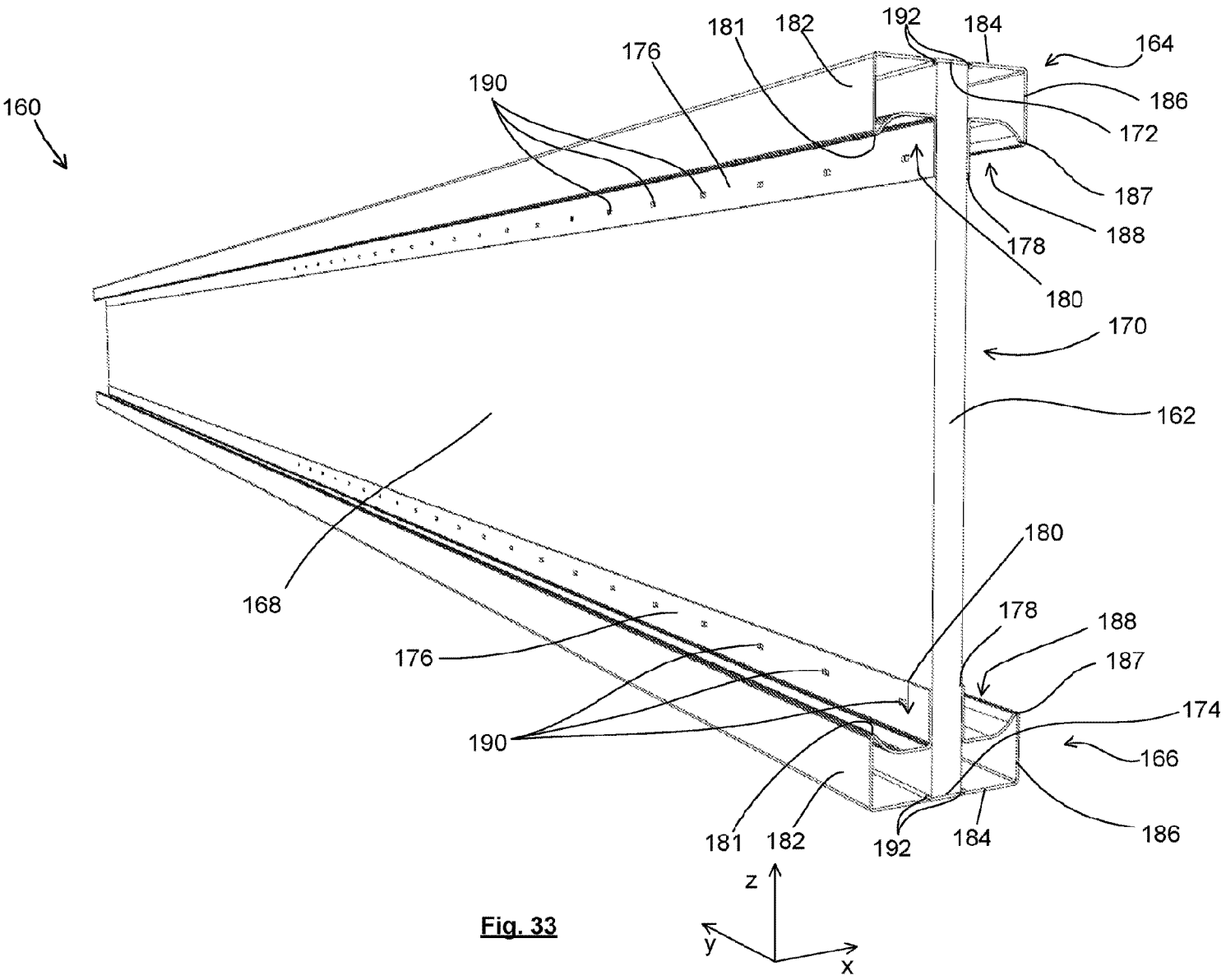
Figure 34:
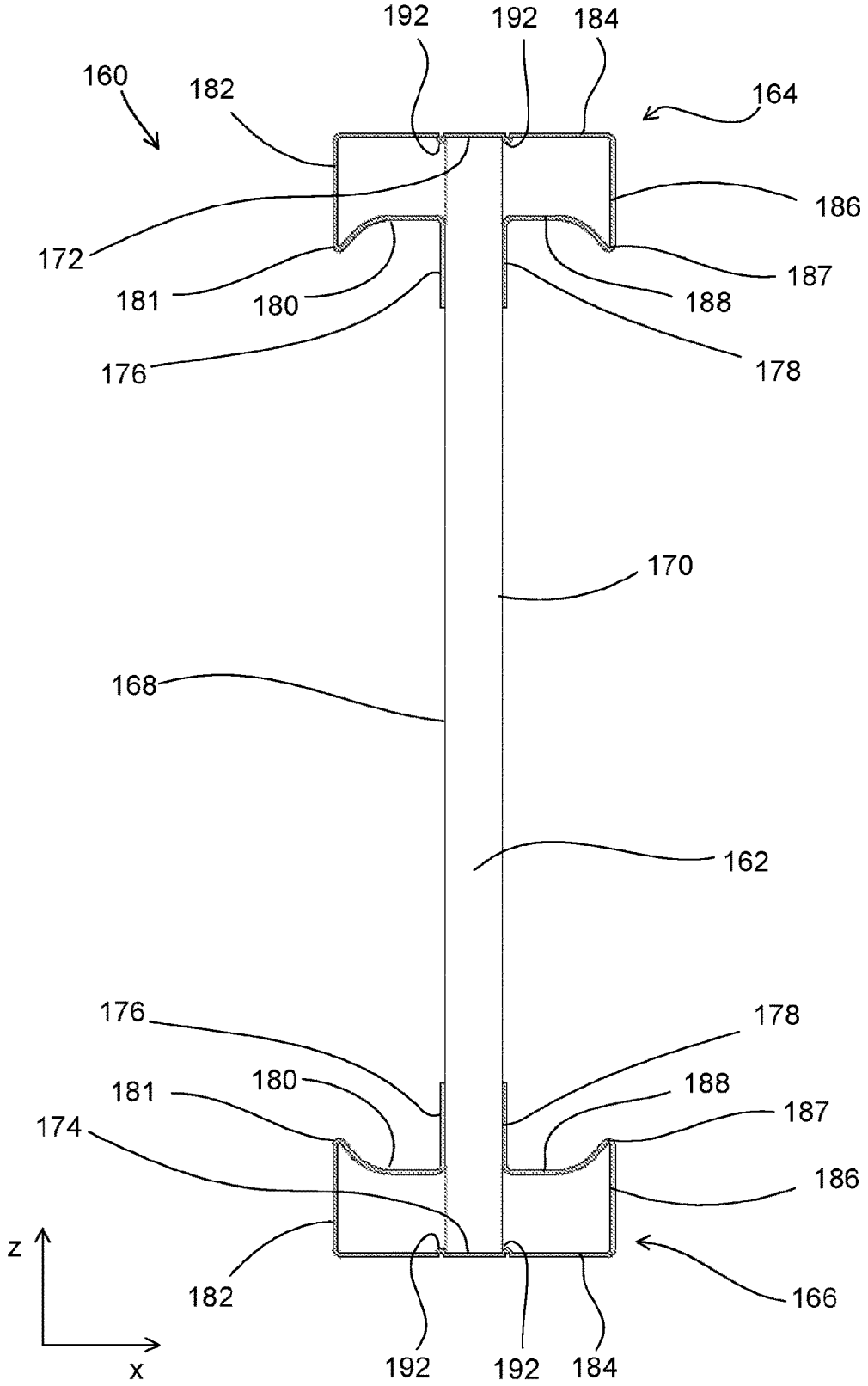
Figure 35:
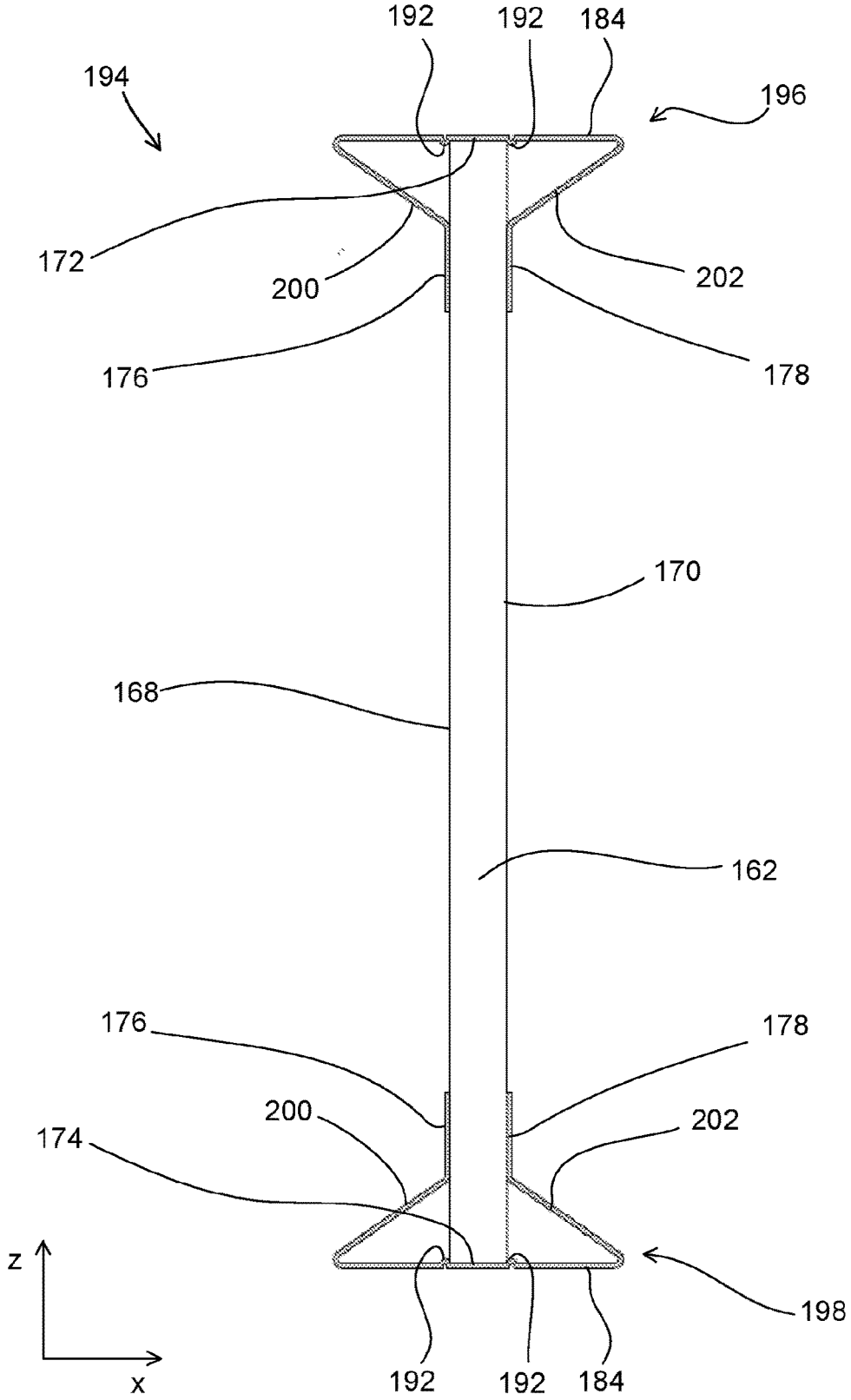
Figure 36:
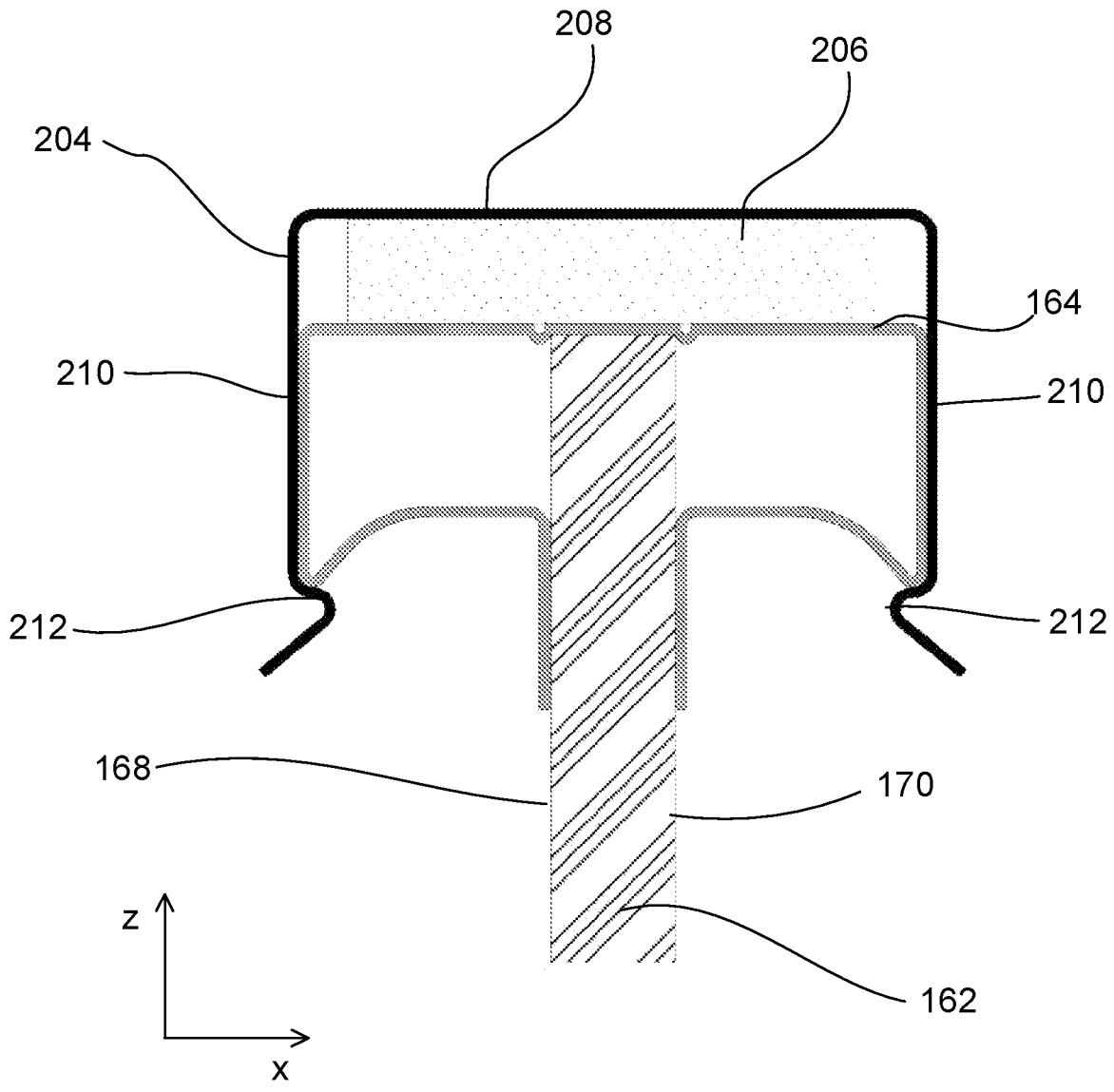
Figure 37:
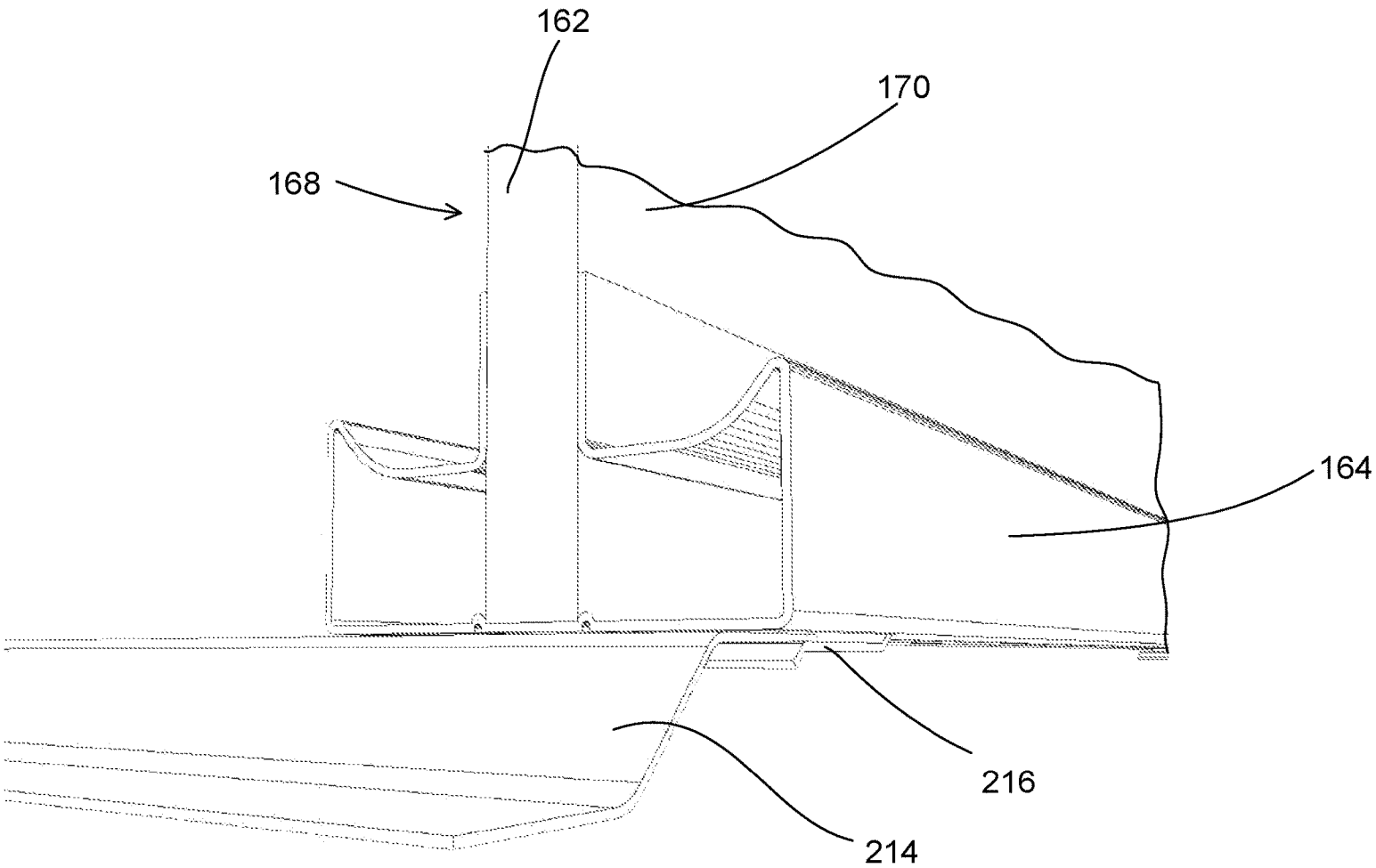
Figure 38:
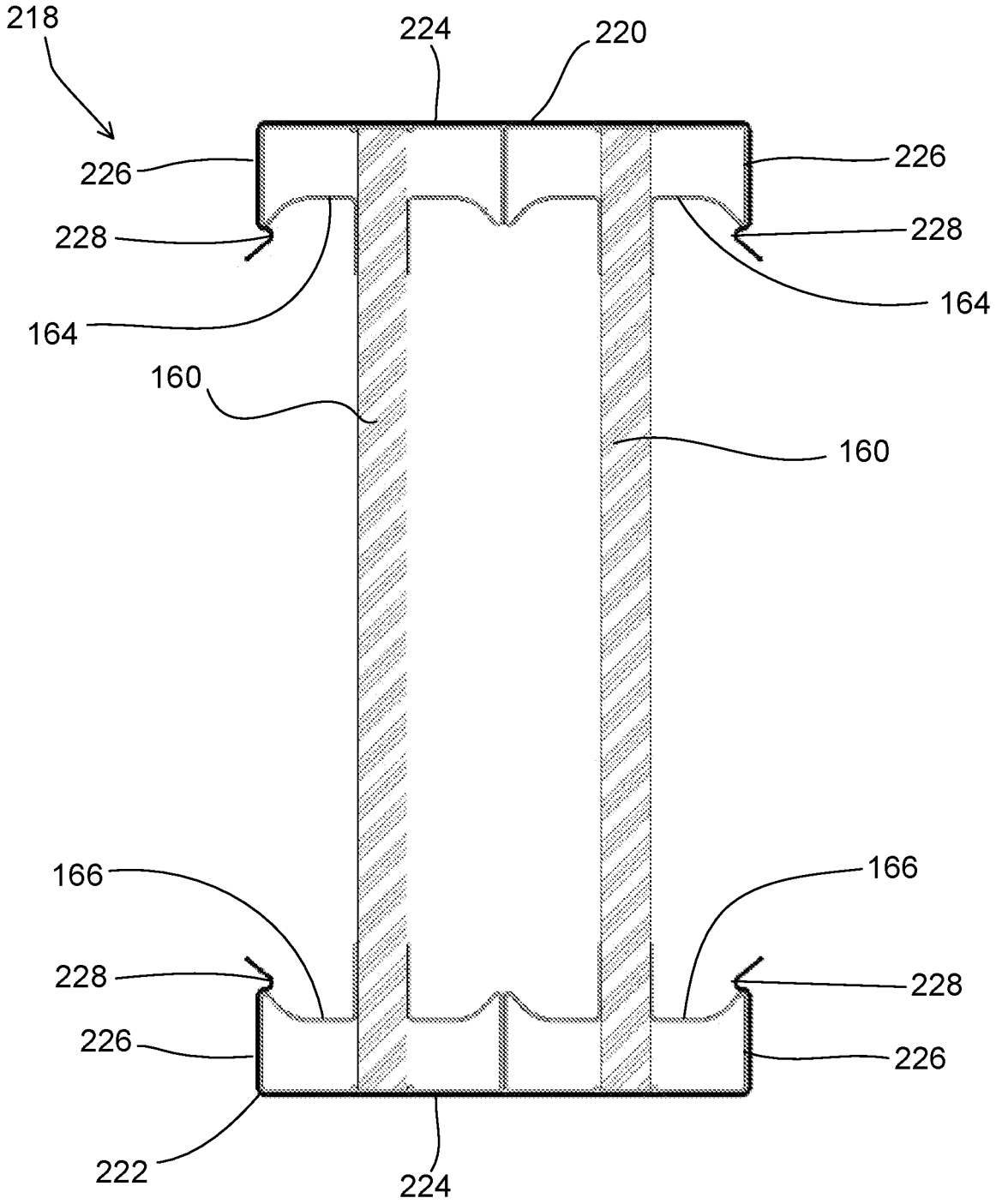

FIGS. 9A-9C each show an embodiment of a connecting strip according to an embodiment of the invention that is arranged to engage with two panels according to an embodiment of the invention;

FIG. 10 shows two adjacent panels and a connecting strip which is suitable for engaging with flanges of the support members of these two panels, which form part of a modular partition system according to an embodiment of the invention;

FIG. 11A shows a first perspective view of a portion of a support panel and the steel strip of as shown in FIG. 10 showing a surface of the support panel which in use contacts the insulating panel;

FIG. 11B shows a second perspective view of a portion of a support panel and the steel strip of as shown in FIG. 10 showing a surface of the support panel which in use is distal from the insulating panel;

FIG. 11C is a cross-sectional view of the portion of the support panel and the steel strip shown in FIGS. 11A and 11B in the x-z plane;

FIG. 11D is a cross-sectional view of the portion of the support panel and the steel strip shown in FIGS. 11A and 11B in the x-y plane;

FIG. 12A is a cross-sectional view of the portion of the support panel and the steel strip shown in FIG. 11C also showing a tool tip;

FIG. 12B is a cross-sectional view of the portion of the support panel and the steel strip shown in FIG. 11D also showing a tool tip;

FIG. 13A shows a single panel and an edging strip according to an embodiment of the invention which is engaged with a flange of the support member of the single panel, the panel being substantially as shown in FIGS. 10 to 12B;

FIG. 13B shows aa pair of adjacent panels and engaged edging strips as shown in FIG. 13A with a tolerance gap formed between the two panels;

FIG. 14 is a schematic perspective view of the structure of hip roof which may incorporate a modular partition system according to an embodiment of the invention;

FIG. 15 is a cross sectional view of a portion of a modular partition system according to an embodiment of the invention;

FIG. 16 is a cross sectional view of a hip roof which incorporates a modular partition system according to an embodiment of the invention;

FIG. 17 is a perspective view of a hip roof which incorporates a modular partition system according to an embodiment of the invention;

FIG. 18A is a perspective view of the hip roof shown in FIG. 17 with a first type of roof covering;

FIG. 18B is a perspective view of the hip roof shown in FIG. 17 with a second type of roof covering;

FIG. 19 is an enlarged view of a portion of FIG. 16 showing the engagement between a panel and a ridge beam;

FIG. 20 is an enlarged perspective view of a portion of the hip roof shown in FIG. 15 showing the engagement between a panel and an eaves beam;

FIG. 21 is a second enlarged perspective view of a portion of the hip roof shown in FIG. 16 showing the engagement between a panel and an eaves beam;

FIG. 22 is a perspective view of a hip roof which incorporates a modular partition system according to an embodiment of the invention showing an engagement system for tile battens;

FIG. 23 is a perspective view of a hip roof which incorporates a modular partition system according to an embodiment of the invention showing another engagement system for tile battens;

FIG. 24 is a cross sectional view of a portion of another modular partition system according to an embodiment of the invention;

FIG. 25 is a partially cut away perspective view of a building which incorporates the modular partition system shown in FIG. 24;

FIG. 26 is a cross sectional view of the building shown in FIG. 25;

FIG. 27 is an enlarged portion of FIG. 26;

FIG. 28 is another enlarged portion of FIG. 26;

FIG. 29 is a partially cut away view of the building shown in FIGS. 25 to 28 showing an engagement system for wall ties;

FIG. 30 is a cross sectional view showing engagement between a wall tie and a connecting strip within the engagement system of FIG. 29;

FIG. 31 is a perspective view of a portion of a modular partition system according to an embodiment of the invention;

FIG. 32 is a cross-sectional view of the portion of a modular partition system shown in FIG. 31;

FIG. 33 shows a perspective view of a support beam according to an embodiment of the present invention;

FIG. 34 shows a cross sectional view of the support beam shown in FIG. 33;

FIG. 35 shows a cross sectional view of a support beam according to another embodiment of the present invention;

FIG. 36 shows a cross section of a part of a support beam according to another embodiment of the present invention;

FIG. 37 shows a perspective view of a part of a support beam according to another embodiment of the present invention; and FIG. 38 shows a cross sectional view of a support beam according to another embodiment of the present invention, said support beam comprising two support beams as shown in FIGS. 33 and 34.

A novel panel 2 for a partition according to an embodiment of the invention is shown in FIGS. 1 to 6. The panel 2 comprises an insulating panel 4 and two support panels 6 disposed on opposed sides of the insulating panel 4.

It will be appreciated that as used herein the term panel is intended to mean a relatively thin, generally flat three-dimensional object or body. It will be further appreciated that by relatively thin it is meant that one dimension of the object or body is smaller than the other two dimensions of the object or body. The smallest dimension of the object or body may be referred to as its thickness. The two dimensions generally perpendicular to the smallest dimension of the object or body may define a plane (or family of parallel planes).

In FIGS. 1 to 6, the smallest dimension, or thickness, of the insulating panel 4 is the z-direction. The two dimensions generally perpendicular to the thickness of the insulating panel 4 may be considered to define the x-y plane. In FIGS. 1 to 6, the smallest dimension, or thickness, of each of the support panels 6 is the x-direction. The two dimensions generally perpendicular to the thickness of the support panels 6 may be considered to define the y-z plane. Therefore, each of the two support panels 6 extends generally perpendicularly to a plane of the insulating panel 4.

The insulation panel 4 may comprise any suitable insulation material. For example, the material may be a rigid insulation material such as, for example, expanded polystyrene (EPS), extruded polystyrene (XPS), rigid polyurethane (PUR), polyisocyanurate (PIR). The material may be either closed cell or open cell. The thickness of the insulation panel 4 may be determined by bearing in mind building regulations or codes to which it is desired for buildings incorporating the panel 2 to meet. There is a general trend in the construction industry for increasing thicknesses of insulation to be installed in partitions. Merely as an example, the insulation panel 4 may have a thickness of the order of 175 mm.

The support panels 6 may be formed from any suitable material. Suitable materials may include hardboard and high density fibreboard (HDF).

Figure 4:
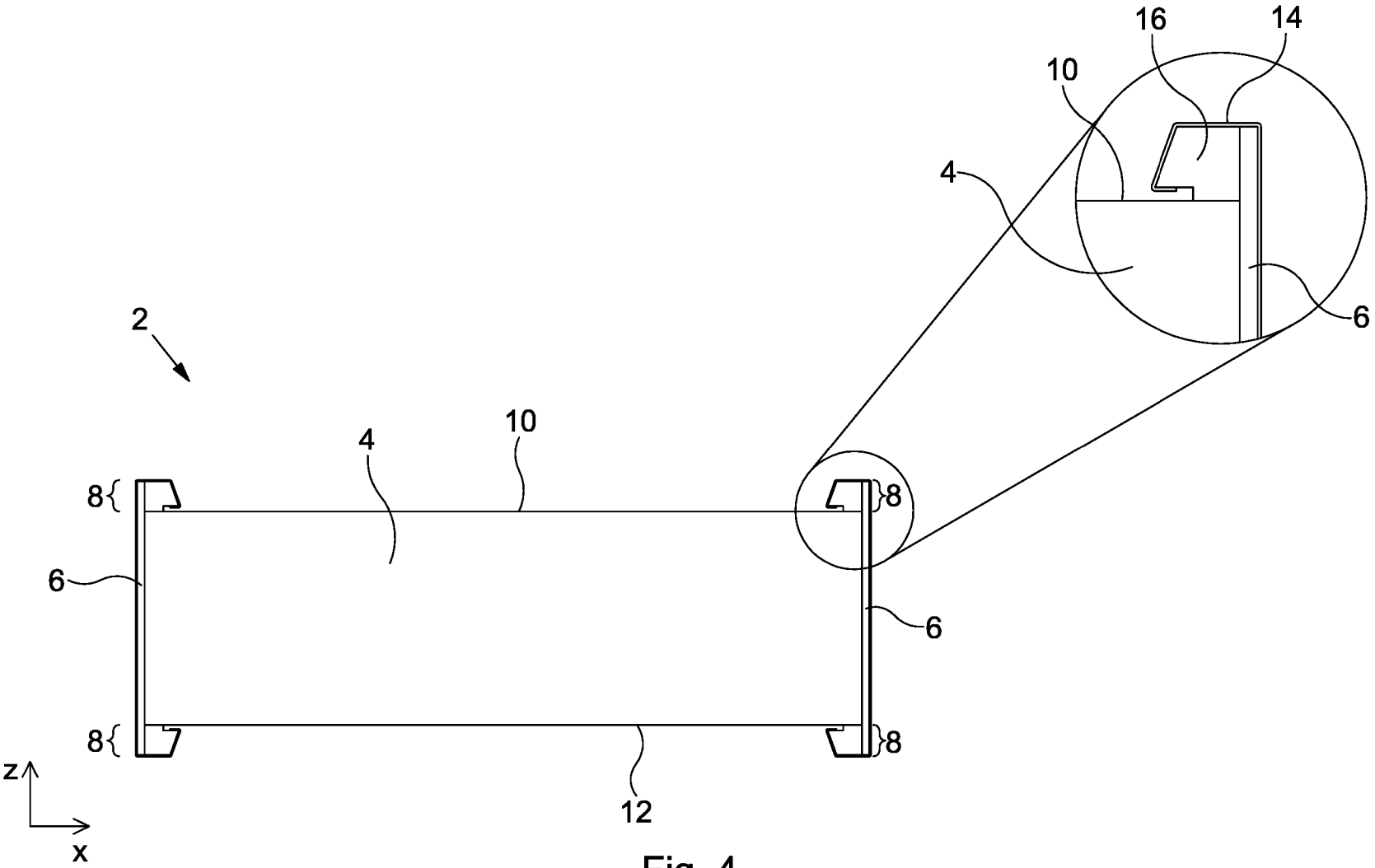
FIG. 4 is a cross sectional view of the panel shown in FIGS. 1 to 3 along the line B-B (see FIG. 3)
Figure 5:
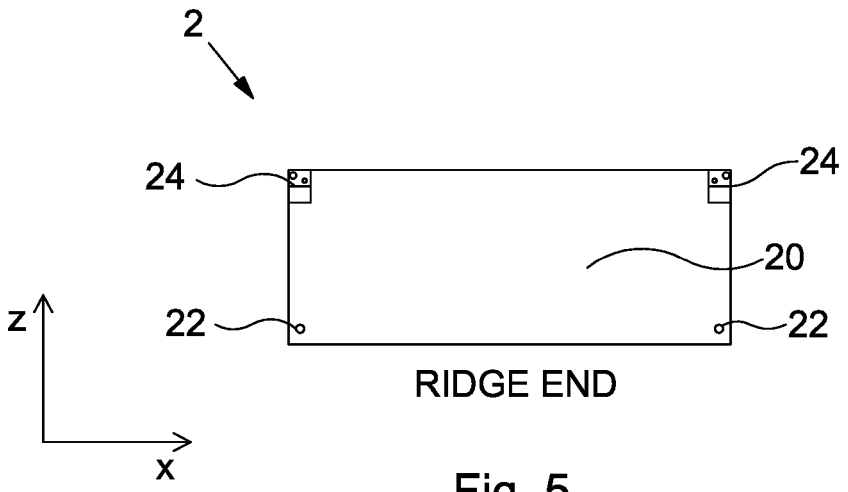
FIG. 5 is a first end view of the panel shown in FIGS. 1 to 4.
Figure 6:
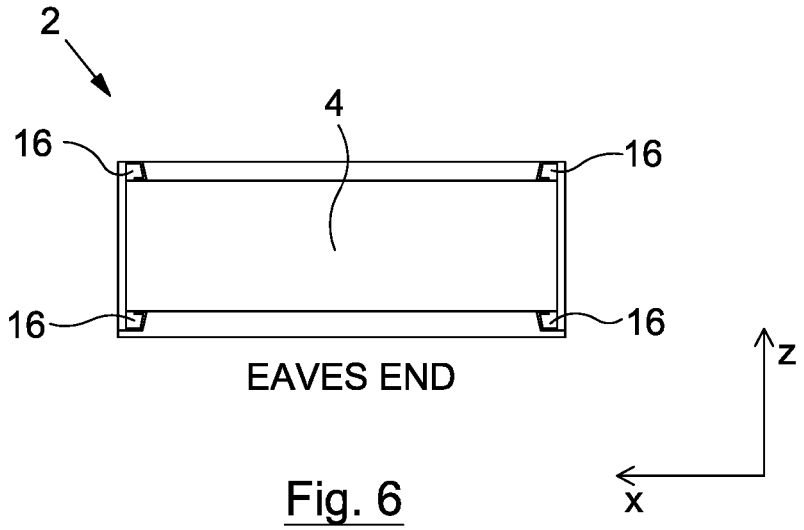
FIG. 6 is a second end view of the panel shown in FIGS. 1 to 5.

As can be best seen in FIG. 4, a protruding portion 8 of each of the two support panels 6 extends beyond the faces 10, 12 of the insulating panel 4. It will be appreciated that as used herein the faces of a panel are intended to mean the two surfaces that are separated by the thickness of the panel.

Therefore, the panel 2 is arranged such that on each of four edges of the panel 2, a protruding portion 8 of one of the support panels 6 stands proud of the insulation panel 4.

The panel 2 further comprises a flange extending from each protruding portion 8 of the two support panels 6, said flange extending generally parallel to the plane of the insulating panel 4. In the embodiment shown in FIGS. 1 to 6, each such flange is provided by a rolled light gauge steel strip 14 and a timber batten 16.

Each timber batten 16 is disposed adjacent to the protruding portion 8 of one of the support panels 6 and one of the faces 10, 12 of the insulating panel 4. Each steel strip 14 comprises a first portion which is adjacent to an external face of the one of the support panels 6 (that is a face of the support panel 6 which is opposed to the insulating panel 4) and a second portion which extends generally parallel to the plane of the insulating panel 4. The second portion of the steel strip 14 may be wrapped round the timber batten 16 so as to retain it in place.

Figure 1:
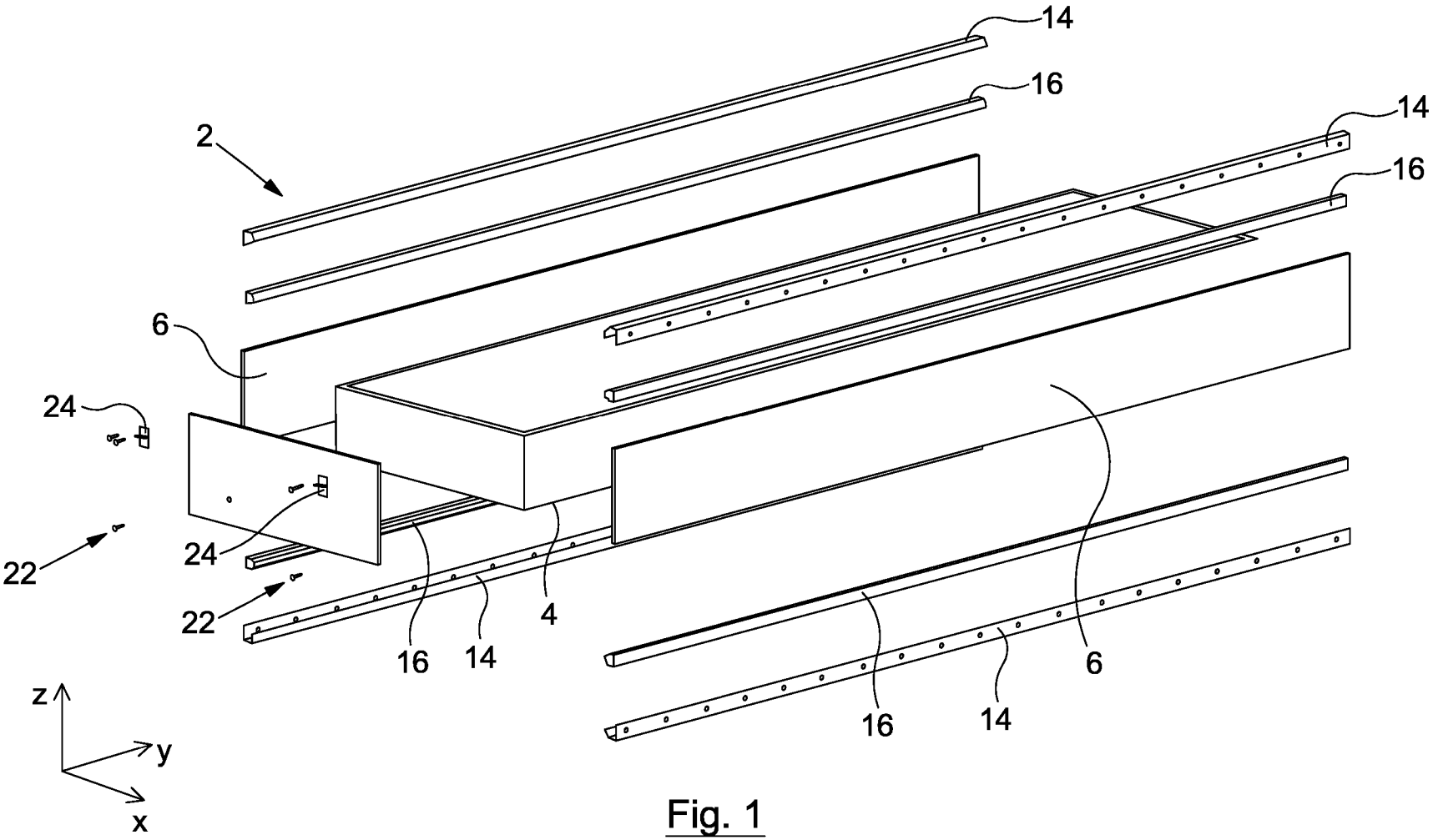
FIG. 1 is an exploded perspective view of a panel for a partition according to an embodiment of the invention.
Figure 2:
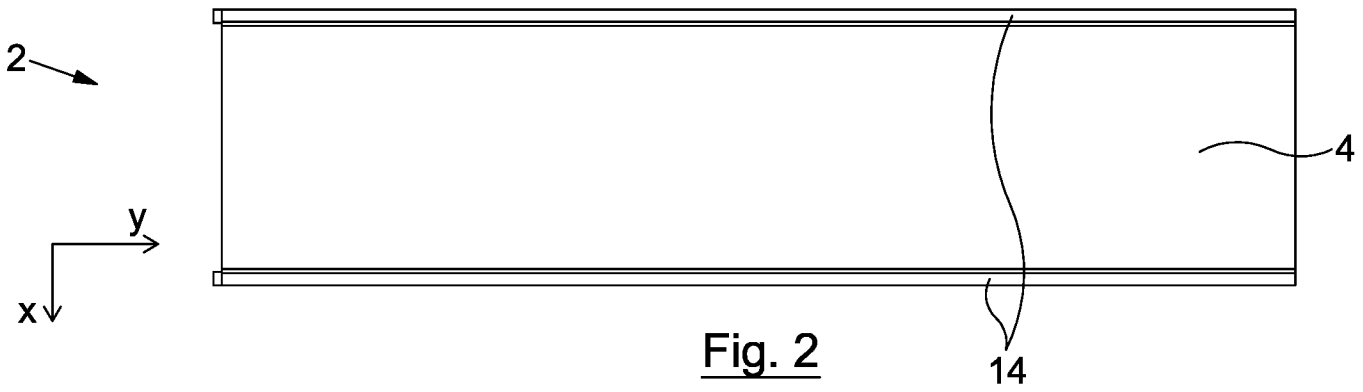
FIG. 2 is a plan view of the panel shown in FIG. 1.
Figure 3:
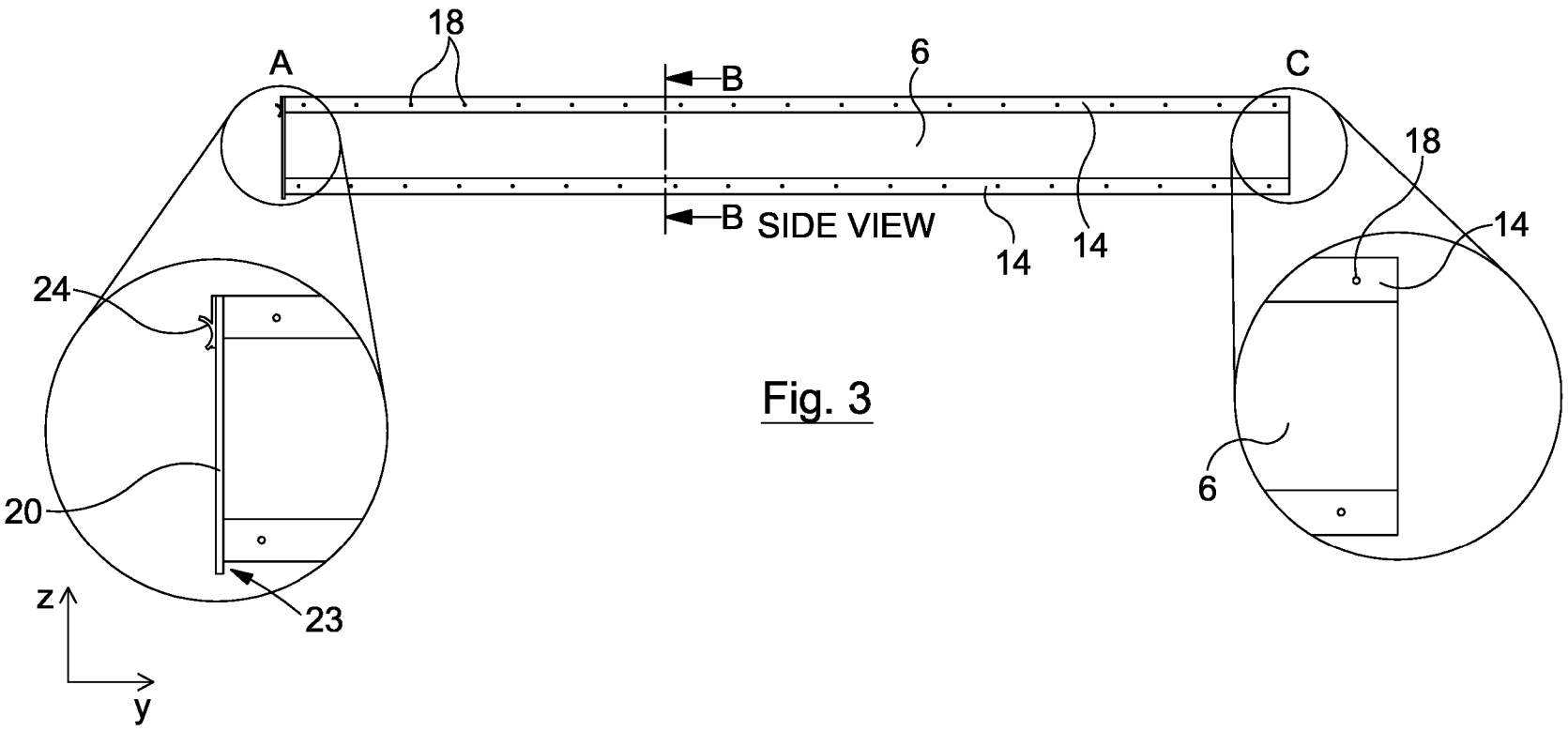
FIG. 3 is a side view of the panel shown in FIGS. 1 and 2.

The first portion of each steel strip 14 is mechanically attached to one of the support panels 6 by one or more fixings 18 (see FIG. 3). The fixings 18 may be, for example, punches, rivets, screws, nails or the like.

Each support panel 6 and the flanges extending therefrom together may be considered to provide a support member. That is, one support panel 6, two steel strips 14 and, optionally, two timber battens 16 may be considered to form a support member.

In FIGS. 1 to 6, thickness of the panel 2 is the z-direction. Of the other two dimensions generally perpendicular to the thickness of the panel 2, the dimension which both the insulating panel 4 and the support panels extend along (i.e. the y-direction) may be considered to be the length of the panel 2 and the other dimension (i.e. the x-direction) may be considered to be the width of the panel 2.

The panel 2 may be of any width. The width of the panel 2 may be selected bearing in mind both: the amount of support required for the overall structural stability of the panel and/or the requirements of any substrate which, in use, the panel 2 is intended to support. For example, in use the panel may support plasterboard (on an interior surface thereof) which is typically supported at a maximum of 600 mm centres.

Therefore, in one embodiment, the panel 2 may have a width of around 600 mm to accommodate this. The support panels 6 may have a thickness of around 6 mm. In order for the overall thickness of the panel 2 to be 600 mm, the width of the insulation panel 4 will be 588 mm. Therefore, across the width of the panel 2 there will be 12 mm of support panel material (for example hardboard) and 588 mm of insulation, i.e. 2% structure and 98% insulation.

The panel 2 shown in FIGS. 1 to 6 and described above provides an insulated construction panel wherein structural support is provided by the two support panels 6 placed on opposite sides of the insulation panel 4. This is in contrast to prior art insulated construction panels such as, for example, structurally insulating panels (SIPs) wherein where the insulation is sandwiched between two structural panels (i.e. two panels placed on the inside and outside faces of the construction panel).

Advantageously, the panel 2 uses significantly less structural support board than is required for an equivalent SIP panel. Furthermore, the support boards 6 may be thinner than the structural support board that is used in SIP panels. As a result, the panel 2 is significantly lighter and is significantly cheaper to produce.

The provision of a protruding portion 8 of the each of the two support panels 6 that extends beyond the faces 10, 12 of the insulating panel 4 offers a further benefit over prior art arrangements (for example SIPs), as now explained. A partition may be formed from a plurality of the panels 2, the plurality of panels being arranged in a row such that a support panel 6 of each panel 2 is adjacent to, and in contact with, a support panel 6 of an adjacent panel 2. Since each of the support panels 6 extends beyond at least one of the sides of the insulating panel, such a partition formed from a plurality of the panels 2 does not have a smooth, flat surface. Rather, the protruding portions 8 of the support panels 6 from each pair of adjacent panels 2 form a ridge on each surface of the partition (which is generally defined by the surfaces of the insulating panels 4).

With prior art arrangements, for example SIPs, battens need to be added to the internal surface of the construction panel for fire and electrical cabling reasons. Typically, an internal board (for example plasterboard) is fixed to said battens. When used as a roofing panel, on the external surface of a SIP, battens are attached for supporting roof tiles. However, these battens are required to be held off the external surface of the SIP with a counter batten to aid water drainage. With the panel 2 shown in FIGS. 1 to 6, the internal battens and the additional external counter battens are no required (due to the ridges on each surface of the partition formed by the protruding portions of the support panels from each pair of adjacent panels).

The provision of a flange extending from each protruding portion 8 of the two support panels 6 (as provided by the rolled light gauge steel strip 14 and the timber batten 16) provides a greater surface area at each end of the support panels 6, which is beneficial for a variety of reasons. First, with this arrangement the profile of the support member is generally half of an I shape. That is, in use, when the two support members from two adjacent panels 2 are in contact, together they are generally of the form of an I beam. The increased surface area of the support members provided by the flanges better distributes any load carried by a partition formed from the panels 2. Second, the increased surface area may make it easier for an internal or external cladding to be fixed to a partition formed from the panels 2.

The support panels 6 may be bonded or adhered to the insulation panel 4. This may be convenient since it may make each panel 2 a more easily transportable assembly. However, since the support panels 6 of the panel 2 extends generally perpendicularly to a plane of the panel 2, there is no need for any load to be transmitted through the insulating panel 4 (in contrast to SIPs). Therefore, any connection (for example adhesive bonding) between the support members 6 and the insulating panel 4 does not need to be of high integrity. This further reduces the manufacturing costs of the system of the first aspect relative to the prior art.

The support panels 6 will not have the same thermal performance as the insulation panel 4 and will typically reduce the thermal performance of the overall assembly in comparison to a construction with insulation alone. To reduce this effect the thickness of the support members 6 may be minimised and the material from which they are formed may be chosen to maximise the thermal performance of the panel 2 whilst fulfilling the structural roll.

The panel 2 may have any length as desired. It has been found that a panel with the features as described above may be able to span distances of around 6.5 m. It is envisaged that the construction of the panel may be such that it will only be cut to length by order. It is expected that this may reduce material waste significantly.

For embodiments wherein the panel 2 is intended to be used to span a pitched roof, one end of the panel 2 is provided with an end support panel 20. The end support panel 20 may be bonded or adhered to the insulating panel 4. Additionally or alternatively, the end support panel 20 may be attached to the timber battens 16 via fixings 22. The fixings 22 may be, for example, punches, rivets, screws, nails or the like.

As can be seen in FIG. 3, at one face of the panel 2 the end support panel 20 extends beyond the protruding portions 8 of the two support panels 6 so as to form a shoulder 23. In use, this shoulder 23 may engage with a complementary feature on a ridge beam. It will be appreciated that, in use, two or more panels 2 may be provided on a first side of a ridge beam and two or more panels 2 may be provided on a second, opposed side of the ridge beam. Proximate the opposite face of the panel 2 the end support panel 20 is provided with two hooks 24. In use, these hooks 24 may provide a location detail for one or more clamps (labelled 25 in FIG. 12) which extend between two panels 2 on opposite sides of a ridge beam. These clamps may be mechanically fixed to the ridge beam.

Figure 7:
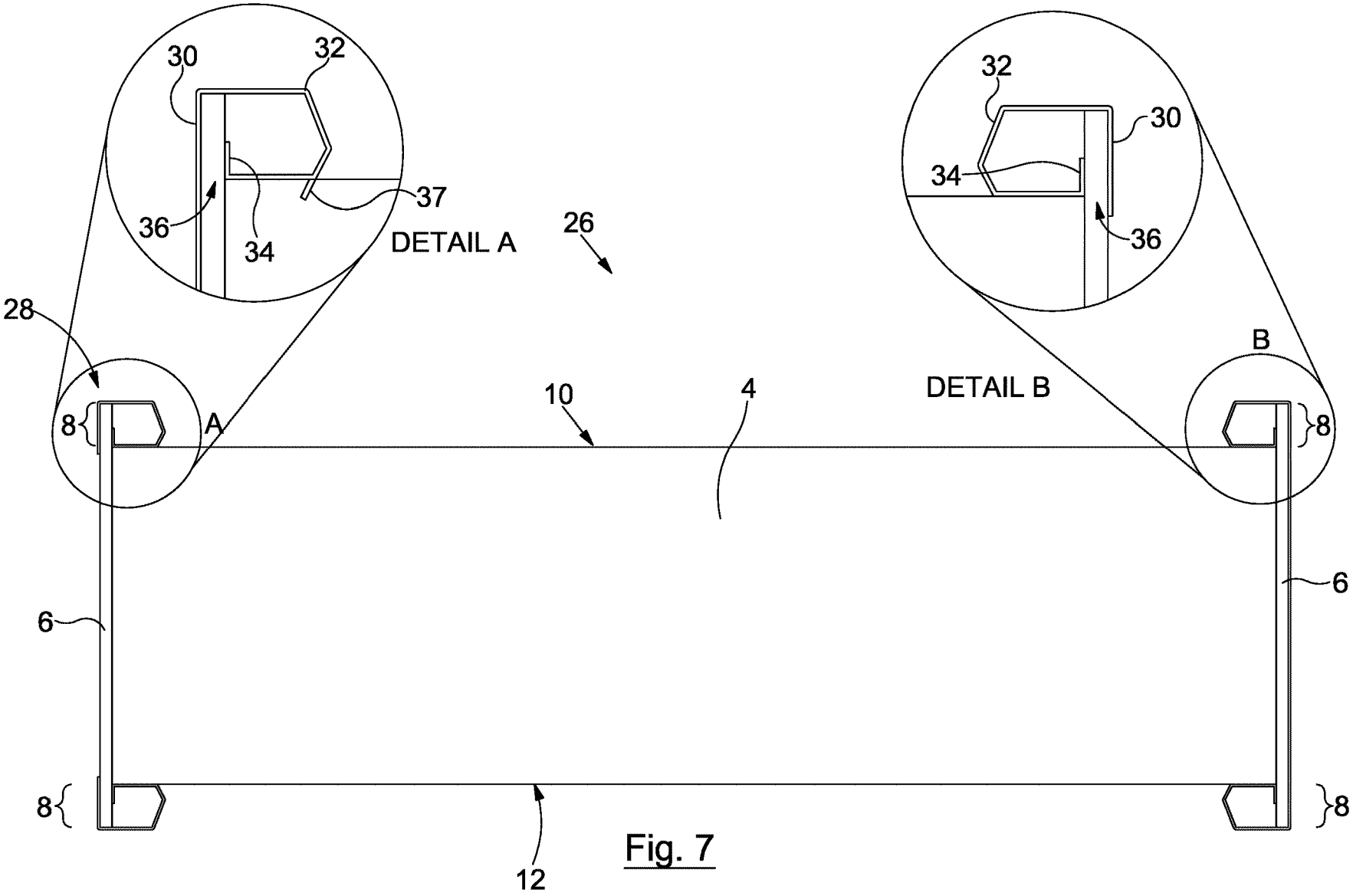
FIG. 7 is a cross sectional view of a second panel for a partition according to an embodiment of the invention.

As explained above, the support panels 6 may be bonded or adhered to the insulation panel 4, which may make each panel 2 more easily transportable assembly. An alternative arrangement is now described with reference to FIGS. 7 and 8. Accordingly, a second novel panel 26 for a partition according to an embodiment of the invention is shown in FIGS. 7 and 8. Features of panel 26 shown in FIGS. 7 and 8 which are substantially the same as those of the panel 2 shown in FIGS. 1 to 6 share common reference numerals. Only the differences between panel 26 shown in FIGS. 7 and 8 and the panel 2 shown in FIGS. 1 to 6 are now described.

The flanges extending from each protruding portion 8 of the two support panels 6 generally parallel to the plane of the insulating panel 4 comprise a modified rolled light gauge steel strip 28.

Each steel strip 28 comprises a first portion which is adjacent to an external face of the one of the support panels 6 (that is a face of the support panel 6 which is opposed to the insulating panel 4) and a second portion 32 which extends generally parallel to the plane of the insulating panel 4.

The second portion 32 of the steel strip is rolled or folded so as to be generally of the form a box beam. To achieve this, the steel strip 28 is rolled or folded such that the second portion 32 of the steel strip comprises: a portion 32*a* which extends generally parallel to, and is spaced apart from, a surface of the insulating panel 4; a portion 32*b* which extends generally towards a surface of the insulating panel 4; a portion 32*c* which extends generally parallel to, and adjacent to, a surface of the insulating panel 4; and a portion 32*d* which extends generally away from a surface of the insulating panel 4. It will be appreciated that the steel strip 28 may be formed by rolling or folding a sheet of steel at the intersection between each adjacent portion.

A distal end 34 of the second portion 32 is generally parallel to the first portion 30. Together the distal end 34 of the second portion 32 and the first portion 30 define a channel or groove 36 for receipt of the protruding portion 8 of one of the two support panels 6. Said channel or groove 36 defined by the distal end 34 of the second portion 32 and the first portion 30 may be dimensioned so as to form an interference fit with the protruding portion 8 of one of the two support panels 6. This may aid in assembly of the panel, keeping the steel strips 28 in place before retaining them with one or more fixings (in an analogous manner to the panel 2 shown in FIGS. 1 to 6).

The second portion 32 of each steel strip 28 is provided with a means for engaging with a face 10, 12 of the insulating panel 4. In particular, second portion 32 of each steel strip 28 is provided with a plurality of discrete or intermittent barbs 37 arranged to pierce or penetrate the insulating panel 4 so as to engage therewith. The barbs 37 are formed from a plurality of portions of the sheet material which are not rolled or folded when the intersection between the portion 32*b* which extends generally towards a surface of the insulating panel 4 and the portion 32*c* which extends generally parallel to, and adjacent to, a surface of the insulating panel 4 is formed.

Some embodiments of the invention relate to a modular partition system comprising: a plurality of panels (for example the panels 2, 26 described above) and at least one connecting strip arranged to cooperate with a support member from each of two of the plurality of adjacent panels. Such a connecting strip may take various different forms as now described with reference to FIGS. 9A-9C.

FIG. 9A shows a connecting strip 38 which is suitable for engaging with the flanges of the support members of the panels 2, 26 described above. The connecting strip 38 defines a channel or groove for receipt of the flanges of the support members of the panels 2, 26 described above. The profile of the connecting strip 38 is such that it forms an interference fit with the flanges of the support members of the panels 2, 26 described above.

Each of FIGS. 9B and 9C shows a different connecting strip 40, 42 which is suitable for engaging with the support panels 6 of a panel similar to those described above. The connecting strip 38 defines a channel or groove for receipt of the protruding portions 8 of two adjacent support panels 6 of the panels. Note that in these embodiments, the support panels 6 are not provided with a flange (neither a steel strip 14, 28 nor a timber batten 16 is provided). However, the connecting strips 40, 42 are provided with protruding flange portions on opposite sides of the channel or groove for receipt of the protruding portions 8 of two adjacent support panels 6. The protruding flange portions of the connecting strips 40, 42 serve an analogous role to the flanges provided on the panels 2, 26 described above). The profiles of the connecting strips 40, 42 are such that they form an interference fit with the protruding portions 8 of two adjacent support panels 6.

Generally, each type of connecting strip 38, 40, 42 shown in FIGS. 9A-9C forms an interference fit with a support member from each of two adjacent panels. Generally, each connecting strip 38, 40, 42 is also mechanically attached to both of the adjacent panels using one or more fixings (for example, punches, rivets, screws, nails or the like).

It will be appreciated that, in use, generally two connecting strips 38, 40, 42 are provided for each pair of adjacent panels, the two connecting strips 38, 40, 42 being provided at opposite ends of the support members.

A further embodiment of a modular partition system comprising: a plurality of panels and at least one connecting strip arranged to cooperate with a support member from each of two of the plurality of adjacent panels is now described with reference to FIGS. 10 to 12B.

FIG. 10 shows two adjacent panels 132 and a connecting strip 134 which is suitable for engaging with flanges of the support members of these panels 132. In this embodiment, the panels 132 differ from the panel 2 shown in FIGS. 1 to 6 and the panel 26 shown in FIGS. 7 to 8. In addition, the connecting strip 134 differs from the connecting strips 38, 40, 42 shown FIGS. 9A-9C. Only the differences between this embodiment and the above-described embodiments will be described in detail here. Accordingly, any features of the panel 132 which are substantially the same as those of the panel 2 shown in FIGS. 1 to 6 and the panel 26 shown in FIGS. 7 and 8 share common reference numerals.

The only difference between the panels 132 of this embodiment and the panel 2 shown in FIGS. 1 to 6 and the panel 26 shown in FIGS. 7 and 8 is the flange of the support panels 6. Similarly to the panel 26 shown in FIGS. 7 and 8, the flange of the panels 132 of this embodiment do not comprise a timber batten 16. The flange of the support panels 6 in the panels 132 of this embodiment comprises a modified steel strip 136 (which differs from the above-described steel strips 14, 28) and which will be described in with reference to FIGS. 11A-11D.

FIGS. 11A-11D show a portion of a support panel 6 and the steel strip 136. FIG. 11A shows a perspective view showing a surface 6*a* (which may be referred to as an interior surface) of the support panel 6 which in use contacts the insulating panel 4. FIG. 11B shows a perspective view showing a surface 6*b* (which may be referred to as an exterior surface) of the support panel 6 which in use is distal from the insulating panel 4. In FIGS. 11A-11D a set of Cartesian coordinate axes is shown which is consistent with those shown in FIGS. 1 to 6, such that the smallest dimension, or thickness, of each of the support panels 6 is the x-direction. The two dimensions generally perpendicular to the thickness of the support panels 6 may be considered to define the y-z plane. The smallest dimension, or thickness, of the insulating panel (not shown) is the z-direction. FIG. 11C is a cross-sectional view of the support panel 6 and the steel strip 136 in the x-z plane and FIG. 11D is a cross-sectional view of the support panel 6 and the steel strip 136 in the x-y plane.

As can be best seen in FIG. 11C, the steel strip 136 comprises: a first portion 138 which is in contact with and generally parallel to the exterior surface 6*b* of the support panel 6; a second portion 140 which extends generally between the two opposed surfaces 6*a*, 6*b* of the support panel 6; a third portion 142 which is generally parallel to the interior surface 6*a* of the support panel 6; and a fourth portion 144 which extends generally parallel to a surface of the insulating panel 4 (see FIG. 10).

The connecting strip 134 (see FIG. 10) defines a channel or groove for receipt of the part of the flanges of the support members 6 of two adjacent panels 132 as described above. The profile of the connecting strip 38 is such that it forms an interference fit with the flanges of the support members 6 of the panels 132, as now described.

The connecting strip 134 (which may be formed from rolled steel) is generally of the form of a box beam but having an aperture for receipt of part of the two support panels proximate an edge thereof and part of the steel strip 136 proximate the edges of the support panels. In particular, the connecting strip 134 comprises a central wall portion 134*a* and two generally U-shaped side portions 134*b*, 134*c*. The channel or groove for receipt of part of the flanges of the support members 6 of two adjacent panels 132 is formed between the two side portions 134*b*, 134*c*.

Between the second and third portions 140, 142, each steel strip 136 comprises a protrusion portion 141, which extends out away from the interior surface 6*a* of the support panel 6. The protrusion portions 141 are dimensioned such that the protrusion portions 141 of the two adjacent panels 132 are slightly larger than an opening of the channel or groove formed between the two side portions 134*b*, 134*c*. However, connecting strip 134 can resiliently deform sufficiently to allow the protrusion portions 141 of the two adjacent panels 132 to be received in the channel or groove. Once the protrusion portions 141 of the two adjacent panels 132 have passed the two side portions 134*b*, 134*c*, the connecting strip 134 can snap back such that the protrusion portions 141 are held captive in the groove or channel.

At a distal end of the fourth portion of the steel strip 136 is provided with a barbed portion 146, which provide with a means for engaging with a face of the insulating panel 4. The barbed portion 146 is similar to the barbs 37 of the embodiment shown in FIGS. 7 and 8 and is arranged to pierce or penetrate the insulating panel 4 so as to engage therewith. However, in this embodiment rather than a plurality of discrete barbs 37, the barbed portion 146 is formed substantially along the whole length of the steel strip 136.

The first portion 138 of each steel strip 136 is mechanically attached to the exterior surface 6*b* one of the support panels 6. Similarly, the third portion 142 of each steel strip 136 is mechanically attached to the interior surface 6*a* one of the support panels 6. In this embodiment, this is achieved by crimping the first portion 138 of the steel strip 136 to the exterior surface 6*b* one of the support panels 6 and crimping the third portion 142 of the steel strip 136 to the interior surface 6*a* one of the support panels 6 using tool to punch, clinch or crimp these surfaces together, as will be described further with reference to FIGS. 12A and 12B, at a plurality of positions. As a result, a plurality of dimples or recesses 148 is visible on the exterior surfaces of the first and third portions 138, 142 of the steel strips 136.

FIG. 12A is a cross-sectional view of the support panel 6 and the steel strip 136 in the x-z plane and FIG. 12B is a cross-sectional view of the support panel 6 and the steel strip 136 in the x-y plane. Also shown schematically in FIGS. 12A and 12B is a tool tip 150.

It will be appreciated that the tool tip 150 is driven into an exterior surface of the first and third portions 138, 142 of the steel strips 136 so as to cause plastic deformation of the surfaces of both the first and third portions 138, 142 of the steel strips and the support panels 6 (which may be flat prior to said plastic deformation). As a result of this plastic deformation, the surfaces of the first and third portions 138, 142 of the steel strips 136 are complementary to and in engagement with the exterior and interior surfaces 6*b*, 6*a* of the support panel respectively.

The tool tip 150 may be generally cylindrical, having a diameter of the order of 4 to 6 mm. However, as can be best seen in FIG. 12A, the tip of the tool tip 150 may taper to a rectangular edge, being similar in shape to a flat screwdriver. The tool tip may be driven in to a depth of the order of 3 to 4 mm. As with previous embodiments, the support panel 6 may have a thickness of the order of 6 mm and the steel strip 136 may be a light gauge steel strip having a thickness of the order of 1 mm. A distance 152 between the centres of adjacent recesses 148 (formed by tool tip 150) may be of the order of 40 mm.

As can be best seen in FIG. 12B, the recesses 148 formed on the interior side 6*a* of the support panel 6 are offset in the y direction relative to the recesses 148 formed on the exterior side 6*b* of the support panel 6. It will be appreciated that although two recesses 148 are shown in FIG. 12A (and FIG. 11C) this is merely to indicate that recesses are provided on both sides of the support panel 6 and that in reality these recesses are offset (as in FIGS. 12B and 11D) such that they would not appear in the same cross section in the x-z plane.

It will be appreciated that the modular partition system can be used to form a partition, with a plurality of adjacent and parallel panels (for example panels 2, 26, 132) connected together using two connecting strips (for example the connecting strips 38, 40, 42, 134) for each pair of adjacent panels. The two connecting strips being provided at opposite ends of the support members 6 of the two adjacent panels.

In general, the support members 6 and connecting strips span between two supports (for example roof beams) and may be manufactured to the desired length (i.e. the dimension of the panels in the y-direction as shown, for example, FIGS. 1 to 6) so as to span between the supports.

The panels may be of any width. The width of the panels may be selected bearing in mind both: the amount of support required for the overall structural stability of the panel and/or the requirements of any substrate which, in use, the panels are intended to support (such as, for example, floorboards, plasterboard etc.). It will be appreciated that it may be desirable for the total assembled width of the modular panel system (i.e. the dimension of the modular system in the x-direction as shown, for example, FIGS. 1 to 6) to be approximately equal to (but slightly smaller than) the width of the partition so as to allow a tolerance gap. The widths of the panels may be selected to be an integer fraction of the width of the partition. Additionally or alternatively, the panels may be provided in one or more standard widths having a width of, for example, around 400 mm, 500 mm or 600 mm. It will be appreciated that for a partition that will have an overall width that is not an integer multiple of one of these standard widths (or a combination of different standard widths) one or more bespoke panel may be formed such that the total assembled width of the modular panel system is approximately equal to (but slightly smaller than) the width of the partition so as to allow a tolerance gap.

In order to allow for a tolerance gap, one or more edging strips may be provided, as now explained. The edging strips may be suitable for engaging with the flange portion of a single panel (in contrast to the connecting strips 38, 40, 42, 134, which are each arranged to engaging with the flange portions of two adjacent panels). Therefore, the edging strips may have a profile shape that is generally of the form of half of one of the connecting strips. This is now explained for the embodiment shown in FIGS. 10 to 12B and described above, with reference to FIGS. 13A and 13B. It will be appreciated that similar edging strips may be provided for the embodiments shown in FIGS. 9A to 9C.

FIG. 13A shows a single panel 132 and an edging strip 154 which is engaged with flange of the support members of the single panel 132. The panel 132 is substantially as described above with reference to FIGS. 10 to 12B. In particular, the panel is provided with the steel strip 136 which is mechanically attached to the support panel 6 and which has a protrusion portion 141 which extends out away from an interior surface of the support panel 6.

The edging strip 154 (which may be formed from rolled steel) is generally of the form of half of the connecting strip 134. The edging strip 154 is generally of the form of a box beam and has an aperture for receipt of: part of the support panel 6 proximate an edge thereof and part of the steel strip 136 proximate the edge of the support panel 6. The edging strip 154 comprises a central wall portion 154*a* disposed between one generally U-shaped side portion 154*b* and one generally flat side portion 154*c*. The channel or groove for receipt of part of the flange of the support members 6 of the single panel 132 is formed between the two side portions 154*b*, 154*c*.

The central wall portion 154*a* has a length that is approximately half that of the central wall portion 134*a* of the connecting strip 134 (cf. FIG. 10). The generally U-shaped side portion 154*b* is generally the same shape as one of the two generally U-shaped side portions 134*b*, 134*c* of the connecting strip 134. However, the other side portion 154*c* comprises a generally flat wall portion that is generally perpendicular to the central wall portion 154*a* and which contacts and is parallel to the first portion 138 of the steel strip 136.

The edging strip 154 engages with the steel strip 136 in a similar snap fit to that between the connecting strip 134 and the pair of adjacent steel strips 136. The protrusion portion 141 is dimensioned so as to be slightly larger than an opening of the channel or groove formed between the two side portions 154*b*, 154*c*. However, the edging strip 154 can resiliently deform sufficiently to allow the protrusion portion 141 to be received in the channel or groove. Once the protrusion portions 141 of the panel 132 has passed the two side portions 154*b*, 154*c*, the edging strip 154 can snap back such that the protrusion portion 141 is held captive in the groove or channel.

FIG. 13B shows two adjacent panels 132, each having an edging strip 154 which is engaged with the flange of the support members of the panels 132 and with a tolerance gap 156 provided between the two panels 132. The tolerance gap 156 may be at least partially filled with a suitable filler material 158 (such as, for example, a foam). It will be appreciated that the two adjacent panels may in use be connected via a substrate that is supported by the modular panel system (such as, for example, floorboards, plasterboard of the like). Such a substrate may contact the central portions 154*a* of both edging strips 154 and may be connected thereto using mechanical fixings (such as, for example nails or screws).

An embodiment of the invention which relates to a modular partition system for use in a pitched roof is now described with reference to FIGS. 14 to 23.

FIG. 14 is a schematic perspective view of the structure of hip roof 44 which may incorporate a modular partition system according to an embodiment of the invention.

The hip roof 44 comprises eaves beams 46, each running along the top of a wall 47 to define a perimeter of the hip roof 44, and a ridge beam 48 defining its top edge. The ridge beam 48 is supported by four hip beams 50, which each extends along a diagonal edge of the roof, from an end of the ridge beam 48 to a corner at which two eaves beams 46 meet.

A modular partition system 52 according to an embodiment of the invention is now described with reference to FIGS. 15 to 21.

FIG. 15 is a cross sectional view of a portion of the modular partition system 52 according to an embodiment of the invention. The modular partition system 52 comprises a plurality of panels 2 as described above with reference to FIGS. 1 to 6. Three panels 2 are shown in FIG. 15 but it will be appreciated that in alternative embodiments the modular partition system 52 may comprise two or greater than three panels 2. The panels 2 are arranged such that the insulating panels 4 of each of the panels 2 are generally mutually parallel and one support member (i.e. one support panel 6, two steel strips 14 and, optionally, two timber battens 16) of each of the plurality of panels 2 is adjacent to a support member of an adjacent panel 2. The modular partition system 52 further comprises two connecting strips 38 for each pair of adjacent panels 2. Each connecting strip 38 is generally of the form shown in FIG. 9A and is arranged to cooperate with a support member from each of two of the plurality of adjacent panels 2.

Generally, on an interior surface of the modular partition system 52, an internal substrate 54 is connected to the panels 2 using one or more fixings (typically screws or nails or the like). The internal substrate 54 may comprise plasterboard, for example 12.5 mm foil backed plasterboard. Each of these fixings passes through a connecting strip 38 and into the flange of one of the panels (i.e. a steel strip 14 and timber batten 16).

Optionally a batten 56 may be provided between the internal substrate 54 and each connecting strip 38. This may be desirable, for example if it is desired to increase the size of the void 58 which is formed between the internal substrate 54 and the insulating panels 4 of the panels 2.

Generally, on an exterior surface of the modular partition system 52, an external substrate or roof structure is connected to the panels 2. There are various different options for such external substrates, as known in the art. In the following, two options are discussed and, from these, it will be apparent to the skilled person how the modular partition system 52 can be used with other types of external substrates. The first option comprises a layer of oriented strand board (OSB) connected to the panels 2 and a layer of roof tiles connected directly thereto. The second option comprises one or more rows of battens (generally extending perpendicular to the fall of the roof) to which roof tiles are connected.

FIG. 17 is a perspective view of a hip roof (of the type shown in FIG. 14) which incorporates the modular partition system 52. FIG. 17 shows an external surface of the modular partition system 52 before an external substrate or covering has been applied. FIG. 18A is a perspective view of the hip roof shown in FIG. 17 with OSB boards 60 fixed to the panels 2 (via the connecting strip 38 and into the flange of one of the panels 2). This is therefore in line with the first roofing option (before the tiles have been applied). FIG. 18B is a perspective view of the hip roof shown in FIG. 17 with rows of timber battens 62 fixed to the panels 2 (via the connecting strip 38 and into the flange of one of the panels 2). This is therefore in line with the second roofing option (before the tiles have been applied).

FIG. 15 shows the first roofing option whereas FIG. 16 shows the second roofing option.

Referring again to FIG. 15, in some embodiments, a layer of OSB boards 60 are fixed to (an exterior surface of) the panels 2 using one or more fixings (typically screws or nails or the like). Each of these fixings passes through a connecting strip 38 and into the flange of one of the panels (i.e. a steel strip 14 and timber batten 16). A layer of tiles 64 is attached to the layer of OSB boards in a conventional manner.

FIG. 16 is a cross sectional view of a hip roof which incorporates the modular partition system 52. FIG. 16 is a cross sectional view which shows a ridge beam 48 and two eaves beams 46 (cf FIG. 14). A section of roof is provided which spans between the ridge beam 48 and each of the two eaves beams 46.

Each section of roof which spans between the ridge beam 48 and one of the eaves beams 46 is generally of the form of the modular partition system 52 shown in FIG. 15 (although in this Figure, timber battens 62 are fixed to the external surface of the modular partition system 52 as opposed to the OSB board 60 and tiles 64 shown in FIG. 15).

The modular partition system 52 engages with the ridge beam 48 and one of the eaves beams 46 as will now be described with reference to FIGS. 19 to 21.

Engagement between the panels 2 of the modular partition system 52 and the ridge beam 48 is now discussed with reference to FIG. 19. The ridge beam 48 has a generally constant cross sectional profile as shown in FIG. 19. The profile of the ridge beam 48 comprises a central portion 49, which is generally of the form of a box beam, and two side portions 65 provided on each side of the central portion 49. Each of the two side portions provides a feature for engagement with the shoulder 23 formed by the end support panel 20 and the protruding portions 8 of the two support panels 6. In particular, each of the two side portions 65 defines a flange or lip 63 for engagement with the shoulder 23 formed by the end support panel 20 and the protruding portions 8 of the two support panels 6. This engagement between the flange or lip 63 for engagement with the shoulder 23 formed by the end support panel 20 and the protruding portions 8 of the two support panels 6 may aid the installation of the panels 2 by providing a locating feature. Once the panels 2 are engaged with the ridge beam 48 they can be mechanically attached thereto by way of one or more fixings 66 (for example, self-tapping screws). The fixings 66 pass through the side portions 65 of the ridge beam 48 and into the panels 2 (for example through the connecting strip 38 and into the flange formed by steel strip 14 and timber batten 16). As shown in FIG. 19, the flange or lip 63 defined by the each side portion 65 is folded back from a main portion of the side portion 65 and the fixings 66 pass through the main portion of the side portion 65, through the flange or lip 63 and into the panel 2.

The end support panel 20 may be formed from the same material as the support panels 6. Alternatively, in some embodiments, the end support panel 20 may be formed from a steel strip or sheet. For such embodiments, the portion of the end support panel 20 which extends beyond the protruding portions 8 of the two support panels 6 (so as to form a shoulder 23) may be curved or generally hook shaped so as to better engage with the two side portions 65 of the ridge beam 48.

It will be appreciated that in a ridge roof of the form shown in FIG. 14, at least some of the panels 2 will span between one of the ridge beams 50 and one of the eaves beams. As can be seen in FIG. 17, such panels are generally of the form of a trapezium (i.e. having two parallel sides and two non-parallel sides). It will be appreciated that such panels 2 are also provided with an end support panel 20 which defines a shoulder 23 for engagement with a feature on the ridge beam 50 in an analogous manner to the engagement with the ridge beam 48 described above.

FIG. 20 shows, from the interior of the roof, an engagement between a panel 2 and an eaves beam 46. As can be seen, the eaves beam 46 defines a flange or lip 67 upon which the panels 2 are supported. The connecting strip 38 stops short of the flange 67 defined by the eaves beam 46 and an additional fixing clip 68 is provided adjacent to the flange 67. This fixing clip 68 comprises a first portion 72 which has a similar profile to that of the connecting strip 38 and which is arranged to cooperate with a support member from each of two adjacent panels 2 in an analogous manner. The fixing clip 68 further comprises a second portion 74 which is generally parallel to the flange 67 defined by the eaves beam 46. Mechanical fixing of the modular partition system 52 to the eaves beam 46 is achieved by a pair of fixings 70 (for example self-tapping screws) which pass through the second portion 74 of the fixing clip 68, through the flange 67 defined by the eaves beam 46 and into the support member of one of the two adjacent panels 2.

FIG. 21 shows, from the exterior of the roof, an engagement between a panel 2 and an eaves beam 46. As can be seen, on the exterior side, the connecting strip 38 extends beyond the support members from the two adjacent panels 2 which it is arranged to cooperate with, over a surface of the eaves beam 46. Optionally, a timber batten 76 may be provided in the space between the connecting strip 38 and the eaves beam 46. Mechanical fixing of the modular partition system 52 to the eaves beam 46 is achieved by a pair of fixings 78 (for example self-tapping screws) which pass through the connecting strip 38, the timber batten 76 (if present) and into the eaves beam 46.

The modular partition system 52 provides a particularly versatile and cost effective system for constructing a partition (for example a roof) which provides a number of advantages over the prior art, as now discussed.

The modular partition system 52 provides an alternative to prior art insulated construction panels such as, for example, structurally insulating panels (SIPs). Within an SIP the insulation is sandwiched between two structural panels (i.e. two panels placed on the inside and outside surfaces of the construction panel). SIP panels are not only used for roofs but also generally for construction building walls and floors. Furthermore, SIPs are generally manufactured as large sheet materials that may form an entire, or at least a significant portion of, a partition. This is an intentional feature of prior art SIP systems which is intended to reduce the number of joints in the hope that this will provide less opportunity for air leaks.

Advantageously, the modular partition system 52 uses panels wherein the support members are disposed on the sides of the insulating panels 4 extending generally perpendicularly to a plane of the modular partition system 52. As a result, the modular partition system 52 may use significantly less structural support material than is required for an equivalent SIP panel. As a result, the panels 2 are significantly lighter and are significantly cheaper to produce. In addition, since the support members of the panels 2 extend generally perpendicularly to a plane of the modular partition system 52, there is no need for any load to be transmitted through the insulating panel 4 (in contrast to SIPs). Therefore, any connection (for example adhesive bonding) between the support members and the insulating panel 4 does not need to be of high integrity. In fact, as discussed above with reference to FIGS. 7 and 8, in some embodiments the support members may be provided with one or more features that provide an interference fit with the insulating panel 4, which can avoid the expense of an adhesive bonding between the support members and the insulating panel 4. This further reduces the manufacturing costs of the system of the modular partition system 52 relative to the prior art.

Furthermore, contrary to the teachings of the prior art, the modular partition system 52 lends itself better to an arrangement with a larger number of panels and, consequently, a larger number of joins. This has been allowed, at least in part, due to the provision of the novel connecting strips 38 arranged to cooperate with a support member from each of two of the plurality of adjacent panels 2 so as to aid a structural connection between two adjacent panels 2. Since the modular partition system 52 allows such smaller panels, it can result in a further cost benefit since the quantity of waste material, for example at apertures in the partition (e.g. doors and windows) and at the joins between partitions (e.g. the corner of a room) can be significantly reduced or even eliminated completely.

In some embodiments, the modular partition system 52 may further comprise a resilient seal between each pair of adjacent panels. For example, a side surface of either or both of the two support members (for example an exterior face of the support panels 6) may be provided with a sealing material (for example a foam tape or the like). Alternatively, a suitable sealing material may be manually provided during installation.

Furthermore, because the modular partition system 52 allows such panels 2, it can be significantly easier to install. For example, it may be easier for the panels 2 of the modular partition system 52 to be manually installed, removing the need for lifting apparatus (e.g. a crane or the like), which can be costly and can lead to costly delays on construction sites (e.g. if the lifting apparatus is temporarily unavailable).

For embodiments wherein the insulation used in the insulating panels 4 is closed cell (for example XPS) there may not be a need for an external (waterproof) membrane to be provided for roofs using the modular partition system 52.

If an external membrane is used with the modular partition system 52 it may be held in place by the connecting strips 38. That is, the external membrane may be applied over two adjacent panels 2 before the connecting strips 38 engage with their support members. Alternatively, an external membrane may be held in place by the steel strips 14 of the panels 2. This is particularly advantageous since the external membrane may be applied at manufacture of the panels 2 saving on installation time.

It will be appreciated that the modular partition system 52 may be provided with a modified connecting strip to allow for site tolerances. For example, due to site tolerances along a run of panels 2 there will be a pair of adjacent panels 2 that have a gap between them. This gap could be filled with expanding foam as is customary and the modified connecting strip may be provided as two separate members with extended legs such that they can overlap each other and be attached together using one or more fixings.

As explained above, at least in some embodiments, one or more rows of battens (generally extending perpendicular to the fall of the roof) are attached to the exterior of the modular partition system 52 to support roof tiles. Therefore, in some embodiments, the connecting strips may be provided with one or more engagement features for engagement with a batten, as now discussed with reference to FIGS. 22 and 23.

FIG. 22 is a perspective view of a hip roof which incorporates a modular partition system according to an embodiment of the invention of the type discussed above. The embodiment shown in FIG. 22 uses a connecting strip 40 which is generally of the form shown in FIG. 9B. The connecting strip 40 defines a channel or groove for receipt of the protruding portions 8 of support panels 6 from two adjacent panels.

On an opposite surface of the connecting strip 40 to said channel or groove is provided a plurality of engagement features for a metal batten. Each engagement feature comprises two pairs of generally L shaped protrusions 80. The protrusions 80 comprise a first portion which extends generally perpendicularly from an upper surface of the connecting strip 40 and a second portion, distal from the upper surface of the connecting strip 40 which extends generally parallel to the upper surface of the connecting strip 40. The second portion of each protrusion 80 defines a guide channel for receipt of a guide flange of a metal batten. Within each pair of protrusions, the second portions extend towards each other such that the guide channels are facing each other. Furthermore, each the guide channels of the two pairs of protrusions are aligned.

As can be seen in FIG. 22, the engagement features are suitable for guiding a batten 82 (for example formed from a rolled light gauge steel strip) comprising two side flanges 83 and a raised central portion 84. The batten 82 may be installed by sliding it in a direction generally parallel to the batten 82 (and generally perpendicular to the connecting strips) so that each of the two side flanges 83 are received in the guide channels formed by the protrusions 80.

The engagement features may be provided at any convenient separation along the connecting strips 40.

The connecting strips 40 may be formed from a light gauge steel strip. The protrusions 80 may be formed from a portion of the upper surface of the connecting strips 40 which has been partially separated from a main part of the upper surface of the connecting strips 40 (for example by cutting or stamping) and which has been bend out of the plane of the main surface of the connecting strips 40.

FIG. 23 is a perspective view of a hip roof which incorporates a modular partition system according to an embodiment of the invention of the type discussed above. The embodiment shown in FIG. 23 also uses a connecting strip 40 which is generally of the form shown in FIG. 9B. The connecting strip 40 defines a channel or groove for receipt of the protruding portions 8 of support panels 6 from two adjacent panels.

On an opposite surface of the connecting strip 40 to said channel or groove is provided a plurality of engagement features for a timber batten 62. Each engagement feature comprises two generally L shaped protrusions 86. The protrusions 86 comprise a first portion which extends generally perpendicularly from an upper surface of the connecting strip 40 and a second portion, distal from the upper surface of the connecting strip 40 which extends generally parallel to the upper surface of the connecting strip 40. The second portion of each protrusion 80 defines a guide channel for receipt of a timber batten 86. The guide channels defined by the two protrusions are aligned.

In use, the connecting strips 40 are installed such that the guide channels defined by the protrusions 86 face generally upwards (for example towards a ridge beam).

As can be seen in FIG. 23, the engagement features are suitable for guiding a timber batten 62. The batten 62 may be installed by sliding it into the guide channels of the connecting strips 40 in a direction generally perpendicular to the batten 62 (and generally parallel to the connecting strips 40). At a distal end of each of the protrusions 86 is provided a lip or flange 88 which faces towards the upper surface of the connecting strip 40. The dimensions of the protrusions 86 and the timber batten 62 may be selected such that the protrusions have to flex in order for the timber batten 62 to pass the lip or flange 88 to be received in the guide channels of the connecting strips 40. With such an arrangement the lip or flange 88 acts to retain the timber batten 62 in the guide channels of the connecting strips 40.

The engagement features may be provided at any convenient separation along the connecting strips 40.

An embodiment of the invention which relates to a modular partition system 90 for use in a cavity wall is now described with reference to FIGS. 24 to 28.

It will be appreciated that the modular partition system 90 shares many features in common with the modular partition system 52 as shown in FIGS. 15 to 21 and described above. The main difference is the application in that the modular partition system 90 shown in FIGS. 24 to 28 forms part of a wall rather than a roof. Features of modular partition system 90 shown in FIGS. 24 to 28 which are substantially the same as those of the modular partition system 52 shown in FIGS. 15 to 21 share common reference numerals. Only the differences between the modular partition system 90 shown in FIGS. 24 to 28 and the modular partition system 52 shown in FIGS. 15 to 21 are now described.

As can be seen in FIG. 24, on an interior surface of the modular partition system 90, an internal substrate 54 is connected to the panels 2 using one or more fixings (typically screws or nails or the like) in an analogous manner way to modular partition system 52. In this embodiment, however, the optional spacing battens 56 are omitted.

The modular partition system 90 forms the inner leaf of a cavity wall construction. Therefore, on an exterior surface of the modular partition system 90 an external leaf 92 of the cavity wall is provided, a space or cavity being provided therebetween.

FIGS. 25 and 26 are a partially cut away perspective view and a cross sectional view respectively of a building which incorporates the modular partition system 90. The building comprises a solid floor 94 and two suspended timber floors 96 above this. In the following the space between the solid floor and the lower suspended timber floor 96 will be referred to as downstairs and the space between the two suspended timber floors 96 will be referred to as upstairs. The solid floor 94 may comprise a concrete slab. The suspended timber floors 96 are of typical construction comprising a plurality of generally parallel floor joists 98 supporting a floor substrate 100 and a ceiling substrate 102. The floor joists are supported at each end by beams 104.

FIG. 25 shows an internal surface of the modular partition system 90 before an internal substrate (for example plasterboard) has been applied.

The inner leaf of the cavity walls comprises the modular partition system 90, which are supported by the floors 94, 96 as now described with reference to FIGS. 27 and 27.

The panels 2 of the modular partition system 90 which are downstairs are supported by a sole plate 106 which is mechanically anchored to the solid floor 94 (see FIG. 28). In turn, these downstairs panels 2 of the modular partition system 90 support beams 104 for supporting the upstairs panels 2 of the modular partition system 90 and the lower suspended timber floor 96 (via joist hangers of the like in a conventional manner).

In this way the load of the upstairs wall and the lower suspended timber floor 96 is transmitted through the beams 104 and the downstairs wall to the solid floor. For any apertures (for example doors and windows) 108 a lintel 110 is provided to distribute the directly above the aperture 108 to the portions of the wall on either side, in a conventional manner.

It is desirable to mechanically tie the inner and outer leaves of a cavity wall together. Therefore, in some embodiments, the connecting strips on the exterior side of the modular partition system 90 may be provided with one or more engagement features for engagement with a wall tie, as now discussed with reference to FIGS. 29 and 30.

FIG. 29 is a partially cut away view of the building shown in FIGS. 25 to 28 showing an engagement system for wall ties. The embodiment shown in FIG. 29 uses a connecting strip 40 which is generally of the form shown in FIG. 9B, which is reproduced as FIG. 30 showing engagement between the connecting strip 40 and a wall tie. The connecting strip 40 defines a channel or groove for receipt of the protruding portions 8 of support panels 6 from two adjacent panels.

On a flange portion of the connecting strip 40, on two opposite sides of the connecting strip 40 are provided a plurality of features 112 for engaging the ends of a wire wall tie 114. The features 112 may be provided at any convenient separation along the connecting strips 40. During construction, wall ties 114 may be connected to the connecting strip 40 where desired. Subsequently, during construction of the outer leaf brick wall 92, a portion 116 of the wall tie 114 near its distal end is set in the mortar of the brick wall, tying the two leaves together.

The above described panels 2, 26 for a partition comprise an insulating panel 4, i.e. a panel comprising a thermally insulating material, extending between two support panels 6. However, it will be appreciated that in alternative embodiments the insulating panel 4 may be replaced by a material that is not thermally insulating. For example, panels for use in internal partitions (either walls or floors), where insulation is not required, may use a cheaper material such as, for example, cardboard. Such embodiments still enjoy many of the benefits discussed above and the cheaper filler material merely provides a connection between the load bearing support members to aid the installation of a partition comprising these panels. As a further alternative, the insulating panels 4 may be replaced with a material with other properties as may be desired for the partition such as, for example, sound insulation. Such an arrangement is shown in FIGS. 31 and 32.

FIGS. 31 and 32 show a portion of a modular partition system 118 according to an embodiment of the invention. The modular partition system 118 is similar to the modular partition system 52 described above although it employs a modified panel 120 and connecting strip 121. Features of the modular partition system 118 shown in FIGS. 31 and 32 which are substantially the same as those of previously described embodiments share common reference numerals. Only the differences between modular partition system 118 shown in FIGS. 31 and 32 and previously described embodiments are now described.

The modified panel 120 is similar in construction to the panels 2, 26 described above although the insulating panel 4 which extends between the two support panels 6 has been replaced by an alternative central panel 122. In this embodiment, the central panel 122 is a composite panel comprising a filler material 124 sandwiched between two sound absorption boards 126. The filler material 124 may comprise mineral wool insulation or another sound absorbing material as appropriate. The sound absorption boards 126 are provided with a plurality of through holes to aid sound absorbsion.

As can be best seen in FIG. 32, flanges extending from each protruding portion of the two support panels 6 generally parallel to the plane of the central panel 122 comprise a rolled light gauge steel strip 128 which is similar to that of the rolled light gauge steel strip 28 of panel 26 described above. However, in this embodiment, there is sufficient space between the flanges provided on opposite edges of the support panels 6 to accommodate both the filler material 124 and the two sound absorption boards 126. Accordingly, a slot 130 is formed between each steel strip 128 and a surface of the filler material 124 for receipt of a sound absorption board 126.

The connecting strip 121 is generally of the form of connecting strip 38 described above (see FIG. 9A) and is arranged to cooperate with a support member from each of two of the plurality of adjacent panels 2.

As discussed above, some embodiments of the present invention relate to a modular partition system for forming a partition (for example a thermally insulating or sound insulating partition). In particular, some embodiments of the invention relate to self-supporting structures which can bear a load such as, for example, a roof, a wall or a floor of a building. Generally these embodiments may comprise a plurality of panels (for example the panels 2, 26, 132, 120 described above) and a pair of connecting strips arranged to cooperate with a support member from each of two adjacent panels. The bulk of each panel is non-load bearing in use and provides thermal or sound insulation. The support members of two adjacent panels, along with two connecting strips co-operate to form an I beam.

Some other embodiments of the invention relate to a support beam, as now discussed with reference to FIGS. 33 to 38. These support beams may have particular application for intermediate floors and internal walls of a building, which may be formed without thermal insulation.

FIGS. 33 and 34 show perspective and cross sectional views respectively of a support beam 160 according to an embodiment of the present invention. The support beam 160 comprises a web panel 162, a first flange 164 and a second flange 166. The web panel 162 may comprise an engineered wood. For example, the web panel 162 may comprise a composite material board or panel. For example, the web panel 162 may comprise OSB, hardboard, mdf, chipboard, plywood or the like.

In FIG. 33, the smallest dimension, or thickness, of the web panel 162 is the x-direction. The two dimensions generally perpendicular to the thickness of the web panel 162 may be considered to define the y-z plane. The web panel 162 has first and second opposed surfaces 168, 170. The first and second opposed surfaces 168, 170 are both generally parallel to the y-z plane.

The first and second surfaces 168, 170 are both generally rectangular, defined by four edges of the web panel 162. In particular, first and second edges 172, 174 of the web panel 162 are separated in the z-direction and define a height of the web panel 162. Similarly, it will be appreciated that third and fourth edges of the web panel 162 are separated in the y-direction and define a length of the web panel 162.

It will be appreciated that the dimensions of the web panel 162 may vary for different embodiments. The dimensions may be dependent on the intended use (and load) of the support beam 162. In one embodiment, the web panel 162 may have a thickness of the order of 8 to 12 mm. A height of the web panel (which may be the dimension in the z direction) may of the order of 240 mm.

The first flange 164 is attached to the web panel 162 proximate the first edge 172 of the web panel 162 and the second flange 166 is attached to the web panel 162 proximate to the second edge 174 of the web panel 162. The first and second flanges 164, 166 extend beyond the first and second surfaces 168, 170 of the web panel 162 in a direction generally perpendicular to a plane of the web panel 162.

The first and second flanges 164, 166 are formed from a metal material.

As can be best seen in FIG. 34, in cross section the first and second flanges 164, 166 each comprise a continuous loop of material which extends from the first surface 168 to the second surface 170. Furthermore, in cross section this continuous loop of material from the first surface 168 to the second surface 170 is generally uniform in cross section. In cross section the first and second flanges 164, 166 are each of the form of a hollow or tubular structure. This hollow or tubular structure has an opening, groove or channel for receipt of one of the first or second edges 172, 174 of the web panel 162.

In one embodiment, the first and second flanges 164, 166 are formed from sheet metal. For example, the first and second flanges 164, 166 may be formed from a light gauge rolled steel strip, for example, having a thickness of the order of 1 mm. The sheet metal may, for example, be folded or rolled to form the first and second flanges 164, 166. Alternatively, the first and second flanges 164, 166 may be formed using another process, for example a continuous process such as extrusion.

In the present embodiment, the cross sectional profile of the first flange 164 is substantially the same as the cross sectional profile of the second flange 166. This cross sectional profile can be best seen in FIG. 34.

In cross section the first and second flanges 164, 166 each comprise a continuous loop of material which extends from the first surface 168 to the second surface 170. In particular, the continuous loop of material comprises a first portion 176 that is in contact with the first surface 168 and a second portion 178 that is in contact with the second surface 170. Extending between the first and second portions 176, 178, the continuous loop or material comprises: a third portion 180 extending generally away from the first surface 168; a fourth portion 182 extending generally parallel to, but spaced apart from the first surface 168; a fifth portion 184 extending generally perpendicularly to a plane of the web panel 168; a sixth portion 186 extending generally parallel to, but spaced apart from the second surface 170; and a seventh portion 188 extending generally between the second and sixth portions 178, 186.

Although the third portion 180 and the fourth portion 182 are generally mutually perpendicular (the third portion 180 extending generally in the x-y plane and the fourth portion 182 extending generally in the z-y plane), the third portion 180 is inclined out of the x-y plane proximate the intersection 181 between the third portion 180 and the fourth portion 182 such that intersection 181 between the third portion 180 and the fourth portion 182 is at an acute angle. Similarly, although the seventh portion 188 and the sixth portion 186 are generally mutually perpendicular (the seventh portion 188 extending generally in the x-y plane and the sixth portion 186 extending generally in the z-y plane), the seventh portion 188 is inclined out of the x-y plane proximate the intersection 187 between the seventh portion 188 and the sixth portion 186 such that intersection 187 between the seventh portion 188 and the sixth portion 186 is at an acute angle.

In this way, the first and second flanges 164, 166 are each of the form of a hollow or tubular structure. This hollow or tubular structure has an opening, groove or channel for receipt of one of the first or second edges 172, 174 of the web panel 162.

Each of the first and second flanges 164, 166 is attached to the first and second surfaces 168, 170 of the web panel 162. This attachment provides resistance to shear forces (the shear plane of the support beam 160 being the plane of the web panel, i.e. the y-z plane). This attachment of the first and second flanges 164, 166 to the first and second surfaces 168, 170 of the web panel 162 prevents movement of the first and second flanges 164, 166 relative to the web panel 162. In some embodiments, the attachment of the first and second flanges 164, 166 to the first and second surfaces 168, 170 is sufficient to resist shear forces of the order of 2.5 kN or more.

It will be appreciated that the attachment of the first and second flanges 164, 166 to the first and second surfaces 168, 170 of the web panel 162 may be achieved in a variety of different ways.

In the present embodiment, the attachment of the first and second flanges 164, 166 to the first and second surfaces 168, 170 of the web panel 162 is via surfaces of the first and second flanges 164, 166 which are complementary to and in engagement with the first or second surfaces 168, 170. In particular, the first portion 176 of each of the first and second flanges 164, 166 is complementary to and in engagement with the first surface 168. Similarly, the second portion 178 of each of the first and second flanges 164, 166 is complementary to and in engagement with the second surface 170.

This engagement is achieved via plastic deformation of the mutually engaging surfaces of the first portions 176 and the first surface 168 (which may be flat prior to said plastic deformation) and plastic deformation of the mutually engaging surfaces of the second portions 178 and the second surface 170 (which may also be flat prior to said plastic deformation). Such plastic deformation may be achieved, for example, by using a punch to crimp the two adjacent surfaces together. For example, a punch may be used to cause the first and second flanges to bite into the web panel.

In particular, the attachment of either of the first and second flanges 164, 166 to the web panel 162 may be achieved in a similar way to the above-described process for the embodiment of the invention shown in FIGS. 10 to 12B wherein a steel strip 136 is attached to the interior and exterior surfaces 6*a*, 6*b* of a support panel 6.

Accordingly, the attachment of either of the first and second flanges 164, 166 to the web panel 162 is achieved by crimping the first portion 176 of the flange 164, 166 to the first surface 168 one of the web panel 162 and crimping the second portion 178 of the flange 164, 166 to the second surface 170 of the web panel 162 using tool to punch, clinch or crimp these surfaces together, at a plurality of positions along the length of the support beam 160. As a result, a plurality of dimples or recesses 190 is visible on the exterior surface of the first and second portions 176, 178 of the first and second flanges 164, 166. Although only the first portions 176 of the flanges 164, 166 are visible in FIG. 33 it will be appreciated that dimples or recesses 190 are also visible on the exterior surface of the second portions 178 of the first and second flanges 164, 166

As explained above with reference to FIGS. 12A and 12B, the attachment process may involve driving a tool tip into an exterior surface of the first and second portion 176, 178 of the flanges 164, 166 so as to cause plastic deformation of the surfaces of both the first and second portions 176, 178 of the flanges 164, 166 and the web panel 162 (which may be flat prior to said plastic deformation).

The tool tip may be generally as described above and may be generally cylindrical, having a diameter of the order of 4 to 6 mm. In one embodiment, the tip of the tool tip tapers to a rectangular edge, being similar in shape to a flat screwdriver. The tool tip may be driven in to a depth of the order of 3 to 4 mm. A distance between the centres of adjacent recesses 190 (formed by tool tip) may be of the order of 40 mm.

As described above with reference to FIG. 12B, the recesses 190 formed on the surface 168 of the web panel 162 may be offset in the y direction relative to the recesses formed on the second surface 170 of the web panel 162.

It will be appreciated that, alternatively, the attachment of the first and second flanges 164, 166 to the first and second surfaces 168, 170 of the web panel 162 may be achieved using screws, nails, rivets or other mechanical fixing.

The fifth portion 184 of each of the first and second flanges 164, 166 may be considered to be a wall portion which is generally perpendicular to a plane of the web panel 162.

The first and second flanges 164, 166 are provided with a feature for engagement with the first or second edge 172, 174 of the web panel 162. In particular, two ridges 192 are formed on the fifth portion 184 of each of the first and second flanges 164, 166. The two ridges 192 provide a location detail for the web panel 162, with is received in a groove formed between the two ridges 192.

The support beam 160 is generally of the form of an I beam. The support beam 160 may be suitable for use as a joist in part of a surface such as a floor, wall or ceiling. The support beam 160 is advantageous over known support beams, as now discussed.

Traditional floor joists are formed from solid timber beams. It has become increasingly common to use an I beam construction for floor joists. One known type of I beam that is used as a floor joist in the construction of buildings comprises a web formed from oriented strand board (OSB) and two solid flanges formed from timber. The OSB web is partially received in a groove in each of the solid timber flanges and attached thereto using adhesive to provide a connection which can resist shear forces.

In contrast to such known I beams or I joists, the support beam 160 described above uses first and second flanges 164, 166 which are formed from a metal material. This offers a significant advantage over the known arrangement since, unlike timber, metal materials may be formed to arbitrary lengths, for example using a range of continuous processes. Therefore, the support beam 160 can be easily manufactured to a range of different lengths. This allows the support beam 160 to be manufactured to the required length for each purpose with substantially no waste.

Furthermore, there are a number of additional advantages of using metal flanges 164, 166 as opposed to timber flanges, including cost, weight and formability.

In addition, the support beam 160 is formed from three parts (the web panel 162, the first flange 164 and the second flange 166), which are attached together (the first and second flanges 164, 166 being attached to the first and second opposed surfaces 168, 170 of the web panel 162). This provides significant advantages over, for example, a typical rolled steel joist (RSJ) which is typically formed entirely from solid steel. This construction, whereby the support beam 160 is formed from three parts which are attached together, advantageously, allows the use of more economical and lighter materials to be used for the web panel 162. Furthermore, it allows the first and second flanges 164, 166 to be formed as generally tubular or hollow structures, providing further cost and weight savings.

It will be appreciated that the shape of the first and second flanges 164, 166 may differ in other embodiments. By way of example, FIG. 35 shows a cross sectional view of a support beam 194 according to another embodiment of the present invention. The support beam 194 shown in FIG. 35 shares many features in common with that of the support beam 160 shown in FIGS. 33 and 34. Only the differences will be described in detail below. Any features of the support beam 194 shown in FIG. 35 which are generally the same as corresponding features of the support beam 160 shown in FIGS. 33 and 34 share common reference numerals therewith.

The support beam 194 comprises a web panel 162, a first flange 196 and a second flange 198. The first and second flanges 196, 198 share a number of features in common with the above described first and second flanges 164, 166.

In cross section the first and second flanges 196, 198 each comprise a continuous loop of material which extends from the first surface 168 to the second surface 170 of the web panel 162. Furthermore, in cross section this continuous loop of material from the first surface 168 to the second surface 170 is generally uniform in cross section. In cross section the first and second flanges 196, 198 are each of the form of a hollow or tubular structure. This hollow or tubular structure has an opening, groove or channel for receipt of one of the first or second edges 172, 174 of the web panel 162.

The first and second flanges 196, 198 may be formed from sheet metal. For example, the first and second flanges 196, 198 may be formed from a light gauge rolled steel strip, for example, having a thickness of the order of 1 mm. The sheet metal may, for example, be folded or rolled to form the first and second flanges 196, 198. Alternatively, the first and second flanges 196, 198 may be formed using another process, for example a continuous process such as extrusion.

The cross sectional profile of the first flange 196 is substantially the same as the cross sectional profile of the second flange 198. However, this cross sectional profile differs from that of the first and second flanges 164, 166 shown in FIGS. 33 and 35.

In cross section the first and second flanges 196, 198 each comprise a continuous loop of material which extends from the first surface 168 to the second surface 170. In particular, the continuous loop of material comprises a first portion 176 that is in contact with the first surface 168 and a second portion 178 that is in contact with the second surface 170. Furthermore, the continuous loop of material comprises a wall portion 184 which is generally perpendicular to a plane of the web panel 162 and which is provided with two ridges 192. However, in this embodiment, the wall portion 184 is connected to the first and second portions 176, 178 by generally straight wall portions 200, 202 respectively.

Extending between the first and second portions 176, 178, the continuous loop or material comprises: a third portion 180 extending generally away from the first surface 168; a fourth portion 182 extending generally parallel to, but spaced apart from the first surface 168; a fifth portion 184 extending generally perpendicularly to a plane of the web panel 168; a sixth portion 186 extending generally parallel to, but spaced apart from the second surface 170; and a seventh portion 188 extending generally between the second and sixth portions 178, 186.

In some embodiments, the support beams 160, 194 may further comprise a resiliently deformable member provided on the wall portion of at least one of the first and second flanges, as now discussed with reference to FIG. 36.

FIG. 36 shows a cross section of a part of a support beam according to another embodiment of the present invention. This support beam is substantially the same as the support beam shown in FIGS. 33 and 34 and described above although, as now explained it also comprises two additional elements.

In particular, this embodiment further comprises an elongate metal member 204 and an elongate resiliently deformable member 206. The resiliently deformable 206 may comprise a strip of foam material. The elongate metal member 204 may be formed from a light gauge steel strip that is shaped such that it can engage over the first flange 164 using a snap fit type coupling such that the resiliently deformable member 206 is held captive between the elongate metal member 204 and the first flange 164. An internal dimension of the elongate member 204 (in the z-direction) is greater than an external dimension of the first flange 164. Therefore, the elongate member 204 is movably connected to the first flange 164 with the resiliently deformable member 206 being disposed between the elongate metal member 204 and the first flange 164.

It will be appreciated therefore that the shape of elongate metal member 204 will, in general, be dependent on the shape of the flanges of the support beam (for example a different profile of elongate metal member may be used in conjunction with the flanges 196, 198 of the support beam 194 shown in FIG. 35). However, in general, the elongate metal member 204 may comprise a straight central wall section 208 and two side wall sections 210 extending generally perpendicularly to the central wall section 208. The side wall sections 210 may be provided with tab portions 212 that are arranged to snap fit over the flange 164.

When a compression force is applied to the central wall section 200, compression of the resiliently deformable member 206 allows the elongate metal member 204 to move towards the first flange 164 in the z-direction.

Such a resiliently deformable member 206 may provide some reduction in the amount of sound that is transmitted through a structure formed using the support beam. For example, the support beam may form a joist for a floor. For example, the resiliently deformable member 206 may be provided on one of the first and second flanges 164, 166 that in use will form a top of the joist (and which may support floorboards or the like). The resiliently deformable member 206 can absorb some sound and therefore at least partially prevent sound from being transmitted through the floor. Advantageously, the embodiment shown in FIG. 36 provides an integrated arrangement that aids the ease of installation of soundproofing solutions.

In some embodiments, the support beams 160, 194 may further comprise one or more engagement features for connection to a resilient bar, as now discussed with reference to FIG. 37.

FIG. 36 shows a perspective view of a part of a support beam according to another embodiment of the present invention. This support beam is substantially the same as the support beam shown in FIGS. 33 and 34 and described above although, as now explained it also comprises further comprise one or more engagement features for connection to a resilient bar.

A known and currently used method to prevent sound transmission through an intermediate floor is to screw resilient bars, in the form of a light gauge steel Z-section 214, to the bottom surface of timber floor joists. A ceiling substrate (for example plasterboard) is then attached to the resilient bars 214, which reduce the transmission of sound from the floor to a space below.

As shown in FIG. 36, in this embodiment, features of the form of generally L-shaped protrusions 216 are formed in the wall portion 184 (the fifth portion 184) of the second flange 166, said protrusions forming a groove for receipt of a portion of a Z-section resilient bar 214. Including these engagement features, for example on one of the first and second flanges that in use will form a bottom of the support beam will improve compliance and speed up installation. The ease of provision of such features on the first and second flanges is a further advantage of the support beams according to embodiments of the invention, which use metal flanges.

In some embodiments, the support beams may further comprise one or more hanging features for connection to a supporting structure that is generally perpendicular to the support beam, the one or more hanging features being provided on at least one of the first and second flanges. Sais one or more hanging features may be provided at one or both ends of the support beam (i.e. the two ends which are separated in the y-direction). It will be appreciated that these hanging features may be generally of the form of any known type of joist hanger but which is integrally formed with either or both of the first and second flanges.

Steel joist hangers are used to support the ends of a beam at a supporting structure that is generally perpendicular to the beam (for example a wall or a perpendicular supporting beam). Light gauge steel is used and requires many fixings between the joist hanger and the beam to ensure the structural performance. It is common in construction for installers to not put enough in fixings in (saving time). The one or more hanging features are integrally formed with the support beam and therefore facilitate quick and safe installation.

Some embodiments of the invention may relate to a support beam comprising: a plurality of support beams as described above (for example support beams 160, 194), as now described with reference to FIG. 38.

FIG. 38 shows a cross sectional view of a support beam 218 comprising two support beams 160 as shown in FIGS. 33 and 34 and described above.

The support beam 218 embodiment further comprises a first elongate connection member 220 arranged to connect to the first flanges 164 of the two support beams 160 as shown in FIGS. 33 and 34. The support beam 218 embodiment further comprises a second elongate connection member 222 arranged to connect to the second flanges 166 of the two support beams 160 as shown in FIGS. 33 and 34.

The first and second connection members 220, 222 are substantially the same and may be formed from a light gauge steel strip that is shaped such that it can engage over the first flanges 164 or the second flanges 166 using a snap fit type coupling. It will be appreciated therefore that the shape of the first and second connection members 220, 222 will, in general, be dependent on the shape of the flanges of the support beam (for example a different profile of elongate metal member may be used in conjunction with the flanges 196, 198 of the support beam 194 shown in FIG. 35). However, in general, the first and second connection members 220, 222 may comprise a straight central wall section 224 and two side wall sections 226 extending generally perpendicularly to the central wall section 224. The side wall sections 226 may be provided with tab portions 228 that are arranged to snap fit over the two flanges (either the two first flanges 164 or the two second flanges 166).

Additional fixings may be provided between the first and second elongate connection members 220, 222 and the first or second flanges 164, 166 of the two support beams 160 as shown in FIGS. 33, 34.

In the design of an intermediate floor or similar a beam may be required to carry several other beams or joists. The support beam 218 shown in FIG. 38 provides an arrangement having increased strength and second moment of area suitable for such applications.

While specific embodiments of the invention have been described above, it will be appreciated that the invention may be practiced otherwise than as described. The descriptions above are intended to be illustrative, not limiting. Thus it will be apparent to one skilled in the art that modifications may be made to the invention as described without departing from the scope of the claims set out below.

The invention claimed is:

1. A panel for a partition, the panel comprising:

a central panel extending in a first dimension, a second dimension, and a third dimension, the first dimension of the central panel being smaller than the second dimension and the third dimension of the central panel, the second dimension and the third dimension of the central panel defining a plane of the central panel, the central panel having a first face and a second face spaced apart from the first face, and the first face and the second face being generally parallel to the plane of the central panel;

two support panels disposed on opposed sides of the central panel, each of the two support panels extending in a first dimension, a second dimension, and a third dimension, the first dimension of each of the two support panels being smaller than the second dimension and the third dimension of each of the two support panels, the second dimension and the third dimension of each of the two support panels defining a plane of the respective one of the two support panels, the plane of each of the two support panels extending generally perpendicularly to the plane of the central panel, each of the two support panels having an external surface and an internal surface that provide two opposed surfaces of the support panel, and wherein protruding portions of the each of the two support panels extend perpendicularly to the plane of the central panel beyond both of the first face and the second face of the central panel; and a plurality of flanges, each flange included in the plurality of flanges being provided around a corresponding one of the protruding portions of the two support panels, and each flange comprising a flange member which is formed from a metal material having: a first portion adjacent to, generally parallel to, and mechanically attached to, the external surface of the support panel that is distal from the central panel; and a second portion having a portion which extends generally parallel to the plane of the central panel;

wherein together the first and second portions of each flange member defines a channel or groove for receipt of the protruding portion of the support panel to which the flange is mechanically attached.

2. The panel of claim 1, wherein the second portion of the flange member is wrapped round a timber batten.

3. The panel of claim 1, wherein the second portion of each flange member comprises: a portion which extends generally between the two opposed surfaces of the support panel; a portion which is generally parallel to the interior surface of the support panel opposite the external surface; and the portion which extends generally parallel to the plane of the central panel.

4. The panel of claim 3, wherein between the portion which extends generally between the two opposed surfaces of the support panel and the portion which is generally parallel to the interior surface of the support panel, each flange member comprises a protrusion portion, which extends out away from the interior surface of the support panel.

5. The panel of claim 3, wherein the second portion of the flange member is provided a barbed portion, which provides with a means for engaging with a face of the central panel.

6. The panel of claim 1, wherein a portion of each flange member is mechanically attached to the interior surface one of the support panels.

7. The panel of claim 6, wherein mechanical attachment of each flange member to the support panel is achieved by crimping the flange member to the support panel using a tool to punch, clinch or crimp each flange member to the support panel.

8. The panel of claim 7, wherein a tip of the tool is driven into an exterior surface of the flange member so as to cause plastic deformation of the surfaces of both the flange member and the support panel.

9. The panel of claim 1, wherein a side surface of either or both of the support panels is provided with a resilient sealing material.

10. A modular partition system comprising a plurality of panels according to claim 1, the modular partition system further comprising at least one connecting strip, wherein the at least one connecting strip extends around and couples with a flange member of a first panel included in the plurality of panels and with a flange member of a second panel included in the plurality of panels so as to connect the first panel with the second panel.

11. The modular partition system of claim 10, further comprising a resilient seal between the first panel and the second panel.

12. The modular partition system of claim 10, wherein in at least one direction the at least one connecting strip extends beyond the support panels of the first panel and the second panel which it is arranged to cooperate with.

13. The modular partition system of claim 10, wherein the at least one connecting strip is provided with one or more engagement features for engagement with at least one of a batten and a wall tie.

14. The modular partition system of claim 10, wherein the at least one connecting strip includes an elongate body defining a groove for receipt of a portion of a support member from each of the first panel and the second panel, wherein the elongate body is provided with one or more engagement features for engagement with at least one of a batten and a wall tie.

15. The modular partition system of claim 14, wherein each engagement feature comprises at least one pair of protrusions, each of the protrusions defining a guide channel for at least part of the batten, the guide channels of the pair of protrusions facing each other.

16. The modular partition system of claim 14, wherein each engagement feature comprises at least one generally L shaped protrusion defining a guide channel for receipt of the batten.

17. The modular partition system of claim 14, wherein on either side of the groove the elongate body defines a plurality of pairs of features for engaging the ends of the wall tie.

* * * * *